US006219505B1

(12) United States Patent
Sato et al.

(10) Patent No.: US 6,219,505 B1
(45) Date of Patent: Apr. 17, 2001

(54) IMAGE FORMING APPARATUS HAVING PAPER-DUST REMOVING DEVICES

(75) Inventors: Shougo Sato; Masahiro Ishii; Satoru Ishikawa; Takeshi Fuwazaki, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/409,386

(22) Filed: Sep. 30, 1999

(30) Foreign Application Priority Data

| | | |
|---|---|---|
| Sep. 30, 1998 | (JP) | 10-278033 |
| Sep. 30, 1998 | (JP) | 10-278034 |
| Jan. 12, 1999 | (JP) | 11-005276 |
| Jan. 18, 1999 | (JP) | 11-009266 |
| Feb. 8, 1999 | (JP) | 11-030531 |
| Mar. 16, 1999 | (JP) | 11-070020 |

(51) Int. Cl.[7] ..... G03G 21/00; G03G 15/08

(52) U.S. Cl. ..... 399/98; 399/349; 399/350; 399/353; 399/357

(58) Field of Search ..... 399/98, 107, 111, 399/149, 150, 343, 349, 350, 353, 357; 355/30

(56) References Cited

U.S. PATENT DOCUMENTS

| | | | | |
|---|---|---|---|---|
| 4,769,676 | | 9/1988 | Mukai et al. | 399/150 |
| 5,436,700 | * | 7/1995 | Kikuchi et al. | 399/111 |
| 5,497,224 | * | 3/1996 | Ishikawa et al. | 399/150 X |
| 5,587,774 | * | 12/1996 | Nagahara et al. | 399/150 X |
| 5,610,697 | * | 3/1997 | Arai | 399/149 |
| 5,659,869 | * | 8/1997 | Ohtsuka et al. | 399/333 |
| 5,701,559 | * | 12/1997 | Ootaka et al. | 399/149 |
| 5,740,498 | * | 4/1998 | Tsuchiya | 399/98 |
| 5,774,768 | * | 6/1998 | Hazama et al. | 399/170 |
| 5,826,153 | * | 10/1998 | Hazama et al. | 399/353 |

FOREIGN PATENT DOCUMENTS

| | | | |
|---|---|---|---|
| 59-049575 | * | 3/1984 | (JP) . |
| U-62-181973 | | 11/1987 | (JP) . |
| 1-161279 | * | 6/1989 | (JP) . |
| 1-295289 | * | 11/1989 | (JP) . |
| B2-2619424 | | 3/1997 | (JP) . |

OTHER PUBLICATIONS

Hosoya, M., et al., "Cleanerless Laser Printer Using Monocomponent Nonmagnetic Development System," *Academic Presentations in Electronics Photography*, vol. 30, No. 3 (1991).

* cited by examiner

*Primary Examiner*—Sophia S. Chen
(74) *Attorney, Agent, or Firm*—Oliff & Berridge, PLC

(57) ABSTRACT

In a first paper-dust removing device, a brush is supported by a support member that is attached to the interior of a casing. The first paper-dust removing device mainly removes pulp fibers of the paper dust, and is located downstream from a transfer position in the photosensitive drum rotating direction. A second paper-dust removing device is additionally provided. The second paper-dust removing device includes a support member that is attached to a casing of a developing cartridge. The support member supports a non-woven fabric that is lined by a sponge. The second paper-dust removing device mainly removes talc in the paper dust. The second paper-dust removing device is located downstream from the first removing device in the photosensitive drum rotating direction. In the second device, the non-woven fabric is contacted with the photosensitive drum at substantially zero contact pressure.

58 Claims, 34 Drawing Sheets

IMAGE FORMING APPARATUS HAVING PAPER-DUST REMOVING DEVICES

BACKGROUND OF THE INVENTION

1. Field of the Invention

The present invention relates to an image forming apparatus such as a laser printer.

2. Description of Related Art

Laser printers and other image forming apparatuses mainly include: a photosensitive drum, a developing roller, and a transfer roller. The photosensitive drum is formed with an electrostatic latent image on its outer peripheral surface. The developing roller is disposed in confrontation with the photosensitive drum. The developing roller supplies developing agent, such as toner, to the photosensitive drum, thereby developing the electrostatic latent image into a visible image. The transfer roller is disposed also in confrontation with the photosensitive drum. The transfer roller is applied with a transfer bias voltage with a polarity opposite to that of the photosensitive drum.

Especially in non-contact type printers, a charger uniformly charges the outer peripheral surface of the photosensitive drum. A laser generating unit modulates a laser beam based on image data, and scans the laser beam across the outer peripheral surface of the photosensitive drum. As a result, a corresponding electrostatic latent image is formed on the surface of the photosensitive drum. The developing roller conveys, on its surface, toner that is electrically charged to the same polarity as that of the photosensitive drum. The electrostatic latent image on the photosensitive drum is developed into a visible toner image with the toner supplied from the developer roller according to a well-known reversal development process. The thus developed visible image is then transferred from the photosensitive drum onto a sheet of paper that is passing between the photosensitive drum and the transfer roller. The visible image is pulled onto the sheet of paper by an electrostatic field that is generated by the transfer bias applied to the transfer roller. Thus, one image forming cycle is completed.

According to the above-described image forming cycle, some toner remains on the surface of the photosensitive drum after the toner image has been transferred from the photosensitive drum onto the sheet of paper. According to a well-known cleanerless method, this residual toner is collected during the next image forming cycle. Thus, in each image forming cycle, development and cleaning are performed simultaneously by the developing roller according to reversal development process.

According to this cleanerless method, there is no need to provide a blade or other type of cleaner device in the image forming apparatus. There is also no need to provide a vessel to accumulate waste toner. Accordingly, configuration of the entire image forming apparatus can be simplified and made more compact. The image forming apparatus can be produced less expensively.

It is noted that when the sheet of paper passes between the photosensitive drum and the transfer roller, paper dust clings to the surface of the photosensitive drum. This paper dust will be possibly collected together with the residual toner. When the toner is reused during a later development process, the paper dust can degrade the resultant visible image. When an acid type sheet is used as the sheet of paper, the paper dust includes filler material such as talc. The filler material can cause filming and so magnify the problem of the defective visible images.

In view of the above-described problems, there has been proposed that the cleanerless-type image forming apparatus be provided with a paper-dust removing device such as a brush. The paper-dust removing device is positioned in contact with the photosensitive drum in order to remove the paper dust that clings to the photosensitive drum.

However, because the paper-dust removing device is in contact with the photosensitive drum, the residual toner also clings to the paper-dust removing device together with the paper dust. This will reduce the ability of the paper-dust removing device to remove the paper dust. The toner clinging to the paper-dust removing device can be smashed into the surface of the photosensitive drum, thereby generating filming of toner on the surface of the photosensitive drum.

There have been proposed several types of paper-dust removing device such as: (1) a rotational brush roller; (2) another rotational brush roller whose constituent brush fibers are formed in loops; and (3) a rotational non-woven fabric roller that includes a rubber roller covered with a non-woven fabric. The rotational brush roller (2) is disclosed in Japanese patent application publication (kokai) No.HEI-1-116677), and the rotational non-woven fabric roller (3) is disclosed in Japanese utility model application publication (kokai) No.SHO-62-181973.

However, these devices (1) through (3) have the following problems.

Devices (1) and (2) are able to properly remove fibers included in the paper dust. However, the brush in these devices is unable to sufficiently remove filler material such as talc in the paper dust from an acidic paper. As a result, talc will possibly be collected together with residual toner on the developing roller. The collected talc will generate an undesirable fogging phenomenon during subsequent development processes. That is, when an electrostatic latent image is developed with toner mixed with talc, fogging will be formed on the white areas of a developed image and as a result the image will be poor.

Device (3) is designed to strongly press the non-woven fabric against the photosensitive drum in order to properly remove the filler material such as talc from the surface of the photosensitive drum. However, the non-woven fabric will scrape the paper dust across the surface of the photosensitive drum. As a result, the soft talc is spread across the surface of the photosensitive drum, resulting in filming of talc on the photosensitive drum surface. The performance of the photosensitive drum will deteriorate.

SUMMARY OF THE INVENTION

It is therefore an objective of the present invention to overcome the above-described problems and to provide an improved image forming apparatus that is capable of properly removing paper dust, even when an acidic paper is used as the transfer medium, without generating filming of toner and filler material on the photosensitive drum, thereby performing high quality image forming operation.

In order to attain the above and other objects, the present invention provides an image forming apparatus, comprising: an image bearing body having a surface that bears thereon a visible image that is formed through development of an electrostatic latent image by developing agent and that moves along a predetermined moving path in a predetermined moving direction, thereby carrying the visible image; a transfer member positioned in a predetermined transfer position along the moving path, the transfer member transferring the visible image from the image bearing body onto a recording medium; a first paper dust removing member that is positioned in a first predetermined position along the moving path downstream from the predetermined transfer position in the moving direction, the first paper dust removing member contacting the surface of the Image bearing body to remove a first component in paper dust that clings to the surface of the image bearing body; and a second paper dust removing member that is positioned in a second predetermined position along the moving path downstream from the first predetermined position in the moving direction, the second paper dust removing member contacting the surface of the image bearing body to remove a second component in the paper dust. The first component may be a fiber component in the paper dust. The second component may be a filler component in the paper dust.

According to another aspect, the present invention provides an image forming cartridge detachably mounted to an image forming apparatus, the image forming cartridge comprising: an image bearing body having a surface that bears thereon a visible image that is formed through development of an electrostatic latent image by developing agent and that moves along a predetermined moving path in a predetermined moving direction to carry the visible image to a predetermined transfer position; a first paper dust removing member that is positioned in a first predetermined position along the moving path downstream from the predetermined transfer position in the moving direction, the first paper dust removing member contacting the surface of the Image bearing body to remove a first component in paper dust that clings to the surface of the image bearing body; and a second paper dust removing member that is positioned in a second predetermined position along the moving path downstream from the first predetermined position in the moving direction, the second paper dust removing member contacting the surface of the image bearing body to remove a second component in the paper dust.

According to a further aspect, the present invention provides an image forming apparatus, comprising: an image bearing body having a surface that bears thereon a visible image which is formed through development of an electrostatic latent image by developing agent, the image bearing body conveying the visible image to a predetermined transfer position; a transfer member located on the transfer position for transferring the visible image from the image bearing body onto a recording medium; a paper dust removing member for removing paper dust clinging to the surface of the image bearing body after the visible image is transferred from the image bearing body onto the recording medium, the paper dust removing member including a contact portion that contacts the image bearing body and that is made of fibers Impregnated by oil agent.

According to another aspect, the present invention provides an image forming apparatus, comprising: an image bearing body having a surface that bears thereon a visible image which is formed through development of an electrostatic latent image by developing agent, the image bearing body moving along a predetermined moving path to thereby convey the visible image to a predetermined transfer position; a transfer member located on the transfer position for transferring the visible image from the image bearing body onto a recording medium; a paper dust removing member for removing paper dust clinging to the surface of the image bearing body after the visible image is transferred from the image bearing body onto the recording medium, wherein the paper dust removing member includes: a base member that is located in the vicinity of the moving path, along which the image bearing body moves, the base member being separated from the image bearing body with a predetermined amount of gap; and a sheet-shaped contact member that is made of fibers and formed in a sheet shape, the sheet-shaped contact member being supported by the base member to allow its contact portion to contact the image bearing body, the contact portion being separated from the base member.

According to another aspect, the present invention provides an image forming apparatus, comprising: an image bearing body having a surface that bears thereon a visible image which is formed through development of an electrostatic latent image by developing agent, the image bearing body moving along a predetermined moving path to thereby convey the visible image to a predetermined transfer position: a transfer member located on the transfer position for transferring the visible image from the image bearing body onto a recording medium; a paper dust removing member for removing paper dust clinging to the surface of the Image bearing body after the visible image is transferred from the image bearing body onto the recording medium, wherein the paper dust removing member includes: a base member that is located in the vicinity of the moving path, along which the image bearing body moves, the base member being separated from the image bearing body with a predetermined amount of gap; and a contact member that is made of fibers and that is supported by the base member to allow its portion to contact the image bearing body, wherein the base member is located vertically higher than the portion of the contact member that contacts the image bearing body, the contact member hanging down from the base member due to a gravitational force to contact the image bearing body.

According to still another aspect, the present invention provides an image forming apparatus, comprising: an image bearing body having a surface that bears thereon a visible image which is formed through development of an electrostatic latent image by developing agent, the image bearing body moving along a predetermined moving path in a predetermined moving direction to thereby convey the visible image to a predetermined transfer position; a transfer member located on the transfer position for transferring the visible image from the image bearing body onto a recording medium; a paper dust removing member for removing paper dust clinging to the surface of the image bearing body after the visible image is transferred from the image bearing body onto the recording medium, wherein the paper dust removing member includes: a resilient base member that is located in the vicinity of the moving path, along which the image bearing body moves, the resilient base member being formed from resilient material and being elongated in a direction intersecting with the moving direction in which the image bearing body moves, and a contact member that is made of fibers and that is located between the resilient base member and the image bearing body, the contact member being applied with an urging force from the resilient base member to thereby contact the image bearing body.

According to another aspect, the present invention provides an image forming apparatus, comprising: an image bearing body having a surface that bears thereon a visible image which is formed through development of an electrostatic latent image by developing agent, the image bearing body moving along a predetermined moving path in a predetermined moving direction to thereby convey the visible image to a predetermined transfer position; a transfer member located on the transfer position for transferring the visible image from the image bearing body onto a recording medium; a paper dust removing member for removing paper dust clinging to the surface of the image bearing body after the visible image is transferred from the image bearing body onto the recording medium, wherein the paper dust removing member includes: a resilient base member that is located in the vicinity of the moving path, along which the image bearing body moves, the resilient base member being formed from foam resilient material and being elongated in a direction intersecting with the moving direction in which the image bearing body moves; and a contact member that is made of fibers and that is located between the resilient base member and the image bearing body, the contact member being applied with an urging force from the resilient base member to thereby contact the image bearing body, the resilient base member having a corner edge portion, at which the resilient base member causes the contact member to contact the image bearing body surface along the direction intersecting with the moving direction, the contact member being located between the corner edge portion of the resilient base member and the image bearing body.

According to a further aspect, the present invention provides an image forming apparatus, comprising: an image bearing body having a surface that bears thereon a visible image which is formed through development of an electrostatic latent image by developing agent, the image bearing body conveying the visible image to a predetermined transfer position; a transfer member located on the transfer position for transferring the visible image from the image bearing body onto a recording medium; a paper dust removing member for removing paper dust clinging to the surface of the image bearing body after the visible image is transferred from the image bearing body onto the recording medium, wherein the paper dust removing member Includes: a sheet-shaped base member that is formed in a sheet shape; and a contact member that is made of fibers and that is attached to the sheet-shaped base member, the base member being positioned relative to the image bearing body so as to cause the contact member to contact the image bearing body.

According to another aspect, the present invention provides an image forming apparatus, comprising: an image bearing body having a surface that bears thereon a visible image which is formed through development of an electrostatic latent image by developing agent; a transfer member transferring the visible image from the image bearing body onto a recording medium; a paper dust removing member that contacts the surface of the image bearing body and that removes paper dust clinging to the surface of the image bearing body after the visible image is transferred from the image bearing body onto the recording medium, the paper dust removing member contacting the surface of the image bearing body with a contact force of an amount that maintains a pattern of the visible image after its contact with the surface of the image bearing body.

BRIEF DESCRIPTION OF THE DRAWINGS

The above and other objects, features and advantages of the invention will become more apparent from reading the following description of the preferred embodiment taken in connection wits the accompanying drawings in which;

FIG. 15(*b*) is a cross-sectional view of another example of the paper-dust removing device provided in the image forming apparatus of FIG. 14;

FIG. 15(*c*) is a cross-sectional view of still another example of the paper-dust removing device provided in the image forming apparatus of FIG. 14;

FIG. 19(*b*) illustrates the state of the paper-dust removing device when a photosensitive drum rotates:

FIG. 22(*b*) is a cross-sectional view of another modification of the paper-dust removing device of the fourth embodiment;

FIG. 26(*b*) is a perspective view showing how a urethane sheet is attached to the holder of FIG. 26(*a*);

FIG. 29(*b*) is a perspective view showing how a PET sheet is attached to the holder of FIG. 29(*a*);

FIG. 34(*b*) is a cross-sectional view illustrating the state how the first paper-dust removing device and a second paper-dust removing device of a further modification are provided:

FIG. 34(*c*) is a cross-sectional view illustrating the state how the first paper-dust removing device and a second paper-dust removing device of still another modification are provided;

FIG. 34(*d*) is a cross-sectional view illustrating the state how the first paper-dust removing device and a second paper-dust removing device of a further modification are provided;

FIG. 34(*e*) is a cross-sectional view illustrating the state how the first paper-dust removing device and a second paper-dust removing device of another modification are provided;

DETAILED DESCRIPTION OF PREFERRED EMBODIMENTS

Figure 1:
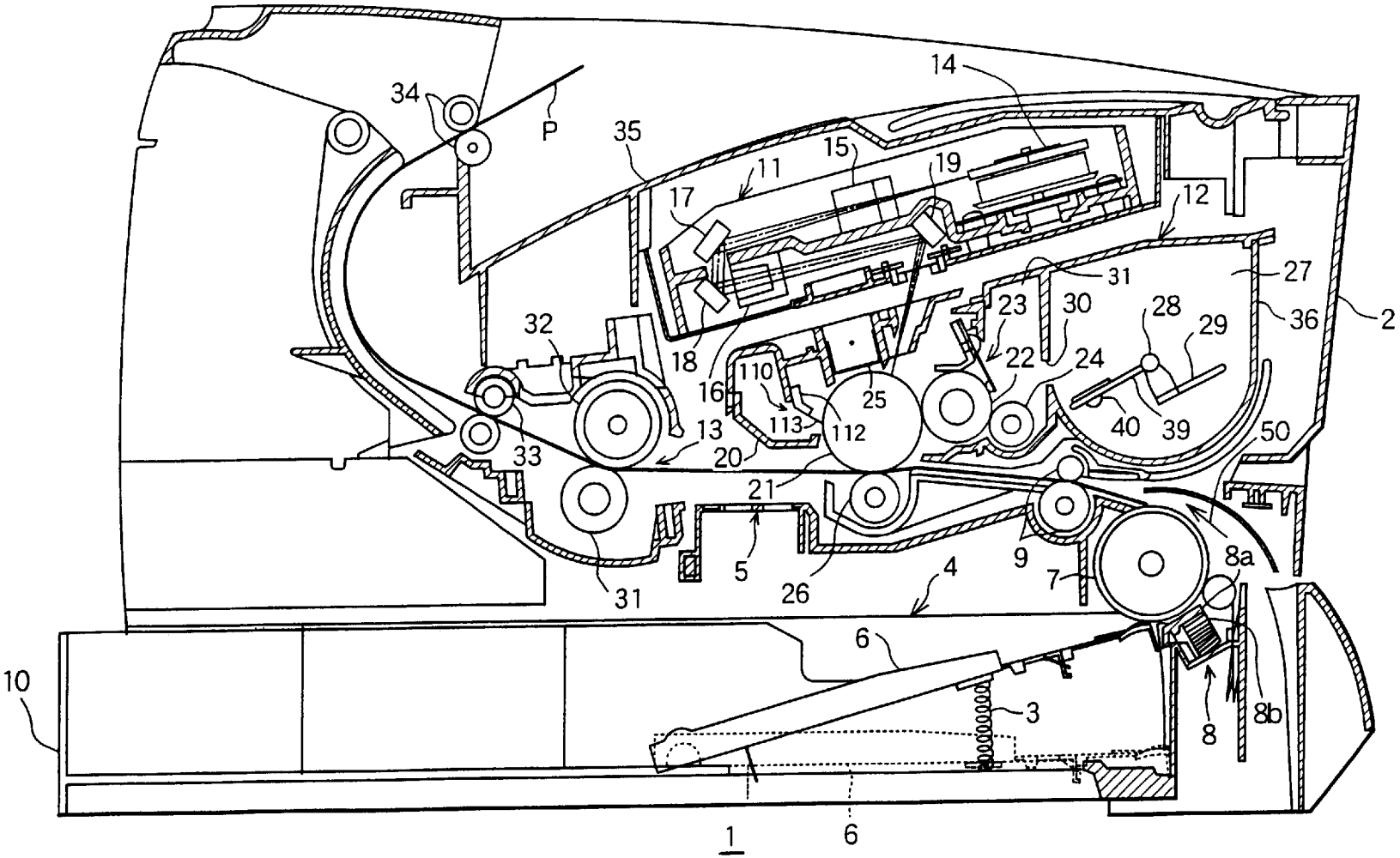
FIG. 1 is a cross-sectional view showing essential parts of a laser printer according to a first embodiment of the present invention.

An image forming apparatus according to preferred embodiments of the present invention will be described while referring to the accompanying drawings wherein like parts and components are designated by the same reference numerals to avoid duplicating description.

First Embodiment

An image forming apparatus according to a first embodiment of the present invention will be described below with reference to FIGS. 1–6.

FIG. 1 is a cross-sectional view showing essential parts of a laser printer 1 that serves as the image forming apparatus according to the first embodiment. As shown in FIG. 1, the laser printer 1 includes a housing or casing 2, in which a sheet feeding unit 4 and an image printing unit 5 are mounted. The sheet feed unit 4 is for supplying sheets of paper P (recording medium) to the image printing unit 5. The sheets of paper P serve as recording media to be printed with visible toner images. The image printing unit 5 is for printing visible toner images onto the sheets of paper P.

As shown in FIG. 1, the sheet feeding unit 4 is disposed at a bottom portion of the housing 2. The sheet feeding unit 4 includes: a sheet supply tray 10, a sheet separation member 8, a sheet supply roller 7, and a pair of register rollers 9. The sheet supply tray 10 is mounted detachably to the casing 2. The sheet supply roller 7 and the sheet separation member 8 are located within the casing 2 above one end of the sheet supply tray 10 when the sheet supply tray 10 is properly mounted within the casing 2. The pair of register rollers 9 are provided downstream from the sheet supply roller 7 with respect to a predetermined sheet transport direction A.

A sheet pressing plate 6 is provided within the sheet supply tray 10. Sheets of paper P can be stacked on the sheet pressing plate 6. The sheet pressing plate 6 is pivotably supported within the sheet supply tray 10 at its one end furthest from the sheet supply roller 7. Accordingly, the other end of the sheet pressing plate 6 nearest the sheet supply roller 7 is made movable in the vertical direction. A spring 3 is provided for urging the sheet pressing plate 6 upward from its under surface. With this arrangement, when the number of sheets stacked on the sheet pressing plate 6 increases, the sheet pressing plate 6 will pivot downwardly against the urging force of the spring 3 around its one end furthest from the sheet supply roller 7. One sheet at the upper most position on the stack on the sheet pressing plate 6 is pressed toward the sheet supply roller 7 by the spring 3 from the under side of the sheet pressing plate 6.

The sheet supply roller 7 and the sheet separation member 8 are disposed in confrontation with each other. The sheet separation member 8 includes a sheet supply pad 8*a* and a spring 8*b* provided to the rear side of the sheet supply pad 8*a*. The spring 8*b* presses the pad 8*a* towards the sheet supply roller 7. With this arrangement, when the sheet supply roller 7 rotates, the uppermost sheet is fed from the stack to a position between the sheet supply roller 7 and the sheet separation member B. As the sheet supply roller 7 further rotates, the uppermost sheet P is fed toward the pair of register rollers 9.

The register rollers 9 include a drive roller and a driven roller. The sheet P fed out by the sheet feed roller 7 has its front edge aliened by the register rollers 9 and then is transported to the image printing unit 5. In this way, one sheet at a time is fed out from the sheet feeding unit 4 and is transported along a predetermined sheet transport path 50 In a sheet transport direction A indicated by an arrow in the figure. Thus, a sheet of paper P is transported at a predetermined timing along the sheet transport path 50.

As shown in FIG. 1, the image printing unit 5 includes a scanner unit 11, an image forming unit 12, and a fixing unit 13.

The scanner unit 11 is provided in the upper portion within the casing 2. The scanner unit 11 includes: a laser generator portion (not shown in the drawing); a polygon mirror 14: lenses 15 and 16; and reflection mirrors 17, 18, and 19. The laser generating portion is for modulating a laser beam based on image date and for emitting the modulated laser beam. As indicated by a single dot chain line in FIG. 1, laser light emitted from the laser generation portion reflects at the polygon mirror (five-sided mirror, for s example) 14, passes through the lens 15, reflects at the reflection mirrors 17 and 18, passes through the lens 16, and reflects at the reflection mirror 19 in this order. The laser beam is finally irradiated across the surface of a photosensitive drum 21 that is provided in the image forming unit 12 as will be described later. Because the polygon mirror 14 is driven to rotate at a high speed, the laser beam is scanned across the surface of the photosensitive drum 21 at a high scanning speed.

Figure 2:
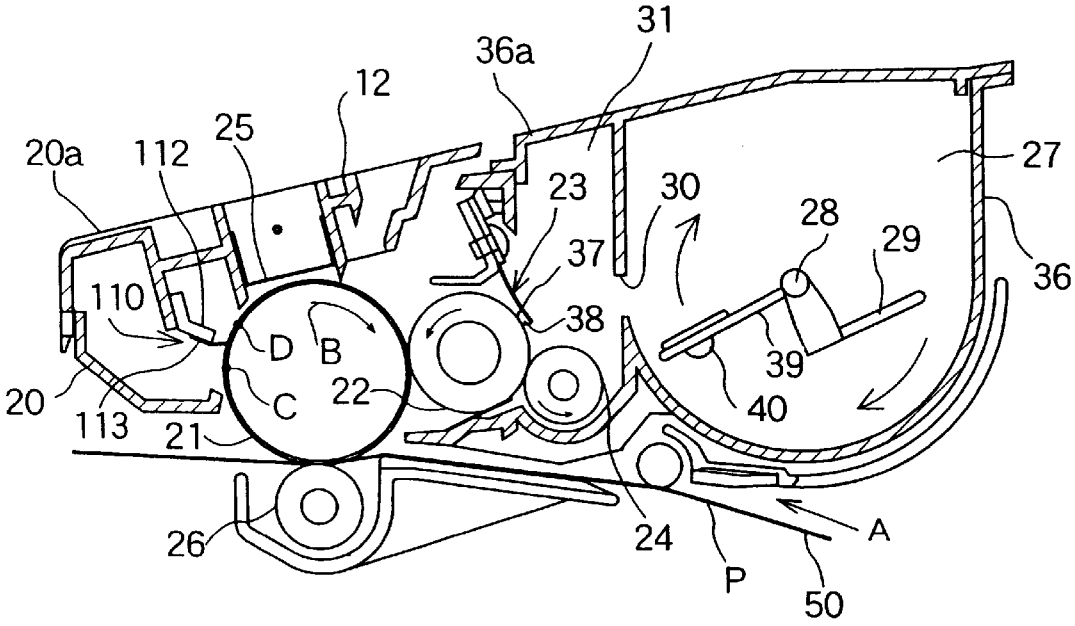
FIG. 2 is a cross-sectional view of an image forming unit provided in the laser printer of FIG. 1.

As shown in FIG. 1, the image forming unit (image forming cartridge) 12 is disposed below the scanner unit 11. As shown in FIG. 2, the image forming unit 12 includes a drum cartridge 20 that is detachably mounted within the casing 2. The image forming unit 12 also includes a development cartridge (development unit) 36 that is detachably mounted to the drum cartridge 20. Thus, the image forming cartridge 12 is constructed from a combination of the cartridges 20 and 36. The image forming cartridge 12 is detachably mounted to the casing 2.

In the drum cartridge 20, a photosensitive drum 21, a Scorotron charger 25, and a transfer roller 26 are mounted. The development cartridge 36 has a toner box 27 and a development chamber 31, In the development chamber 31, a supply roller 24, a developing roller 22, and a layer-thickness regulating blade 23 are provided.

The toner box 27 is filled with toner T. According to this embodiment, this toner T is a nonmagnetic single component development agent. The toner T has electrically insulating properties, and is adapted for being electrically charged to a positive polarity. This positive polarity toner can develop electrostatic latent images on the photosensitive drum 21 when the photosensitive drum 21 is electrically charged to a positive polarity. If negative polarity toner is used to develop electrostatic latent images on the photosensitive drum 21, it is necessary to electrically charge the photosensitive drum 21 to a negative polarity. It is noted, however, that when the Scorotron charger 25 is used to charge the photosensitive drum 21 to the negative polarity according to its non-contact position relative to the photosensitive drum 21, a great deal of ozone will be generated. In order to prevent generation of ozone, a conductive roller or brush can be used instead of the Scorotron charger. The conductive roller or brush has to be positioned in contact with the photosensitive drum 21 to electrically charge the photosensitive drum 21. With this method, however, irregularity will occur in the charge state on the surface of the photosensitive drum 21. Contrarily, according to this example, because the photosensitive drum 21 is charged to a positive polarity by the Scorotron charger, only an extremely small amount of ozone will be generated even when the Scorotron charger 25 is used in the non-contact condition. Additionally, the Scorotron charger can uniformly charge the photosensitive drum surface 21 with no irregularity. Accordingly, by using positive polarity toner, a uniform image development can be attained with only slight generation of ozone.

In this example, the toner T is a mixture of toner base particles with an external additive agent, such as silica, that is added to the outer surface of the toner base particles. The toner base particles have particle sizes in a range of between about 6 to 10 mm, with average particle diameter of about 8 mm. The external additive agent is added to the outer surface of the toner to improve fluidity of the toner.

The toner base particles are formed from a polymer that is produced by copolymerization of polymerizing monomers and that is mixed with coloring agent, wax, and charge control agent. The copolymerization process uses well known polymerization methods such as suspension polymerization. For example, the toner base particles can be formed by copolymerizing a styrene monomer, such as styrene, and an acryl monomer, such as acrylic acid, alkyl (C1–C4) acrylate, or alkyl (C1–C4) methacrylate. The thus polymerized toner base particles have a uniform particle diameter and therefore have a nearly spherical shape. The polymerized toner base particles have therefore extremely high fluidity and excellent charging ability. In this example, the toner base particles are formed from styrene acrylic resin that is formed by suspension polymerization into sphere shapes.

An example of the coloring agent mixed with the toner base particles includes carbon black.

Examples of the charge control agent include nigrosine, triphenylmethane, and quaternary ammonium salt.

The charge control agent is preferably made of charge control resin that is obtained by copolymerization of an two monomers, one of which is an ionic monomer. The ionic monomer has an ionic functional group such as ammonium salt. A representative example of the ionic monomer includes salt of N,N-diethyl-N-methyl-2-(methacrylo yloxy) ethyl ammonium and P-toluenesulfonic acid. Examples of the monomer that is capable of copolymerizing with the ionic monomer include: styrene monomers such as styrene; and acrylic monomers such as acrylic acid, alkyl (C1–C4) acrylate, and alkyl (C1–C4) methacrylate.

When using such a charge control resin, by appropriately selecting the ratios of the respective monomers, the intermolecular distance between mutual ionic functional groups can be optionally selected. More specifically, if a compound of a single monomer that has an ionic functional group, such as quaternary ammonium, is used as the charge control agent, the resistance value of the resultant toner will possibly decrease with increase in the compound amount added to the toner material. This is because as the amount of the compound added to the toner material increases, the ionic functional groups in the compound will become positioned directly next to one another. This reduction in resistance can lead to reduction in the charging ability of the toner. Contrarily, according to the present embodiment, the charge control resin is composed not only from a single ionic monomer but also from another monomer. Accordingly, even when the amount of the charge control resin mixed to the toner material increases, the resistance value will not decrease. In other words, it is possible to prevent decrease of the resultant resistance value by changing the ratio of the amount of the functional groups relative to that of the material compolymerizing with the functional groups. Thus, it is possible to enhance charging ability of the toner. In particular, a styrene-acryl copolymer including quaternary ammonium salt that is obtained by copolymerization of the above-described monomers has excellent dispersion characteristic and charge stability characteristic.

In this example, the toner base particles are made from styrene/acryl copolymer that is obtained by copolymerization of styrene monomer and acrylic monomer and that is added with charge control resin formed from styrene-acryl copolymer including quaternary ammonium salt. Because the thus copolymerized toner material and charge control resin have the same styrene-acryl composition, the charge control resin can be more uniformly dispersed within the polymerized toner material, thereby enhancing charge ability of the toner material.

As shown in FIG. 2, a rotational shaft 28 is provided in the center of the toner box 27. An agitator 29 is supported on the rotational shaft 28. A toner supply port 30 is opened at a side wall of the toner box 27. The toner T in the toner box 27 is agitated by the agitator 29 and is discharged through the toner supply port 30 to the development chamber 31. A window 40 for detecting the residual amount of toner T in the toner box 27 is provided in the side wall of the toner box 27. The window 40 is cleaned off by a cleaner 39, which is supported on the rotational shaft 28.

The development chamber 31 is provided in fluid communication with the toner box 27 via the toner supply opening 30. The toner supply roller 24 is mounted within the development chamber 31 at a location adjacent to the toner supply port 30. The toner supply roller 24 is mounted rotatable in a counterclockwise direction as indicated by an arrow in FIG. 2. The developing roller 22 is mounted also within the development chamber 31. The developing roller 22 is disposed In confrontation with the supply roller 24. The developing roller 22 is rotatable also in the counterclockwise direction indicated by the arrow in FIG. 2. The toner supply roller 24 and the development roller 22 are disposed in abutment contact with each other so that both of the rollers 24 and 22 are slightly compressed.

The supply roller 24 has a metallic roller shaft covered by a roller portion that is formed from a conductive foam material. The development roller 22 has a metallic roller shaft covered by a roller portion that is made from a conductive rubber material. The roller portion of the development roller 22 is constructed from a main roller body and a coat layer covering the outer surface of the main roller body. The main roller body is formed from urethane rubber or silicone rubber and is dispersed with carbon fine particles. The main roller body therefore has electric conductivity. The coat layer is formed from urethane rubber or silicone rubber dispersed with fluorine. Because fluorine tends to charge to a negative polarity, the coat layer can enhance the positively-changing nature of the toner while bearing the toner thereon. The developing roller 22 is applied with a transfer bias with a polarity opposite to that of the photosensitive drum 21. The developing roller 22 has an electric resistance, of an amount between about $10^4$ and $10^8\Omega$, from its shaft center to its outer surface.

The layer-thickness regulating blade 23 is disposed within the development chamber 31 at a location adjacent to the development roller 22. The layer-thickness regulating blade 23 includes a blade body 37. The blade body 37 is formed from a plate spring that is made of metal such as stainless steel (SUS). A pressing portion 38 is integrally formed with the blade body 37 at its free end. The pressing portion 38 has a semicircular shape in cross-section and is formed from electrically-insulating silicone rubber. The blade body 37 is supported, at its base end, on a side wall 36*a* of the development cartridge 36. The blade body 37 is supported on the side wall 36*a* of the development cartridge 36 at such a location that the pressing portion 38 will be pressed against the development roller 22 by the resilient force of the blade body 37.

With this structure, when toner T is discharged from the toner box 27 into the development chamber 31, the toner T is supplied to the development roller 22 by rotation of the toner supply roller 24. The toner is electrically charged to a positive polarity due to friction between the toner supply roller 24 and the development roller 22, while being supplied onto the development roller 22. In association with rotation of the development roller 22, the toner on the development roller 22 passes between the developing roller 22 and the pressing portion 38 of the layer-thickness regulating blade 23. The toner is even further charged by friction between the developing roller 22 and the pressing portion 38, while being regulated to a toner layer of a predetermined thickness on the developing roller 22.

The photosensitive drum 21 is mounted in the drum cartridge 20. The drum cartridge 20 is detachably mounted to the side wall 36*a* of the development cartridge 36 so that the photosensitive drum 21 becomes in confrontation with the development roller 22. The photosensitive drum 21 is rotatably mounted. A drive mechanism (not shown) is provided to drive the photosensitive drum 21 to rotate at a predetermined timing in a clockwise direction B indicated by an arrow in FIG. 2.

Figure 3:
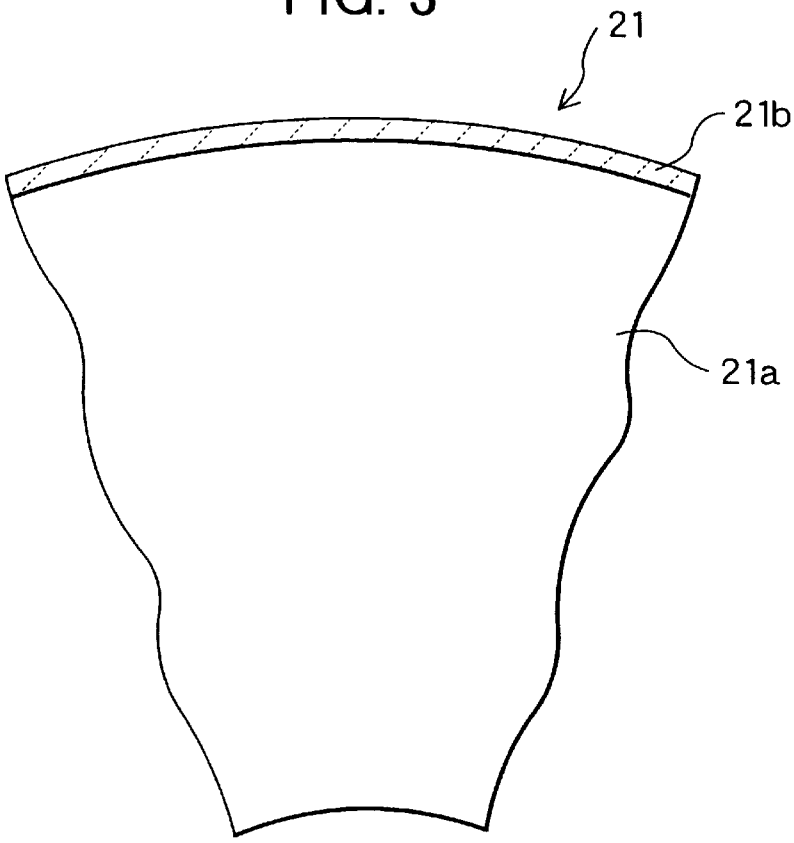
FIG. 3 is a cross-sectional view of an essential portion of a photosensitive drum employed in the image forming apparatus of FIG. 2.

The photosensitive drum 21 is constructed from a sleeve (drum body) that is electrically grounded, and a photosensitive layer formed on the outer surface of the sleeve. The photosensitive layer is formed from a material that is electrically charged to a positive polarity. For example, the photosensitive layer is made from an organic photoconductor whose main composition is polycarbonate. In this example, as shown in FIG. 3, the photosensitive drum 21 has a hollow cylindrical sleeve 21*a* made of aluminum. A photoconductive layer 21*b* is provided over the outer peripheral surface of the sleeve 21*a*. The photoconductive layer 21*b* is made of polycarbonate dispersed with photoconductive resin, and has a predetermined thickness of about 20 micrometers, for example. The sleeve 21*a* is electrically grounded and is rotatably mounted to the drum cartridge 20.

The Scorotron charger 25 is mounted in the drum cartridge 20 at a location that is above the photosensitive drum 21 and that is separated from the photosensitive drum 21 by a predetermined distance. The Scorotron charger 25 is a positively charging type. The Scorotron charger 25 includes a tungsten wire or other type charge wire, and generates corona discharge therefrom. The Scorotron charger 25 is configured so as to be capable of electrically charging the surface of the photosensitive drum 21 uniformly to a positive polarity.

After the Scorotron charger 25 uniformly charges the surface of the photosensitive drum 21 to a positive polarity, the scanner unit 11 exposes the surface of the photosensitive drum 21 with a laser beam that is modulated by image data. When the electrically-charged surface of the photosensitive drum 21 is exposed to the laser beam, the electric potential at exposed portions is reduced to an electric potential lower than at non-exposed portions and at the developer roller 22. Thus, an electrostatic latent Image is formed on the surface of the photosensitive drum 21.

As the development roller 22 rotates, the positively charged toner borne on the development roller 22 is brought into contact with the surface of photosensitive drum 21. As a result, the toner is supplied only to those areas that have their electric potential reduced according to the electrostatic latent image. Thus, the toner is selectively supplied to the surface of the photosensitive drum 21 to develop the electrostatic latent image into a visible toner image. Reversal development is achieved in this manner.

The transfer roller 26 is mounted in the drum cartridge 20 at a position below the photosensitive drum 21 and in confrontation with the photosensitive drum 21. The transfer roller 26 is mounted rotatable in the counterclockwise direction indicated by the arrow in FIG. 2. The transfer roller 26 has a metallic roller shaft covered with a roller made of a resilient conductive form material such as rubber material (silicone rubber or urethane rubber, for example). The transfer roller 26 is applied with a transfer bias that has a polarity opposite to that of the photosensitive drum 21. Accordingly, the positively-charged toner borne on the photosensitive drum 21 is electrostatically attracted in a direction toward the transfer roller 26.

A part of the sheet transport path 50 downstream from the register rollers 9 passes through a predetermined transfer position that is defined between the photosensitive drum 21 and the transfer roller 26. Accordingly, the sheet of paper P passes through the predetermined transfer position between the photosensitive drum 21 and the transfer roller 26. With this arrangement, the visible toner image borne on the photosensitive drum 21 is transferred from the photosensitive drum 21 to a sheet of paper P that is being conveyed between the photosensitive drum 21 and the transfer roller 26.

As shown in FIG. 1, the fixing unit 13 is disposed downstream from the developing unit 12 along the sheet transport path 50 in the sheet transport direction A. The fixing unit 13 includes a thermal roller 32 and a pressing roller 31 that is pressed against the thermal roller 32. The thermal roller 32 is a hollow roller formed of metal, and encloses therein a halogen lamp for heating the roller 32. The thermal roller 32 is for thermally fixing toner onto a sheet of paper P as the sheet of paper P passes between the pressing roller 31 and the thermal roller 32.

A pair of transport rollers 33 are provided downstream from the fixing unit 13 in the sheet transport direction A. The sheet of paper P is therefore transported by the transport rollers 33 to a pair of discharge rollers 34. When the sheet of paper P reaches the pair of discharge rollers 34, the sheet of paper P is discharged by the discharge rollers 34 onto a discharge tray 35 that is provided on the upper surface of the casing 2.

With the above-described structure, during one image forming procedure, the charge unit 25 uniformly charges the surface of the photosensitive drum 21 to a predetermined electric potential (which will be referred to as "original electric potential" hereinafter) of a positive polarity. When the laser scanner unit 11 irradiates the surface of the photosensitive drum 21 with laser light L that has been modulated according to image information, the electric potential of the photosensitive drum drops, at its laser beam-exposed region, from the original potential to an electric potential lower than that of the development roller 22. Thus, a corresponding electrostatic latent image is produced on the surface of the photosensitive drum 21. The electrostatic latent image is made from an image area corresponding to the laser-exposed region having the reduced electric potential. A non-image area corresponds to an unexposed region that maintains the original electric potential. The positively-charged toner supported on the development roller 22 is electrostatically attracted toward the electrostatic latent image area having the reduced electric potential. Thus, the electrostatic latent image is developed into a visible toner image.

Rotation of the photosensitive drum 21 conveys the visible toner image formed thereon in the rotating direction B to the transfer position where the transfer roller 26 abuts against the photosensitive drum 21. At the transfer position, the visible toner image is transferred onto a sheet of paper P that has been supplied from the sheet feeder unit 4. Because the polarity of the transfer bias applied to the transfer roller 26 is opposite to those of the photosensitive drum 21 and of the toner, the visible toner image is transferred from the photosensitive drum 21 to the sheet of paper P that is being conveyed between the photosensitive drum 21 and the transfer roller 26.

Next, the sheet of paper P is transported to the fixing unit 13 and is further transported while being sandwiched between the thermal roller 32 and the pressing roller 31. Thus, the visible toner image is pressed and heated on the sheet of paper P and fixed onto the sheet P. The sheet P is discharged onto the discharge tray 35 at the upper surface of the laser beam printer 1 by the transport rollers 33 and the discharge rollers 34. This completes one cycle of image forming process.

According to the predetermined cleanerless method, when some residual toner remains on the surface of the photosensitive drum 21 after the transfer process during one image forming cycle, the residual toner will be collected by the developing roller 22 during the next image forming cycle, and will be reused for subsequent developing processes.

More specifically, during each cycle of image forming process, some toner remains on the photosensitive drum 21 after the toner image has been transferred onto the sheet of paper P. At the next image forming cycle, rotation of the photosensitive drum 21 first brings the residual toner into confrontation with the charge unit 25. When the charge unit 25 uniformly charges the photosensitive drum 21 back to the original electric potential, the residual toner is also charged to the original electric potential. Then, the laser beam exposure unit 11 irradiates the photosensitive drum 21 with a laser beam that is modulated corresponding to image information. As a result, the electric potential at the exposed area drops from the original potential, while the electric potential at the non-exposed area maintains the original potential. Further rotation of the photosensitive drum 21 brings the residual toner into confrontation with the development roller 22. Toner on the development roller 22 is transferred onto the exposed area, and therefore a part of the residual toner that exists on the exposed area will be burled in the newly-supplied toner. A remaining part of the residual toner that is located on the non-exposed area of the photosensitive drum 21 are electrostatically attracted to the development roller 22. Thus, the development roller 22 develops the electrostatic latent image while simultaneously collecting the residual toner on the photosensitive drum 21. According to this cleanerless process, there is no need to provide a cleaner device for cleaning residual toner. There is no need to provide a separate vessel for accumulating waste toner. Configuration of the printer 1 can therefore be simplified and made compact. Also, cost for producing the printer 1 can be reduced.

It is noted that in the laser printer 1 having the above-described structure, the surface of the photosensitive drum 21 directly contacts the sheet of paper P. Therefore, paper dust easily clings to the surface of the photosensitive drum 21. If the paper dust is allowed to remain on the surface of the photosensitive drum 21 together with the residual toner, the paper dust will possibly be collected by the developing roller 22 together with the residual toner. This can result in formation of defective images during the subsequent image forming cycles.

In order to solve this problem, according to the present embodiment, the laser printer 1 is provided with a paper-dust removing device 110. The paper-dust removing device 110 serves to remove paper dust that clings to the photosensitive drum 21. As shown in FIG. 2, the paper-dust removing device 110 is disposed downstream from the transfer roller 26 and upstream from the charging unit 25 and the development roller 22 with respect to the rotational direction B of the photosensitive drum 21. The paper-dust removing device 110 is located in contact with the surface of the photosensitive drum 21.

Figure 4:
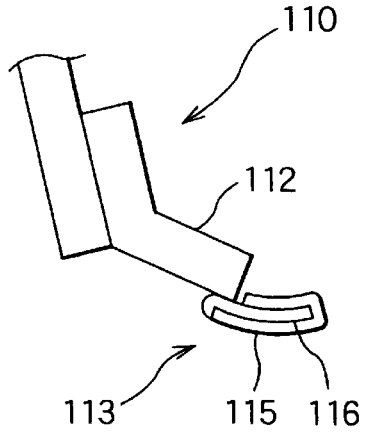
FIG. 4 is a cross-sectional view of a paper-dust removing device of FIG. 2.

As shown in FIG. 4, the paper-dust removing device 110 includes: a base member 112 and a contact member 113 supported on the base member 112. As shown in FIG. 2, one end of the base member 112 is fixed to a side wall 20*a* of the drum cartridge 20. One end of the contact member 113 is fixed to the other end of the base member 112. The contact member 113 is for contacting with the surface of the photosensitive drum 21. The contact member 113 is formed from: a back lining member 116 made from a urethane sheet, for example; and a non-woven fabric 115 lined by the back lining 116. One end of the lining member 116 is connected to the base member 112. With this structure, the pressure applied by the contact member 113 against the surface of the photosensitive drum 21 can be adjusted by appropriately selecting the material of the back lining member 116.

According to the present embodiment, the pressure applied by the contact member 113 is adjusted to a relatively weak value so that if residual toner remains in some particular pattern on the photosensitive drum 21 after the toner image transfer operation, the contact member 113 will not disturb the subject pattern when it contacts with the photosensitive drum 21. That is, the pattern of the residual toner will be maintained the same both before and after the contact member 113 contacts with the toner on the photosensitive drum 21.

Figure 5:
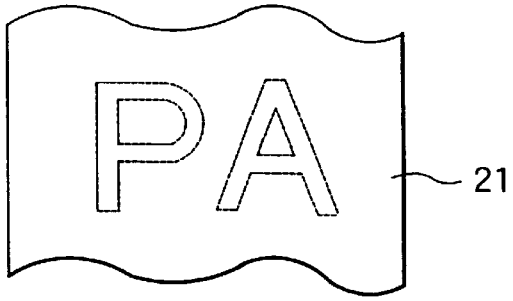
FIG. 5 illustrates an example of toner remaining on the photosensitive drum as representing some pattern image.

For example, if a toner character pattern SPA- is transferred from the photosensitive drum 21 onto the sheet of paper P, then after this transfer process, some toner will remain in the same "PA" pattern as shown in FIG. 5. That is, the toner image pattern of FIG. 4 appears at location C in FIG. 2. The pressure applied by the contact member 113 is adjusted, in correspondence with the nature of the toner, to a value that is appropriate for maintaining the residual toner in the same "PA" pattern after the contact member 113 has contacted the residual toner. Accordingly, the same "PA" pattern shown in FIG. 5 will remain even at location D in FIG. 2.

The contact member 113 is disposed upstream from the development roller 22 and downstream from the transfer roller 26 with respect to the rotational direction B of the photosensitive drum 21. With this arrangement, after the visible toner image borne on the photosensitive drum 21 is transferred onto the sheet of paper P by the transfer roller 26, paper dust clinging to the photosensitive drum 21 will be removed by the paper-dust removing device 110. Afterward, the residual toner still remaining on the photosensitive drum 21 will be collected by the development roller 22 according to the above-described cleanerless method. Accordingly, the residual toner collected by the development roller 22 is totally absent of undesirable paper dust. As a result, the collected toner can be properly reused during subsequent image forming cycles without defective images being generated by paper dust.

The contact member 113 can properly remove paper dust clinging to the surface of the photosensitive drum 21 by contacting with the surface of the photosensitive drum 21. The contact member 113 contacts the photosensitive drum 21 with a pressure of an amount sufficiently maintaining the residual toner image on the surface of the photosensitive drum 21 in the same pattern as before and after the contact member 113 contacts with the photosensitive drum 21. Therefore, the toner will almost never cling to the contact member 113. The paper-dust removing device 110 will continue to properly functioning to remove paper dust without any dropping efficiency, which can be caused by toner clinging to the contact member 113. Also, filling can be effectively prevented from occurring on the photosensitive drum 21 by toner accumulating on the paper-dust removing device 110.

According to the present embodiment, polymerized toner, which has a good fluidity and charge ability, is used. Because the toner has good fluidity, it will not easily cling to the paper-dust removing device 110 when it contacts to the paper-dust removing device 110. Accordingly, it is possible to effectively prevent decrease in the paper dust removing ability of the paper-dust removing device 110 that can occur when toner clings to the paper-dust removing device 110. It is possible to effectively prevent generation of filming that can occur when toner accumulates on the paper-dust removing device 110. Also because of the good fluidity of the polymerized toner, the toner can be properly collected electrostatically by the developing roller 22. Thus, the toner can be collected with a high efficiency by the cleanerless method.

Even if the non-woven fabric 115 contacts with the photosensitive drum 21 only with a weak pressure, the paper is dust can be properly caught up by constituent fibers of the non-woven fabric 45.

Thus, according to the present embodiment, the visible toner image formed on the photosensitive drum 21 is conveyed by the photosensitive drum 21 to the transfer position where the visible Image is transferred onto a sheet of paper P. Even when paper dust clings to the photosensitive body, the paper dust will be properly removed by the paper-dust removing device 110. Any defective images will not be formed on the photosensitive drum 21. Especially, the paper dust removing device 110 is designed so that the contact member 113 can contact the photosensitive drum 21 with a small pressing force whose amount is adjusted to allow the residual toner remaining on the photosensitive drum 21 to remain as representing the same pattern image even after contact by the contact member 113. The amount of the pressing force is adjusted dependently on the characteristics of the toner used.

Figure 6:
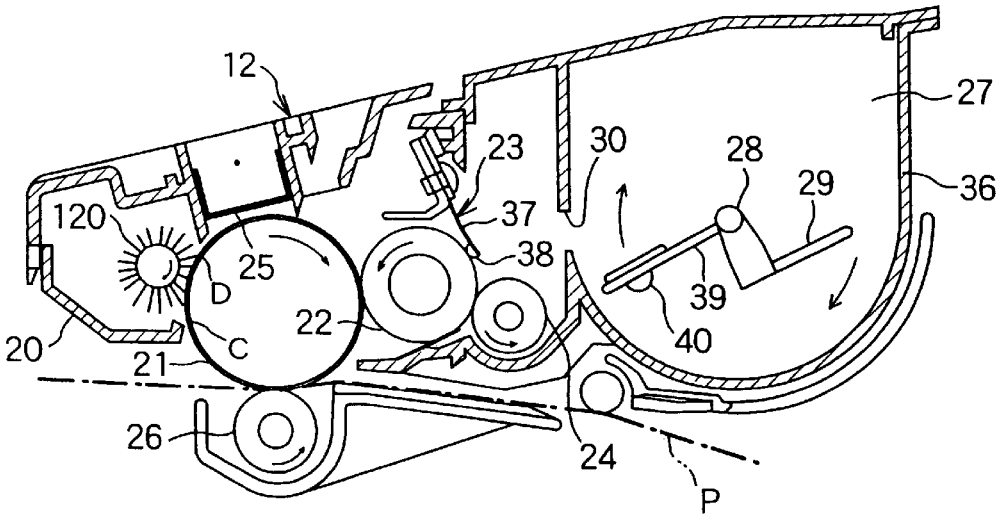
FIG. 6 is a cross-sectional view of another example of the image forming unit provided in the laser printer of FIG. 1.

In the above description, the paper-dust removing device 110 is of a fixed type, wherein the one end of the contact member 113 is fixed to the base member 112. However, the paper-dust removing device is not limited to this type, but can have any configuration wherein the pressure can be adjusted to such a weak value that will not disturb the residual toner image. For example, a paper-dust removing is device 120 constructed from a rotating brush as shown in FIG. 6 can be used. Although not shown in the drawing, a driving mechanism (not shown) is provided to drive the rotating brush 120 in a clockwise direction indicated by an arrow In the figure. The pressing force against the photosensitive drum 21 can be adjusted by adjusting the stiffness and bending amount of the rotating brush 120.

It is noted that more than one of the paper-dust removing device 110 of FIG. 4 can be provided to the single photosensitive drum 21. Similarly, more than one roller 120 of FIG. 6 can be provided to the single photosensitive drum 21. Both of the paper-dust removing devices 110 and 120 can be used together to the single photosensitive drum 21.

Experiments

Experiments were performed to evaluate how the pressing forces of the paper-dust removing devices 110 and 120 against the photosensitive drum 21 influences the image forming quality.

A first set of three samples with different pressing forces were prepared for the paper-dust removing device 110. All the samples have the same contact member 113, that is, the same back lining 116 and the same non-woven fabric 115. The respective samples 110 are different in their base members 112. More specifically, the first sample has the base member 112 formed from a urethane sheet, and is considered to present a weak pressing force against the photosensitive drum 21. The second sample has the base member 112 formed from a PET (polyethylene terephthalate) sheet, and is considered to present a medium pressing force against the photosensitive drum 21. The third sample has the base member 112 formed from a urethane rubber plate, and is considered to present a strongest pressing force against the photosensitive drum 21.

Similarly, another set of three samples with different pressing forces were prepared for the paper dust removing brush 120. The pressing forces of the samples were adjusted by changing the bending amount of brush-constituent fibers in the samples. More specifically, the first sample was located as separated with a large distance from the photosensitive drum 21 so that the brush-constituent fibers were bent at the smallest amount and therefore presented the weakest pressing force against the photosensitive drum 21. The second sample was located closer to the photosensitive drum 21 so that the brush-constituent fibers were bent at a larger amount and therefore presented a stronger pressing force (medium pressing force) against the photosensitive drum 21, The third sample was located closest to the photosensitive drum 21 so that the brush-constituent fibers were bent at the largest amount and therefore presented the strongest pressing force (strong pressing force) against the photosensitive drum 21.

The thus prepared six different samples were mounted one at a time in the printer 1 of the configuration of FIG. 1. Then, experiments were performed as described below for each sample.

First, the laser printer 1 was operated to print Japanese characters, hiragana, in a Ming-Cho font with a size of 3 mm×3 mm square, while turning off the transfer bias of the transfer roller 26. In this case, because no bias voltage was applied to the transfer roller 26, a visible toner image of the Japanese letters formed on the photosensitive drum 21 was not transferred to a sheet of paper P, but continued being borne on the photosensitive drum 21. Accordingly, as the photosensitive drum 21 rotates, the visible toner image was conveyed to the location C (FIG. 2 or 6), passed by the presently-mounted sample of the paper-dust removing device 110 or 120, and reached the location D (FIG. 2 or 6). The visible toner image that reached the location D was visually observed, and evaluation was performed whether the toner image was disturbed by the presently-mounted sample 110 or 120. More specifically, it was confirmed that some slight blurring was generated on the toner image when some vertical lines were visible to the naked eye in the horizontal lines in the toner image. The results of this experiment are shown in Table 1 below.

TABLE 1

| Paper-Dust Removing Device | Pressing Force | State of Character pattern after passage by the paper-dust removing device | Filming of the photosensitive drum by toner | Paper Dust Removed State |
|---|---|---|---|---|
| 110 | weak | no change | No filming occurred for 30,000 sheets. | G |
| 110 | medium | some blurring | Filming occurred after printing of 12,000 sheets. | G |
| 110 | strong | barely legible | Filming occurred after printing of 3,000 sheets. | G |
| 120 | weak | no change | No filming occurred for 30,000 sheets. | F |
| 120 | medium | some blurring | Filming occurred after printing of 16,000 sheets. | F |
| 120 | strong | barely legible | Filming occurred after printing of 6,000 sheets. | G |

Next, the laser printer 1 was operated to print the same Japanese characters at the same size, while turning on the transfer bias of the transfer roller 26. Accordingly, at this time, the Japanese letters were printed on sheets of paper P. Each time the resultant printed material was produced, it was evaluated whether the printed material was influenced from any toner filming phenomenon. The printing was repeatedly conducted until defective printing occurred due to toner filming. The printing was repeatedly conducted onto 30,000 sheets of paper P at maximum if no defective printing occurred due to toner filming. The results of this experiment are also shown in Table 1 above.

Each time the resultant printed material was thus produced, it was also evaluated whether the printed material was influenced from any paper dust. That is, the printed patterns on the printed material were visually observed, and it was evaluated whether traces caused by paper dust could be seen in the printed image. The results of this experiment are also shown in Table 1.

In Table 1, the symbol "G (good)" indicates that absolutely no traces caused by paper dust could be observed on the printed material. The symbol "F (fair)" indicates that some traces were observed on at least one sheet of paper P. It is noted, however, that categories with symbol "F" are considered still acceptable because the observed paper dust traces were not striking in comparison with paper dust traces that are produced when no paper powder removal devices 110 or 120 is provided.

As apparent from the experimental results shown in Table 1, it is confirmed that both of the paper-dust removing devices 110 and 120, whose pressing forces were adjusted to weak amounts, did not change or disturb the toner character pattern when the toner character pattern passed by the paper-dust removing device 110 or 120. Also no defective printing was caused by filming. In contrast to this, the paper-dust removing devices 110 and 120, whose pressing forces were adjusted to medium or strong, disturbed the toner character pattern when the toner character pattern passed by the paper-dust removing device 110 or 120. Also, defective printing caused by filming was generated before 30,000 sheets were printed.

The paper-dust removing devices 110 and 120 set with the same weak force, however, showed different characteristics with respect to the observed states of paper dust traces. That is, the device 110 showed absolutely no paper dust traces, but the brush 120 sometimes generated paper dust traces.

In the above-described experiments, polymerized toner was used. In additional experiments, crushed toner was used instead of polymerized toner, and the same experimentations described above were performed. When crushed toner was used, however, ghosting was observed. That is, it was observed that the printed pattern remained even after the photosensitive drum 21 rotated once.

Second Embodiment

A second embodiment will be described below with reference to FIGS. 7–13.

This embodiment provides an image forming apparatus that can form high quality images even on acidic papers by properly removing paper dust from the photosensitive drum.

First, a detailed explanation will be given for how paper dust generated from the sheets of paper P causes poor images. The main component of paper is pulp fiber, which is cellulose extracted from coniferous or broadleaf trees, is Paper further includes filler material that makes the paper opaque or white; a sizing agent to reduce absorption of ink by the paper to prevent ink from spreading excessively through the paper; and a fixing agent that enhances absorption of the sizing agent by pulp fiber. Especially, acidic paper usually contains talc or clay as a filler, rosin size as the sizing agent, and aluminum sulfate as the fixing agent.

Of these materials, pulp fiber and talc filler are the materials that especially adversely affect the electrophotographic process. If the pulp fiber enters the developing cartridge 36 that uses nonmagnetic single component toner T, the pulp fiber can be caught between the layer-thickness regulating blade 23 and the developing roller 22, and will damage the layer-thickness regulating blade 23 or the developing roller 22. Additionally, toner will possibly cling to the pulp fiber. The pulp fiber attached with the toner will possibly pass between the development roller 22 and the layer-thickness regulating blade 23 and then be transferred to the surface of a sheet of paper P. If this sheet of paper P passes through the fixing process and is discharged onto the discharge tray 35 with the pulp fiber attached thereon, the pulp fiber will appear as an undesirable black speck in white areas on the sheet of paper.

The talc has a strong tendency to be electrically charged to a negative polarity. Accordingly, when positive polarity toner is used, if talc mixes into the developing cartridge 36, then the charge amount of the toner will be reduced. This will cause fogging on resultant printed images. On the other hand, when negative polarity toner is used, then talc can result in fogging or even if fogging does not occur, the charged amount of toner might become too high so that the density of resultant images will drop.

It is noted that if a brush roller is employed to remove paper dust from the photosensitive drum 21, the brush roller can catch pulp fibers in the paper dust. However, especially when an acidic paper is used as the sheet of paper P, the brush roller may not properly catch small filler components such as talc. If a non-woven fabric roller is employed to remove paper dust from the photosensitive drum 21, the non-woven fabric can properly catch both the fibers and filler components of the paper dust when the non-woven fabric roller is strongly pressed against the photosensitive drum 21. In this case, however, the hard pulp fiber that gets caught up by the non-woven fabric roller can damage the surface of the photosensitive drum 21. Also, when the filler material accumulates on the non-woven fabric roller, the soft filler material can cling to the surface of the photosensitive drum 21 by being scraped between the surface of the photosensitive drum 21 and the pulp fiber accumulated on the non-woven fabric roller. A thin film of filler material is formed on the photosensitive drum surface. This results in filming of filler material. When the thin film of filler material is formed on the surface of the photosensitive drum 21, the photosensitive drum 21 fails to be properly charged to the predetermined electric potential by the charger 25. The electric potential also fails to properly drop to the necessitated electric potential at the laser beam-exposed area. Accordingly, image formation cannot be properly attained. Also, due to the thin film of filler material formed on the photosensitive drum 21, toner will tend to cling to the surface of the photosensitive drum 21. In this case, the toner may not properly separate from the photosensitive drum surface and therefore may not properly transfer onto the recording sheet P.

In order to solve the above-described problems, according to the present embodiment, a paper-dust removing device is provided to include a contact member that is constructed from fibers impregnated with oil and that contacts the photosensitive drum 21 to remove paper dust therefrom. For example, the paper-dust removing device may include an electrically insulating brush, whose constituent fibers are impregnated with oil- The paper-dust removing device may alternatively include a woven fabric, a knitted fabric, or a non-woven fabric, each of which is constituted from fibers impregnated with oil. With this configuration, paper dust can be properly removed from the photosensitive drum 21.

Figure 7:
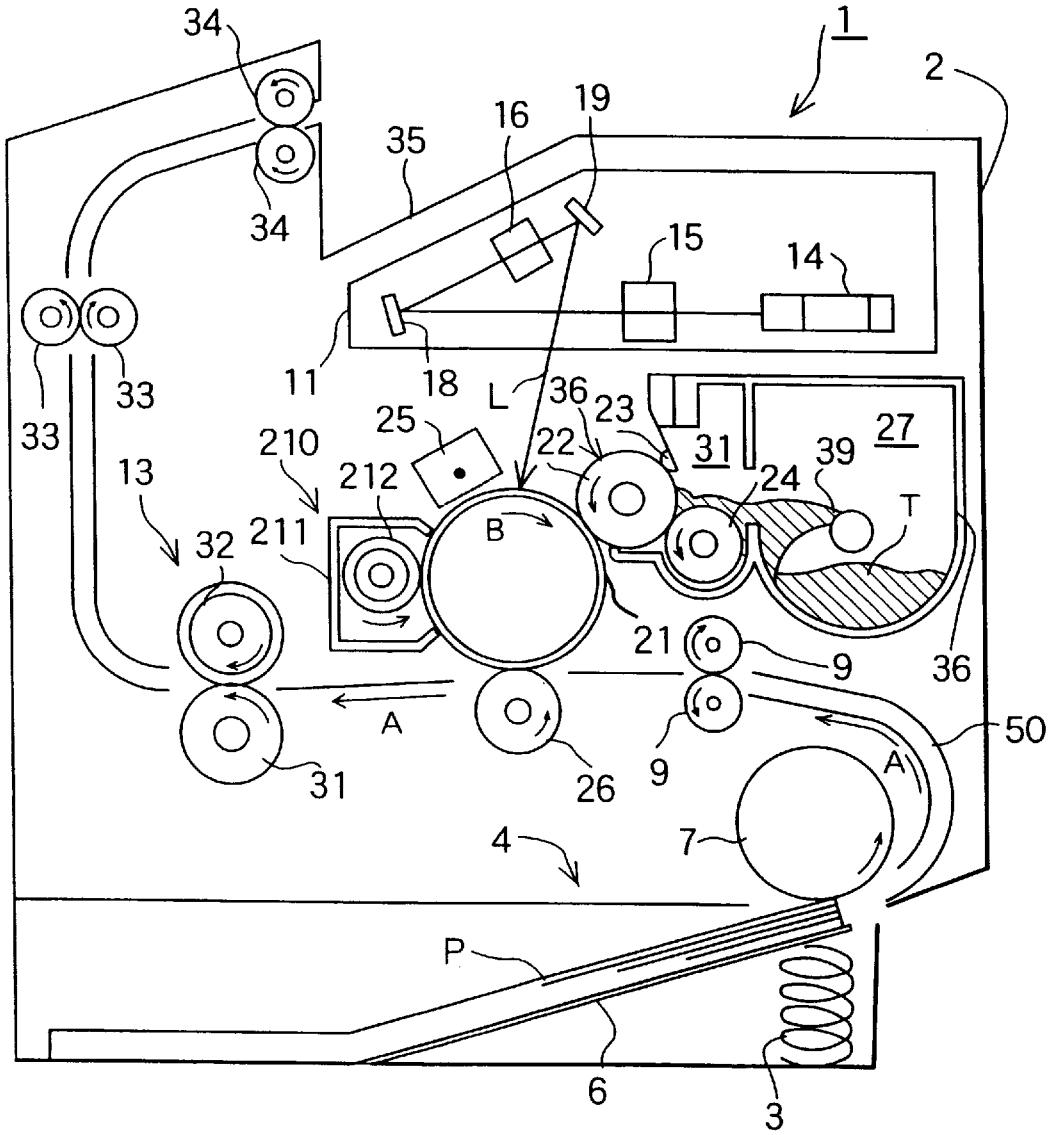
FIG. 7 is a cross-sectional view of an image forming apparatus according to a second embodiment.

FIG. 7 is a cross-sectional schematical view of a laser printer 1 according to the second embodiment. The laser printer 1 of the present embodiment is the same as that of the first embodiment except that a paper-dust removing device 210 is provided and except that no drum cartridge 20 is provided. According to the present embodiment, the photosensitive drum 21, the charge unit 25, the paper-dust removing device 210, and the transfer roller 26 are mounted directly to the casing 2. The development cartridge 36 is detachably mounted to the casing 2. The laser printer 1 of the present embodiment is operated to perform the cleanerless development process in the same manner as in the first embodiment.

The paper-dust removing device 210 of the present embodiment will be described below in greater detail.

Figure 8:
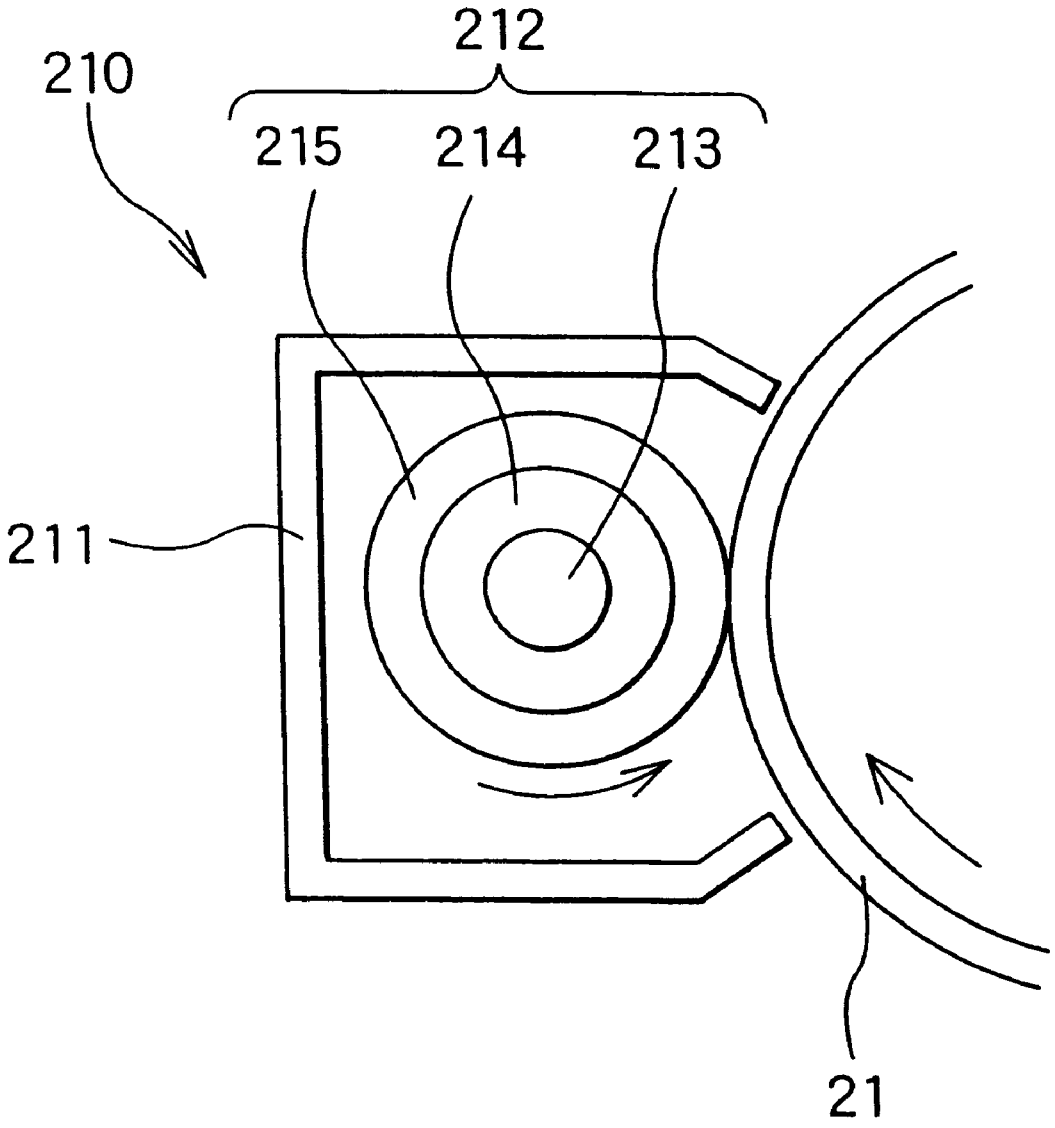
FIG. 8 is a cross-sectional view of a paper-dust removing device provided in the image forming apparatus of FIG. 7.

As shown in FIG. 7, the paper-dust removing device 210 includes a casing 211, and a paper dust removing roller 212 that is disposed within the casing 211. As shown in FIG. 8, the paper dust removing roller 212 is constructed from a metal shaft 213, a resilient roller 214 provided on the periphery of the metal shaft 213, and a non-woven fabric sheet 215 wound around the roller 214. The metal shaft 213 is made from aluminum. The metal shaft 213 extends parallel to the rotational axis of the photosensitive drum 21. Thus, the metal shaft 213 extends perpendicularly to the direction, in which the photosensitive drum 21 moves or rotates to convey the toner image in its rotational direction B. The resilient roller 214 is made from sponge, for example. The non-woven cloth sheet 215 is impregnated with oil, and is for contacting the surface of the photosensitive drum 21.

According to the present embodiment, the non-woven fabric sheet 215 is formed from fibers entangled into an integral mass. In the non-woven fabric sheet 215, the constituent fibers are arranged in an extremely random manner, and therefore fine paper dust can be properly caught up in between the fibers.

The fiber material of the non-woven fabric sheet 215 can include synthetic fiber, composite fiber, semi-synthetic fiber, reclaimed fiber, natural fiber, or other types of fiber. Representative examples of synthetic fiber include polyester fiber, polyamide fiber, polyolefine fiber, and acrylic fiber. Composite fiber includes a resin of the above-described synthetic fibers. An example of semi-synthetic fiber includes acetate fiber. Examples of reclaimed fiber include cupra and rayon. Examples of natural fiber include cotton, linen and wool. An example of other fiber-made products includes cotton blend.

The non-woven cloth sheet 215 is impregnated with at least one of mineral oil, synthetic oil, silicone oil, or a surfactant. Paraffin hydrocarbon, naphthene hydrocarbon, or aromatic hydrocarbon can be used as mineral oil. Alkylbenzene oil, polyolefine oil, or polyglycol oil can be used as synthetic oil. Chain dimethyl polysiloxane, cyclic dimethyl polysiloxane, methyl hydrogen polysiloxane, or a variety of different types of denatured silicone can be used as silicone oil. Either a cationic or nonionic surfactant can be used. A quaternary ammonium salt is preferably used as cationic type surfactant. Polyethylene glycol or a polyhydric alcohol can be used as the nonionic surfactant. According to the present embodiment, one or a mixture of any of the above-described oil solutions are applied to the non-woven fabric sheet 215 to a ratio of 1% to 20% by weight of the non-woven cloth sheet 215. A proper cohesion force can be attained by those types of oil.

According to the present embodiment, the paper dust removal roller 212 is disposed at a location where the roller 212 will be pressed against the photosensitive drum 21 with a pressure of an amount of approximately zero (0) in order to reduce to a minimum the amount that the oil solution transfers onto the photosensitive drum 21. More specifically, the roller 212 is located so that a distance between its shaft 213 and the surface of the photosensitive drum 21 is equal to the total thickness of the resilient roller 214 and the non-woven fabric sheet 215. Because the amount of oil that clings to the photosensitive drum 21 is kept to a minimum, filming caused by oil solution on the photosensitive drum 21 can be prevented. Filming caused by soft talc can also be prevented.

Thus, according to the present embodiment, the roller 212 is rotatably mounted inside the casing 211. The paper dust remove roller 212 includes the non-woven fabric sheet 215 that is wrapped around the sponge roller 214. The sponge roller 213 is axially supported onto the shaft 213. The non-woven fabric sheet 215 is impregnated with oil agent. The roller 212 is positioned relative to the photosensitive drum 21 so as to contact the photosensitive drum 21 with a contact pressure of substantially zero (0).

Even when the pressure applied by the paper dust removal roller 212 against the photosensitive drum 21 is approximately zero (0), paper dust such as talc and pulp fiber can be reliably removed by cohesion of the oil solution impregnated in the non-woven fabric sheet 215. Even when acidic paper is used as the paper sheet P, paper components such as talc can be reliably removed and fogging or other printing problems can be reliably prevented. Accordingly, filming of talc will not occur on the photosensitive drum 21. Also, talc or pulp fiber will not enter the developing cartridge 36. Accordingly, pulp fiber will not be transferred onto print sheets P. Therefore, fogging or soiling of the sheets of paper P can be reliably prevented.

The paper dust removal roller 212 is configured to be driven to rotate by the rotation of the photosensitive drum 21. Accordingly, the paper dust removal roller 212 rotates counterclockwise as shown in FIG. 8. As apparent from the figure, a spacing is formed in the casing 211 below the paper dust removal roller 212. With this structure, when paper dust is removed by the paper dust removal roller 212 from the photosensitive drum 21, the paper dust drops into the spacing, and will not accumulate on the contact portion between the paper dust removal roller 212 and the photosensitive drum 21. Accordingly, the surface of the photosensitive drum 21 will not be damaged by hard pulp fiber that clings to the roller 212. Filming caused by soft talc can also be reliably prevented.

Next, a modification of the present embodiment will be described below.

In the above-described embodiment, the paper dust removal device 210 is constructed from the non-woven fabric 215 wrapped around the resilient roller 214. However, the present embodiment is not limited to this configuration. For example, the paper dust removal device 220 having the configuration of FIG. 9 can be employed instead. The paper dust removal device 220 includes a casing 224, in which a paper dust removal roller 223 is rotatably provided. The paper dust removal roller 223 is constructed from a stiff or hard roller 221 attached with several elongated non-woven fabric sheets (strips) 222. Each non-woven fabric sheet 222 is attached to the roller 221 at one end, with its free end overlapping the fixed end of an adjacent non-woven fabric sheet 222. Each non-woven fabric sheet 222 is impregnated with one or a mixture of at least one of the oil solutions described above.

Although not shown in the drawing, a drive mechanism is provided for rotating the paper dust removal roller 223 in the same direction as the photosensitive drum 21. With this configuration, when one of the non-woven fabric sheets 222 contacts the photosensitive drum 21, the non-woven fabric sheet 222 moves in a direction Opposite to that of the photosensitive drum 21. With this structure, the pressure applied by the non-woven fabric sheet 222 onto the photosensitive drum 21 can be strikingly suppressed. Still, the cohesion force of the oil solution and the paper dust-catching force of the non-woven fabric sheet 222 cooperate to reliably remove paper dust from the photosensitive drum 21.

Figure 9:
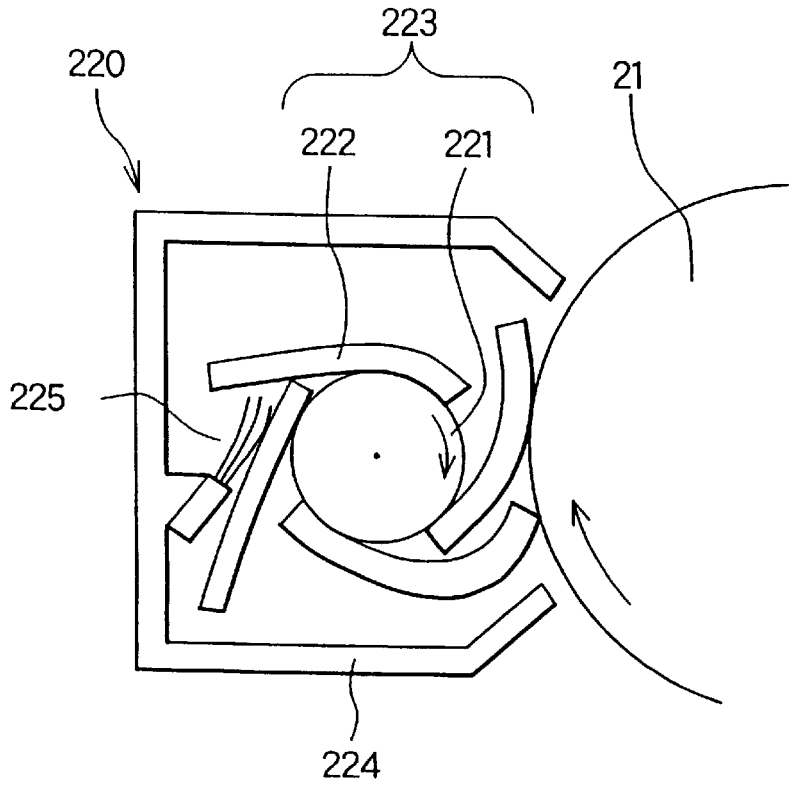
FIG. 9 is a cross-sectional view of a modification of the paper-dust removing device.

As shown in FIG. 9, a pick up member 225 is additionally provided within the casing 224. The pick up member 225 is disposed to contact each non-woven fabric sheet 222 to properly pick up paper dust that is removed by the non-woven fabric sheet 222 from the photosensitive drum 21 and that clings to the non-woven fabric sheet 222. Accordingly, it is possible to prevent paper dust from accumulating on the non-woven fabric sheet 222.

Another modification of the present embodiment will be described below.

Figure 10:
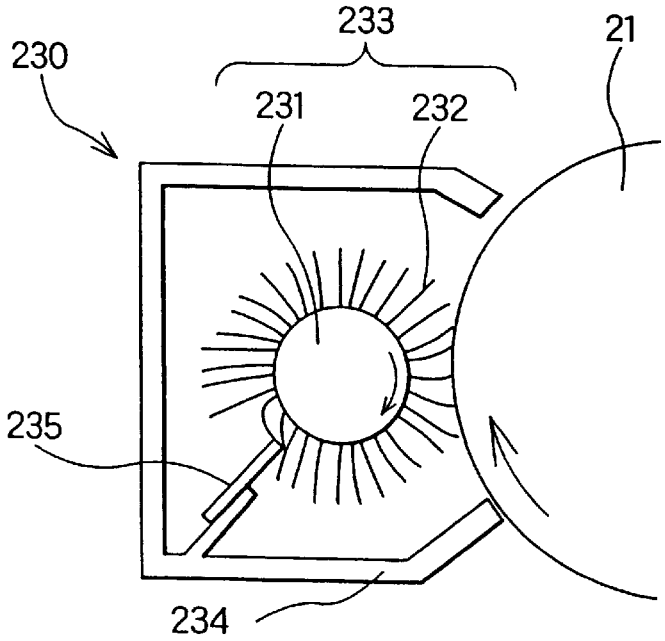
FIG. 10 is a cross-sectional view of another modification of the paper-dust removing device.

According to this modification, another paper-dust removing device 230 shown in FIG. 10 is employed. The paper-dust removing device 230 includes a casing 234, in which a paper dust removal roller 233 is mounted. The paper dust removal roller 233 is constructed from a stiff or hard roller 231 attached with an insulation brush 232. The brush 232 is impregnated with an oil solution in a manner similar to the non-woven fabric 222 of FIG. 9. The paper dust removal roller 233 is rotatably provided in the casing 234, and a drive mechanism (not shown) is provided to rotate the paper dust removal roller 233 in the same direction as the photosensitive drum 21. Within the casing 234, a pick up member 235 is additionally provided for contacting the brush 232.

The length of the fibers constituting the brush 232, the distance between the roller 231 and the surface of the photosensitive drum 21, and the material of the brush fibers 232 are selected so that the brush 232 presses against the photosensitive drum 21 with an extremely small pressing force. Still, cohesion force of the oil solution and the paper dust picking up force of the brush 232 properly cooperate to reliably remove paper dust from the photosensitive drum 21.

In the case where the support roller 214 (FIG. 8) is allowed to rotate following the rotation of the photosensitive drum 21, the fiber-made contact member 215 rotates in accordance with rotation of the support roller. Also in the case where the support roller 221 (FIG. 9) or 231 (FIG. 10) is driven by the drive mechanism to rotate, the fiber-made contact member 222 or 232 rotates in accordance with rotation of the corresponding support roller. Accordingly, a contact portion where the contact member contacts the photosensitive drum 21 successively changes. Accordingly, the removed paper dust will not accumulate onto the same position of the contact member. The photosensitive drum 21 will not be damaged by the paper dust accumulated on the contact member.

Each of the soft fiber brush 232 and the non-woven fabric sheets 215 and 222 can softly contact the surface of the photosensitive drum 21, and therefore will not damage the photosensitive drum surface.

Still another modification of the present embodiment will be described below.

Figure 11:
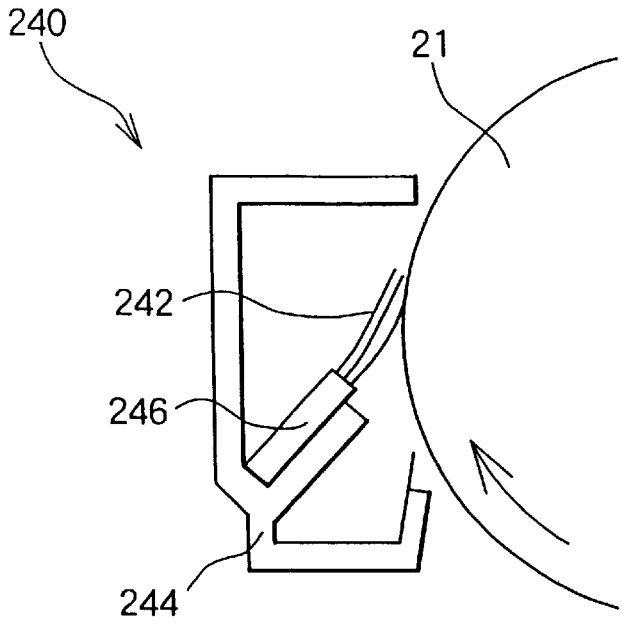
FIG. 11 is a cross-sectional view of still another modification of the paper-dust removing device.

According to the present modification, another paper-dust removing device 240 shown in FIG. 11 is employed. The paper-dust removing device 240 includes a casing 244, in which a support member 246 is fixedly provided. A brush 242 is fixedly attached to the support member 246, and is impregnated with an oil solution similarly to the brush 232 of FIG. 10.

The above-described paper-dust removing device 240 has a simple configuration. The length of the brush 242, the distance between the support member 246 and the surface of the photosensitive drum 21, and the material of the brush-constituent fibers are selected so that the brush 242 presses against the photosensitive drum 21 with an extremely small pressure. Still, cohesion force of the oil solution and the paper-dust picking up force of the brush 242 cooperate to reliably remove paper dust from the photosensitive drum 21.

It is noted that paper dust can easily accumulate at the position where the brush 242 contacts the photosensitive drum 21. However, by adjusting the abutment angle of the brush 242 with respect to the photosensitive drum 21, paper dust removed by the brush 242 will successfully fall into the casing 244 to an amount that will actually cause no problems.

Another modification of the present embodiment will be described below.

Figure 12:
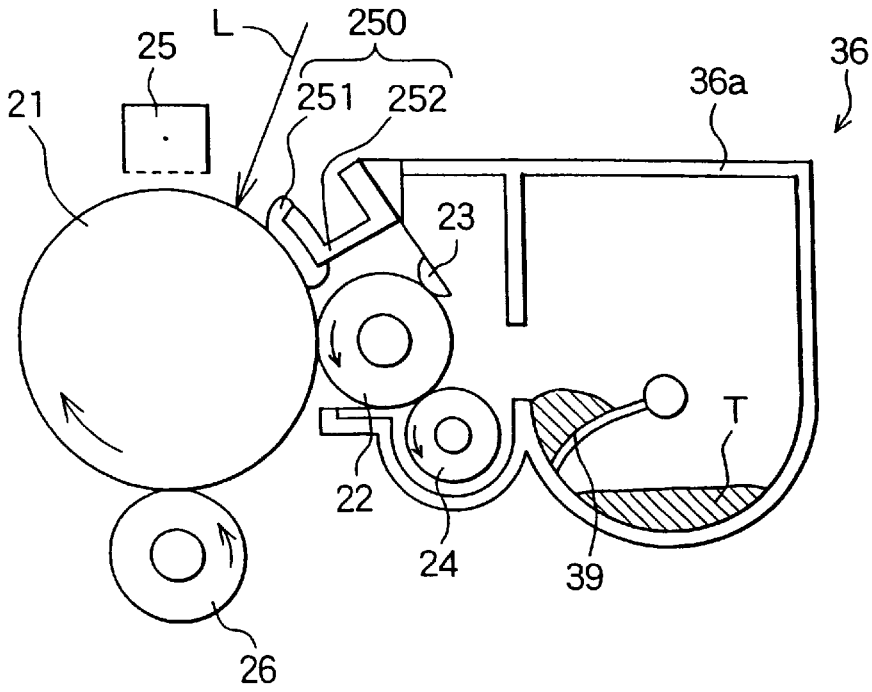
FIG. 12 is a cross-sectional view of another modification of the paper-dust removing device.

According to the present modification, another paper-dust removing device 250 shown in FIG. 12 is employed. The paper-dust removing device 250 includes a support member 252, and a non-woven fabric sheet 251 supported on the support member 252. The support member 252 is attached to the side wall 36*a* of the development cartridge 36. The support member 252 is separated from the photosensitive drum 21 by a distance equal to the thickness of the non-woven fabric sheet 251. Accordingly, the non-woven fabric sheet 251 applies a pressure of a substantially zero value to the photosensitive drum 21.

Also in this modification, the non-woven fabric sheet 251 is impregnated with oil solution in a manner similar to the non-woven fabric sheet 222 of FIG. 9. Cohesion force of the oil solution and the paper dust picking up force of the non-woven fabric sheet 251 cooperate to reliably remove no paper dust from the photosensitive drum 21.

According to this configuration, the paper dust removed by the non-woven fabric sheet 251 tends to easily accumulate where the non-woven fabric sheet 251 contacts the photosensitive drum 21. However, by adjusting the pressure, at which the non-woven fabric sheet 251 contacts the photosensitive drum 21, to substantially a zero value, accumulation of paper dust can be suppressed to an amount that will cause no problems.

According to the present embodiment, the paper-dust removing device 250 is formed integrally with the wall 36*a* of the development cartridge 36, which is freely detachable with respect to the laser beam printer 1. Accordingly, the paper-dust removing device 250 can be exchanged with a new one when the cartridge 36 is exchanged with a new one. Accordingly, the non-woven fabric sheet 251 will not be used for an excessively long period of time so that an undesirably large amount of paper dust will not accumulate between the non-woven fabric sheet 251 and the photosensitive drum 21.

Figure 13:
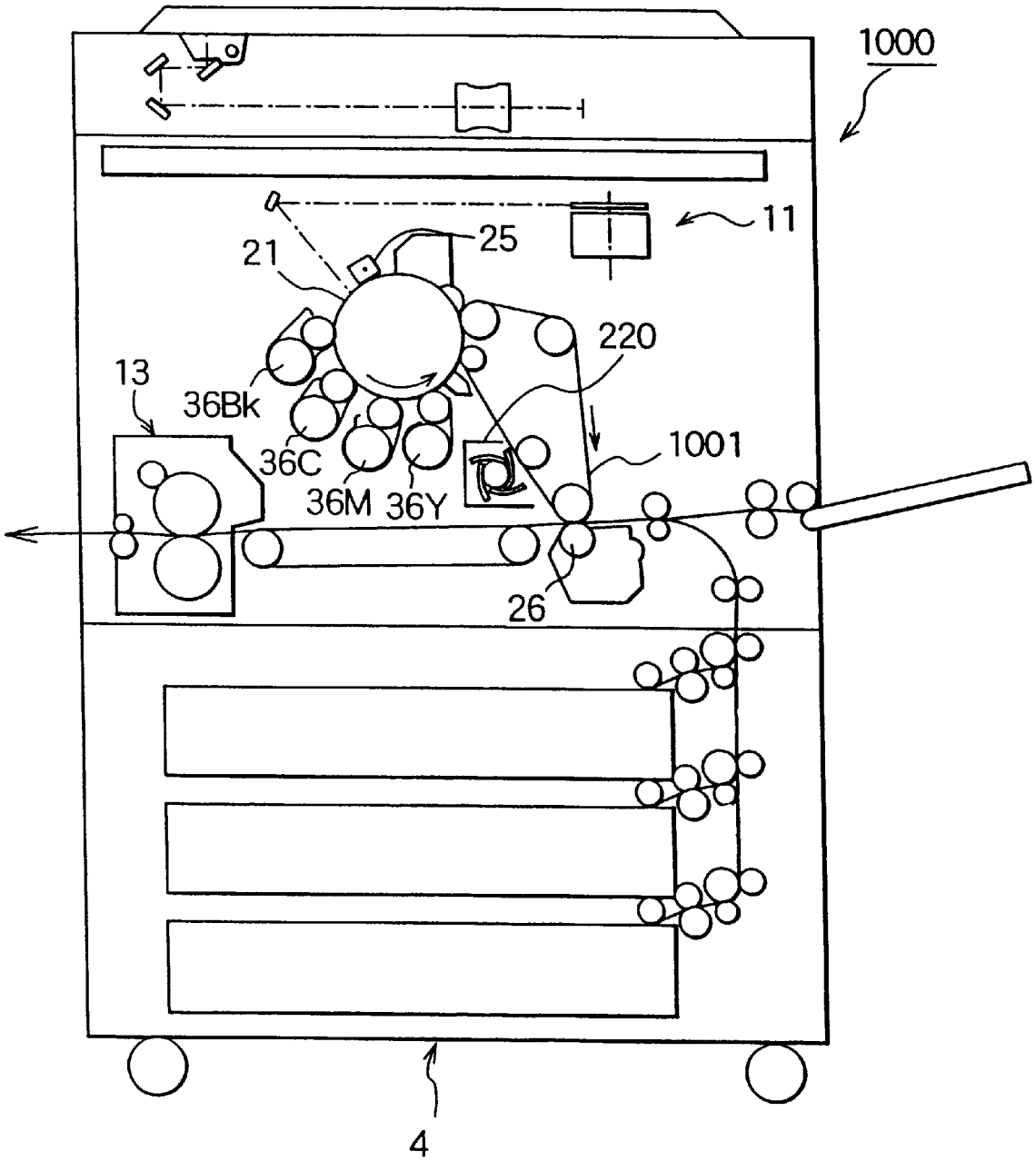
FIG. 13 is a cross-sectional view of an image forming apparatus of a modification according to the second embodiment.

Still another modification of the present embodiment will be described below with reference to FIG. 13.

So far, the present embodiment has been described applied to the laser printer 1 in which the photosensitive drum 21 serves to convey a black toner image to the transfer position where the toner image is transferred to the sheet of paper P. However, the present embodiment is not limited to application in this type of image forming apparatus, but can instead be applied to other types of image forming apparatuses. For example, the present embodiment can be applied to an image forming apparatus 1000 of a type shown in FIG. 13 in which an intermediate transfer belt 1001 is employed to convey a color toner image to the transfer position.

The image forming apparatus 1000 of this modification is a color copy machine for forming color images using four different color types of toner. The image forming apparatus 1000 includes the feeder unit 4, the photosensitive drum 21, the charge unit 25, the laser scanner unit 11, and the fixing unit 13 in the same manner as the image forming apparatus 1 of FIG. 7. However, the image forming apparatus 1000 includes four developing units 36Y, 36M, 36C, and 36Bk. The developing unit 36Y stores yellow toner, the developing unit 36M stores magenta toner, the developing unit 36C stores cyan toner, and the developing unit 36Bk stores black toner.

Although the laser beam printer 1 shown in FIG. 7 transfers the toner image from the photosensitive drum 21 directly to the sheet P, the copy machine 1000 of this modification employs the intermediate transfer belt 1001 for transferring a toner image of each color from the photosensitive drum 21 to the sheet of paper P. The intermediate transfer belt 1001 is made from electrically-chargeable polymide. The intermediate transfer belt 1001 is applied with an electric voltage, while being pressed against the toner image on the photosensitive drum 21. The toner image is transferred from the photosensitive drum 21 to the intermediate transfer belt 1001 by electrostatic force. Afterward, the transfer roller 26 is applied with an electric voltage that has a polarity opposite to that of the toner image and whose value is higher than the voltage of the intermediate transfer belt 1001. Therefore, the toner is again transferred by an electrostatic force from the intermediate transfer belt 1001 to the sheet of paper P. In this way, according to the copy machine 1000, the photosensitive drum 21 does not directly contact the sheets of paper P, but the intermediate transfer belt 1001 directly contacts the sheets of paper P. In order to remove paper dust from the intermediate transfer belt 1001. therefore, the paper-dust removing device 220 shown in FIG. 9, for example, is provided so that its non-woven fabric sheets 222 will be brought into contact with the intermediate transfer belt 1001. The paper dust on the intermediate transfer belt 1001 can be reliably removed so that formation of poor images can be prevented. Accordingly, it is possible to prevent transfer of paper dust from the intermediate transfer belt 1001 both to the photosensitive drum 21 and to sheets of paper P. It is possible to prevent occurrence of defective images. It is noted that the paper-dust removing device 210, 230, 240, or 250 can also be employed in the copy machine 1000.

In the above-description, the contact members 215, 222, and 250 are made of non-woven fabric. However, they may be formed from woven fabric or knitted fabric.

Similarly to the first embodiment, each of the paper-dust removing devices 210–250 of the present embodiment may be configured so as to press against the photosensitive drum 21 with a pressure that is adjusted to maintain a toner image remaining on the photosensitive drum 21 or on the intermediate belt 1001. The amount of the pressure is adjusted dependently on the nature of toner used. The pressure adjustment can be achieved by changing, for example, the distance between each support member 213, 221, 231, 246, or 252 and the photosensitive drum 21 or the intermediate belt 1001, and/or the material, the thickness, and/or the length of the contact member 215 and/or 214, 222, 232, 242, or 251 supported on the supported member.

Third Embodiment

A third embodiment will be described below with reference to FIGS. 14–17.

Figure 14:
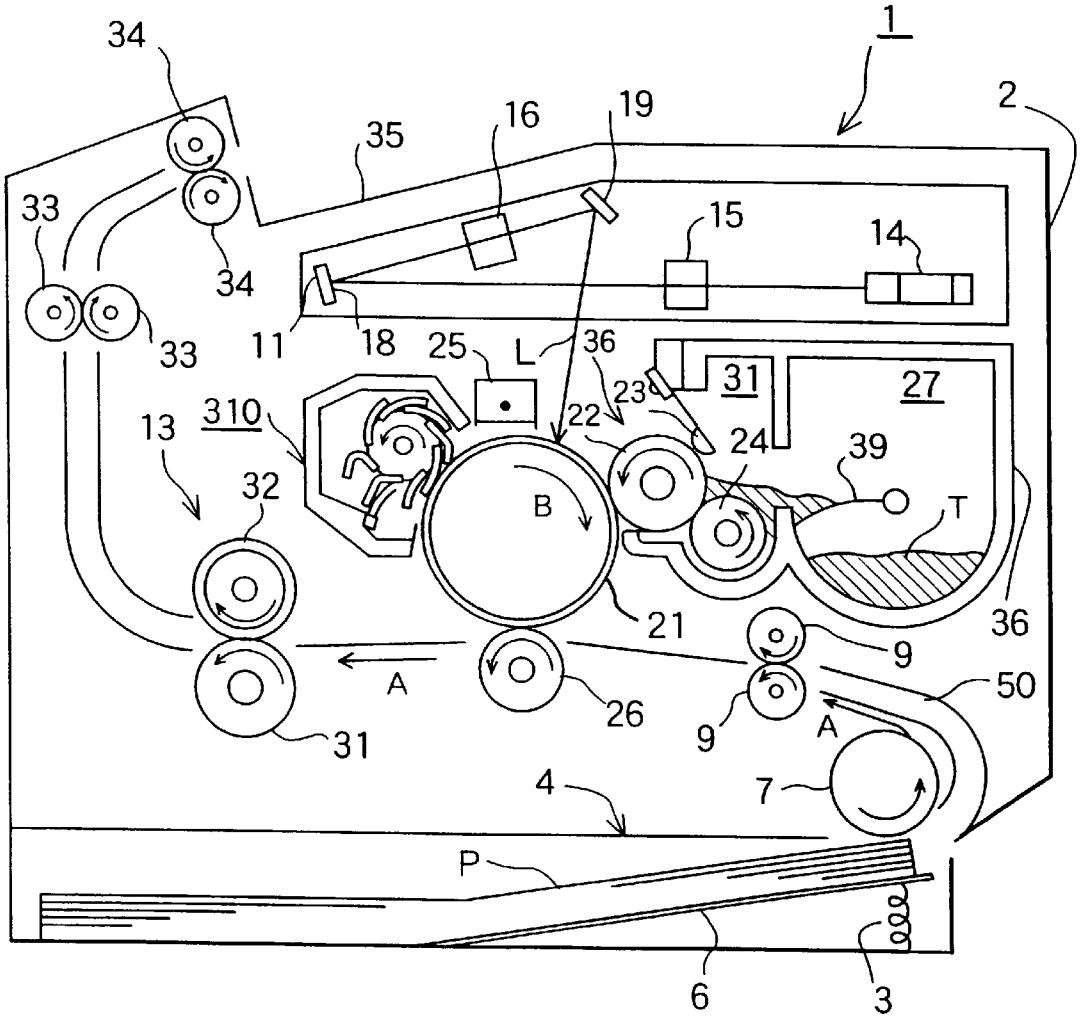
FIG. 14 is a cross-sectional view of an image forming apparatus according to a third embodiment.

FIG. 14 is a cross-sectional schematical view of a laser printer 1 according to the third embodiment. The laser printer 1, of the present embodiment is the same as that of the second embodiment, except that a paper-dust removing device 310 having the configuration shown in FIG. 14 is provided in place of the paper-dust removing device 220 of the second embodiment. The device 310 differs from the device 220 in that it is positioned slightly higher than the device 220 with respect to the photosensitive drum 21, its roller 315 (FIG. 15(*a*)) is formed with notches into which sheets 318 are inserted, and it is rotated in the counterclockwise direction.

The paper-dust removing device 310 includes a casing 312, within which the roller 315 and a brush 311 are provided. The brush 311 has electrical insulating properties and is fixedly provided to the interior wall of the casing 312. The roller 315 is rotatably provided within the casing 312. The roller 315 includes a roller shaft 314 and a resin roller 316 integrally formed with the roller shaft 314. The roller 315 is located near to, but separated from, the moving path (surface) of the photosensitive drum 21 by a certain amount of distance.

Several non-woven fabric sheets (strips) 318 are attached to the resin roller 316. As mentioned above, the resin roller 316 is formed, at its peripheral surface, with several notches, or flat attachment portions. One end of each non-woven fabric sheet 318 is fixedly attached to one of the attachment portions by adhesive or a two-sided adhesive tape so that the non-woven fabric sheet 318 will hang down by gravitational force into contact with the surface of the photosensitive drum 21. Each non-woven fabric sheet 318 is impregnated with an oil solution as described in the second embodiment.

A drive mechanism (not shown) is provided to rotate the resin roller 316 in a direction F opposite to the rotational direction B of the photosensitive drum 21. The resin roller 316 is driven to rotate at a peripheral speed higher than that of the photosensitive drum 21.

The brush 311 is for scraping off both paper dust and toner that is removed by and accumulated on the non-woven fabric sheets 318. The casing 312 has a space or spacing below the roller 315 and the brush 311 to accommodate paper dust and toner that is scraped off the non-woven fabric sheets 318 by the brush 311.

According to the present embodiment, the resin roller 316 is disposed at a position that is separated from the photosensitive drum 21 with the certain distance and that is vertically higher than the position where each non-woven fabric sheet 318 contacts the photosensitive drum 21. With this configuration, each non-woven fabric sheet 318 contacts the photosensitive drum 21 by its own weight and is therefore not pressed against the photosensitive drum 21 by the resin roller 316. Accordingly, the pressing force of the non-woven fabric sheets 318 against the photosensitive drum 21 can be made considerably small. Filming can be properly prevented from occurring on the photosensitive drum 21.

Additionally, because the resin roller 316 is driven to rotate, the location where each non-woven fabric sheet 318 contacts the photosensitive drum 21 continually changes. Accordingly, paper dust removed by the non-woven fabric sheet 318 never accumulates at the same single location on each non-woven fabric sheet 318. Damage to the photosensitive drum 21 by paper dust accumulated on the non-woven fabric sheet 318 can be prevented.

Especially when the resin roller 316 is rotated at a sufficiently high peripheral speed, the non-woven fabric sheet 318 is brought into contact with the photosensitive drum 21 by centrifugal force.

Because the non-woven fabric sheets 318 are impregnated with oil solution as described above, cohesion force of the oil solution also serves to remove paper dust from the photosensitive drum 21. Even when an acidic paper is used as the sheet of paper P, all components, even talc, of paper dust can be removed so that fogging and other poor image formation can be properly prevented.

Because the pressing force of the non-woven fabric sheets 318 against the photosensitive drum 21 is considerably small, it is possible to prevent oil agent from transferring from the non-woven fabric sheets 318 to the photosensitive drum 21. Filming by oil can also be prevented.

With the above-described arrangement, when the laser printer 1 performs the cleanerless development operation, paper dust can be properly prevented from entering the developing cartridge 36 when the residual toner is recovered by the development cartridge 36.

The resin roller 316 is driven to rotate and the brush 311 is provided below the resin roller 316. Accordingly, paper dust removed by and attached to each non-woven fabric sheet 318 is scraped off the non-woven fabric sheet 318 by the brush 311 and drops into the spacing in the casing 312, that is located below the resin roller 316. Paper dust will not accumulate on the non-woven fabric sheet 318. Accordingly, hard paper dust such as pulp fiber will not scratch the surface of the photosensitive drum 21. Soft paper dust such as talc will not generate filming on the surface of the photosensitive drum 21.

Thus, according to the paper-dust removing device 310 of the present embodiment, the brush 311 is mounted in the casing 312. The brush 311 has an electric insulating property. The resin roller 316 is integrally formed with the roller shaft 314. Several non-woven fabric sheets 318 are attached to the surface of the resin roller 316. One end of each non-woven fabric sheet 318 is fixed to the resin roller 316 by adhesive, a two-sided adhesive tape, or the like. The sheet 318 is impregnated with oil agent. The roller 316 is located so that the non-woven fabric sheets 318 will hang down due to gravitational force to contact the photosensitive drum 21. The device 310 having the above-described structure is located so that the resin roller 316 is separated from the photosensitive drum 21 with the certain amount of gap and is positioned vertically above the position where the sheets 318 contact the photosensitive drum 21. Accordingly, the sheets 318 hang down due to their own weights to contact the photosensitive drum 21. The pressing force, with which the sheets 318 contact the photosensitive drum 21, can be properly reduced.

In the above description, the resin roller 316 is driven to rotate. One end of each non-woven fabric sheet 318 is fixedly attached to the resin roller 316, and the other end of the non-woven fabric sheet 318 contacts the photosensitive drum 21 by gravitational or centrifugal force of the non-woven fabric sheet 318. However, It is unnecessary to rotate the roller 316 that serves as a base member for the non-woven fabric sheets 318. Instead, one end of each non-woven fabric sheet 318 can be fixedly attached to some base member that is fixedly secured to the casing 2 of the laser printer 1. The non-woven fabric sheet 318 is attached to the base member so that its free end can hang down into contact with the photosensitive drum 21. With this configuration, the non-woven fabric sheet 318 is contacts the photosensitive drum 21 by gravitational force only. Accordingly, the pressing force of the non-woven fabric sheet 319 against the photosensitive drum 21 can be made very small. The same advantages described above for removing paper dust can be attained in this modification.

Another modification of the present embodiment will be described below.

Figure 15A:
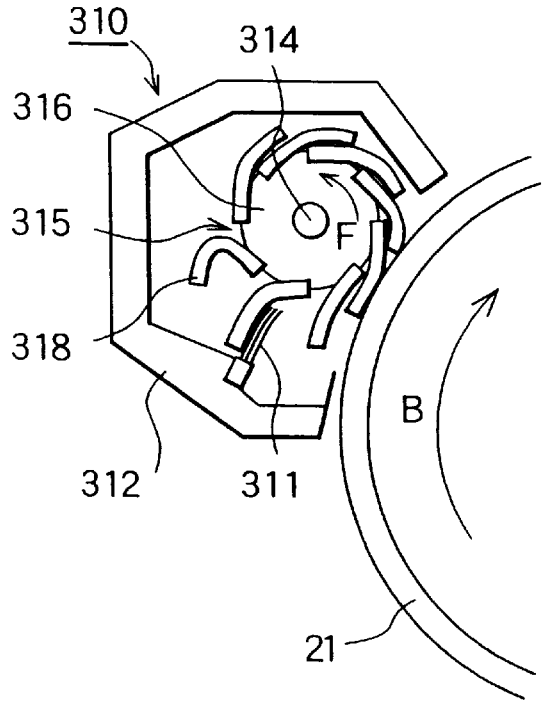
FIG. 15(*a*) is a cross-sectional view of one example of a paper-dust removing device provided in the image forming apparatus of FIG. 14.
Figure 15B:
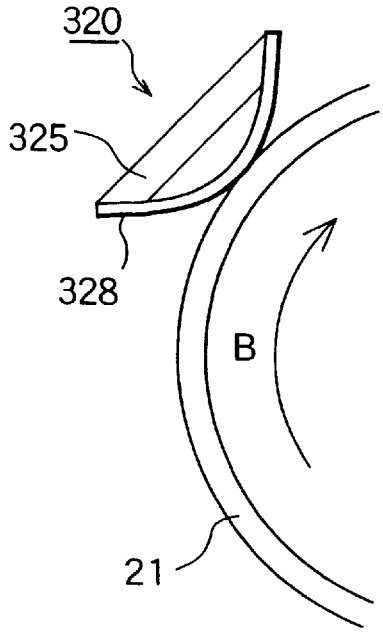
Figure 15C:
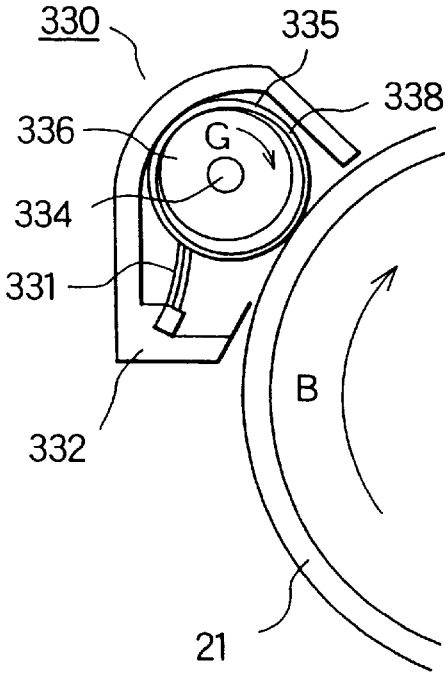

According to this modification, a paper-dust removing device 320 shown in FIG. 15(*b*) is employed. The paper-dust removing device 320 includes a base plate 325 and a non-woven fabric sheet 328. The fabric sheet 328 is fixedly attached, at both ends, to corresponding ends of the base support plate 325. The non-woven fabric sheet 328 is impregnated with oil solution similarly to the non-woven fabric sheet 318 of FIG. 15(*a*). The paper-dust removing device 320 can be disposed at any location facing the photosensitive drum 21 as long as the central portion of the non-woven fabric sheet 198 contacts the photosensitive drum 21, but does not contact the base plate 325.

For example, when the paper-dust removing device 320 is located above the photosensitive drum 21, the central portion of the non-woven fabric sheet 328 that is not fixed to the base plate 325 hangs down by gravitational force. Thus, the non-woven fabric sheet 328 contacts the photosensitive drum 21 at Its central portion.

When it is desired to dispose the paper-dust removing device 320 to the side or below the photosensitive drum 21, the non-woven fabric sheet 328 is preferably formed thicker to provide it with some stiffness. Also, each non-woven fabric sheet 328 is bent to a gently curve at its central portion, and is attached, at both ends, to the corresponding ends of the base plate 325.

According to each of the above-described configurations, the central portion of the non-woven fabric sheet 328 does not contact the support plate 325. This combined structure of the non-woven fabric sheet 328 and the base plate 325 is located so that the bent or curved central portion of the non-woven fabric sheet 328 will contact the photosensitive drum 21. Thus, the non-woven fabric sheet 328 is not pressed against the photosensitive drum 21 by the base plate 325. The non-woven fabric sheet 328 presses the photosensitive drum 21 only by a weak pressing force. Accordingly, the same paper dust removing effects can be achieved as in the above-described paper-dust removing device 310 of FIG. 15(*a*).

Still another modification of the present embodiment will be described with reference to FIG. 15(*c*).

According to the present modification, a paper-dust removing device 330 shown In FIG. 15(*c*) is provided. The paper-dust removing device 330 includes a casing 332, in which a brush 331 and a roller 335 are mounted. The roller 335 is rotatably mounted inside the casing 332. The brush 331 is fixed to the interior of the casing 332 below the roller 335. The brush 331 is electrically insulating.

The roller 335 includes a metal roller shaft 334. A resilient roller 336 is provided on the outer periphery of the metal roller shaft 334. A non-woven fabric sheet 338 is provided over the outer peripheral surface of the resilient roller 336. The metal roller shaft 334 is made from aluminum, for example. The resilient roller 336 is made from sponge, for example. The non-woven fabric sheet 338 is formed in a soft tubular shape (endless belt shape) with its inner diameter longer than the outer diameter of the resilient roller 336. The non-woven fabric sheet 338 is impregnated with an oil solution similarly to the non-woven fabric sheet 318 of FIG. 15(*a*). A drive mechanism (not shown) is provided to drive the resilient roller 336 at a slow rate in the direction G, which is the same as the rotational direction of the photosensitive drum 21.

The casing 332 is formed with a space at a location below the roller 335 and the brush 331. The space is for receiving paper dust that once adhered to the non-woven fabric sheet 338, but was scraped off the non-woven fabric sheet 338 by the brush 331.

With the structure described above, the non-woven fabric sheet 338 is formed in the tubular shape with its inner peripheral diameter longer than the outer peripheral diameter of the resilient roller 336. Accordingly, the non-woven fabric sheet 338 is supported, at its upper portion, on the outer peripheral surface of the resilient roller 336. The non-woven fabric sheet 338 hangs down by its own weight from the resilient roller 336 so that the lower portion of the non-woven fabric sheet 338 is out of contact with the resilient roller 336. Because the resilient roller 336 rotates in the same direction as the photosensitive drum 21, as the surface of the resilient roller 336 approaches the surface of the photosensitive drum 21, the non-woven fabric sheet 338 separates from the resilient roller 336 and bends upon being in abutment contact with the photosensitive drum 21. Thus, the non-woven fabric sheet 338 contacts the photosensitive drum 21 only by its own weight. Therefor, the pressing force of the non-woven fabric sheet 338 against the photosensitive drum 21 is considerably small, so that the paper-dust removing device 330 can attain the same advantages as described above for the configurations of FIGS. 15(*a*) and 15(*b*).

Still another modification will be described below.

It is noted that the paper-dust removing device 310 shown in FIG. 15(*a*) is configured so that each non-woven fabric sheet 318 can contact the photosensitive drum 21 by gravitational force applied to itself. Therefore, the resin roller 316 is positioned vertically higher than the position where the non-woven fabric sheet 318 contacts the photosensitive drum 21. However, if the non-woven fabric sheet 318 is made sufficiently thick and stiff In the same manner as described for the configuration 320 of FIG. 15(*b*), the non-woven fabric sheet need not be disposed at the position higher than the position where the non-woven fabric sheet 318 contacts the photosensitive drum 21. In this case, the paper-dust removing device can be disposed at any location on the periphery of the photosensitive drum 21.

Figure 16:
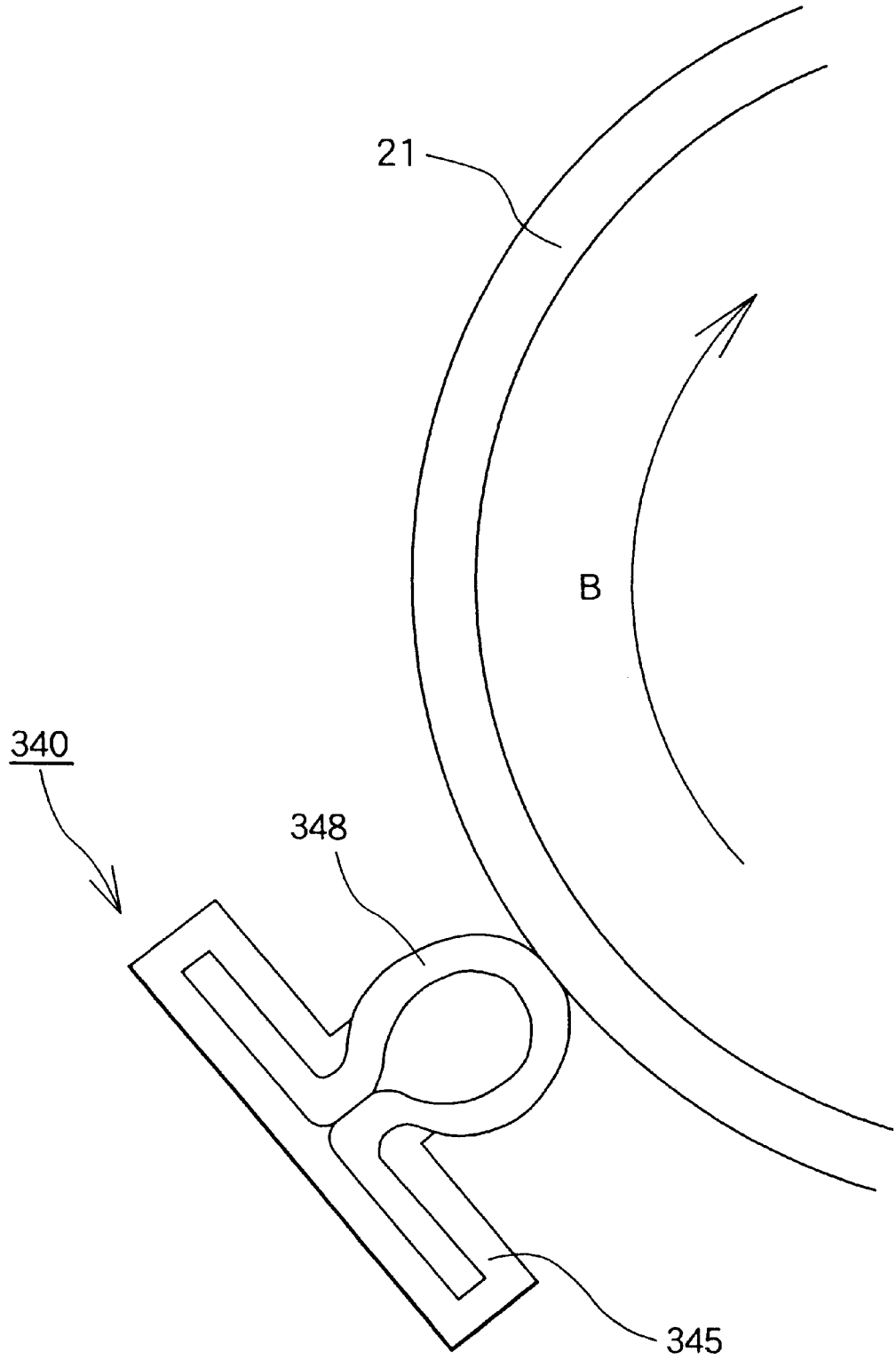
FIG. 16 is a cross-sectional view of a modification of the paper-dust removing device provided in the image forming apparatus of FIG. 14.

For example, a paper-dust removing device 340 having the configuration shown in FIG. 16 can be employed. This paper-dust removing device 340 is disposed below the photosensitive drum 21. The paper-dust removing device 340 includes a base member 345 and a non-woven fabric sheet 348 supported by the base member 345. The base member 345 is of a hollow rectangular shape, which is elongated parallel to the photosensitive drum 21. The hollow base member 345 has a slit on one side of the rectangular shape that confronts the photosensitive drum 21. The slit extends parallel to the photosensitive drum 21. The non-woven fabric sheet 348 is formed thick and stiff to a sufficient degree, and is impregnated with an oil solution. The non-woven fabric sheet 348 is supported by the base member 345 with both ends inserted into the interior of the base member 345. The central portion of the non-woven fabric sheet 348 protrudes from the base member 345 to form a protrusion. The protrusion has a ring-shaped hollow cross-section. Because the portion of the non-woven fabric sheet 348 that protrudes from the base member 345 is formed sufficiently thick, it will not hang down by its own weight and will contact the photosensitive drum 21 properly even from the side or below the photosensitive drum 21. Because the portion of the non-woven fabric sheet 348 that contacts the photosensitive body 21 is out of contact with the base member 345, the non-woven fabric sheet 348 is not strongly pressed against the photosensitive drum 21 by the base member 345. Accordingly, the non-woven fabric sheet 348 can be pressed against the photosensitive drum 21 by an extremely small pressing force. With this structure, paper dust can be properly removed while filming can be properly prevented from occurring.

According to the present embodiment, each of the contact members 318, 328, 338, and 348 has a sheet shape. It is therefore possible to make large the area of a portion of the contact member that contacts the photosensitive drum 21. The contact member can therefore efficiently remove paper dust from the photosensitive drum 21. The contact member has a some degree of thickness and good durability. It is possible to easily process each sheet member into a proper size and shape corresponding to the size of the photosensitive drum 21.

In the modifications of FIGS. 15(*b*) and 16, the paper-dust removing devices 320 and 340 are not enclosed in any casings contrary to the paper-dust removing devices 310 and 330 shown in FIGS. 15(*a*) and 15(*c*). However, each of the paper-dust removing devices 320 and 340 can be designed to be provided with such a casing. In this case, paper dust scraped off the non-woven fabric sheet 328 or 348 can be accumulated in the casing. It is therefore possible to prevent such paper dust from dispersing around the photosensitive drum 21. It is possible to prevent any adverse effects caused by the dispersed paper dust collecting on components around the photosensitive drum 21.

Figure 17:
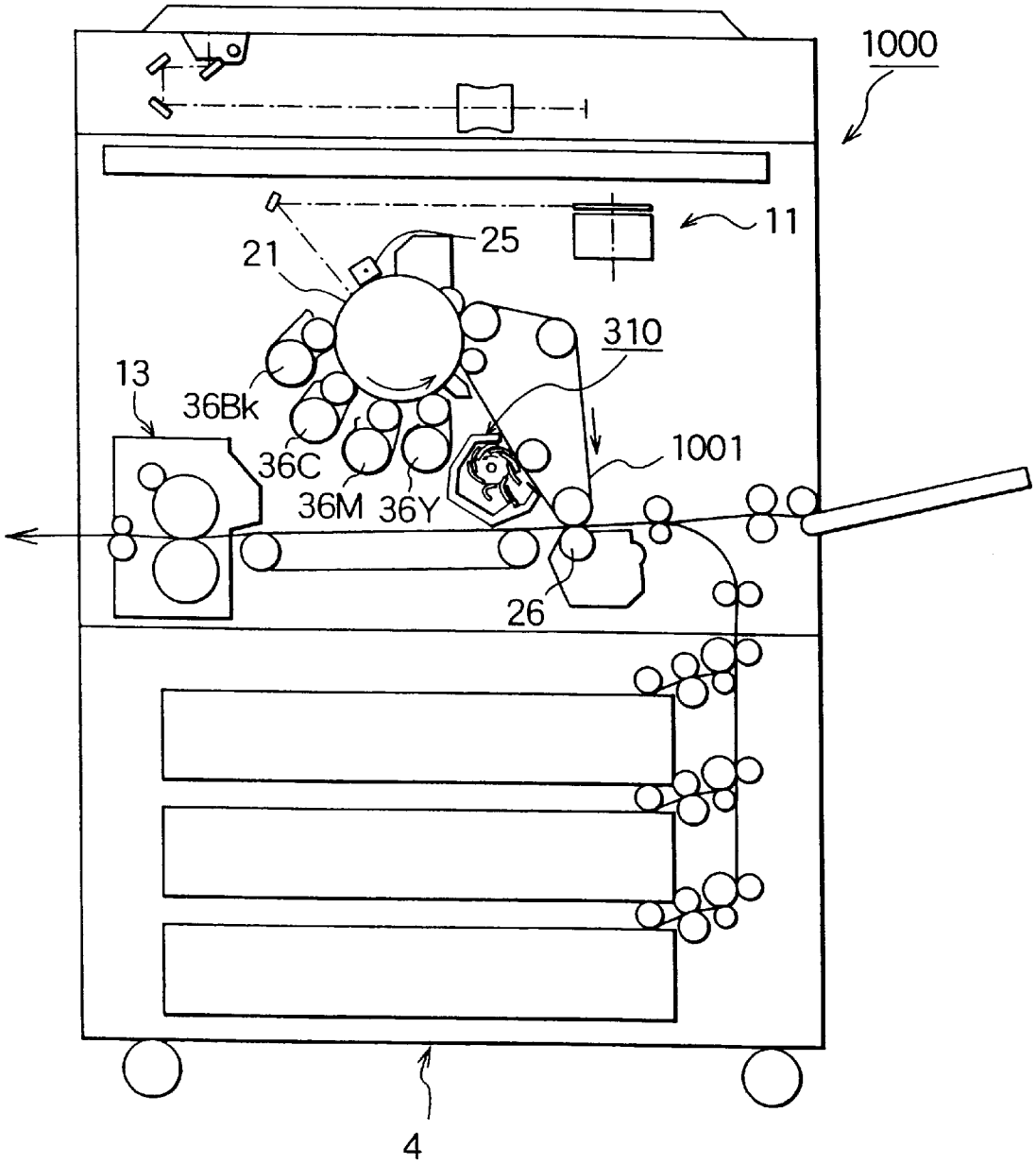
FIG. 17 is a cross-sectional view of an image forming apparatus of a modification according to the third embodiment.

The above description is directed to the laser beam printer 1 that transfers black toner images directly from the photosensitive drum 21 to the sheets of paper P, thereby forming black and white images onto the sheets of paper P. However, the present embodiment can be applied to other types of image forming apparatus. For example, similarly to the second embodiment, the present embodiment can be applied to the color copy machine 1000 of FIG. 17 that employs the intermediate transfer belt 1001 to transfer color toner images from the photosensitive drum 21 to the sheets of paper P. In this modification, either of the paper-dust removing devices 310, 320, 330, and 340 of FIGS. 15(*a*)–(15*c*) and 16 can be employed to remove paper dust clinging to the intermediate transfer belt 1001, while preventing occurrence of filming. In the example of FIG. 17, the paper-dust removing device 310 is employed.

In the above description, all of the sheets 318, 328, 338, and 348 are made of non-woven fabric. However, they may be made of woven fabric, knitted fabric, or the like.

Similarly to the first embodiment, each of the paper-dust removing devices 310–340 of the present embodiment may be configured to press against the photosensitive drum 21 with a pressure of an amount that is adjusted to maintain unchanged a toner image remaining on the photosensitive drum 21 or on the intermediate belt 1001. The amount of the pressure is adjusted dependently on the nature of toner used. The pressure adjustment can be achieved by changing, for example, the distance between each support member 314, 325, 334, or 345 and the photosensitive drum 21 or the intermediate belt 1001, and/or the material and/or the thickness of the sheet member 318, 328, 338, or 348 supported on the supported member.

Fourth Embodiment

A fourth embodiment will be described below with reference to FIGS. 18–23.

Figure 18:
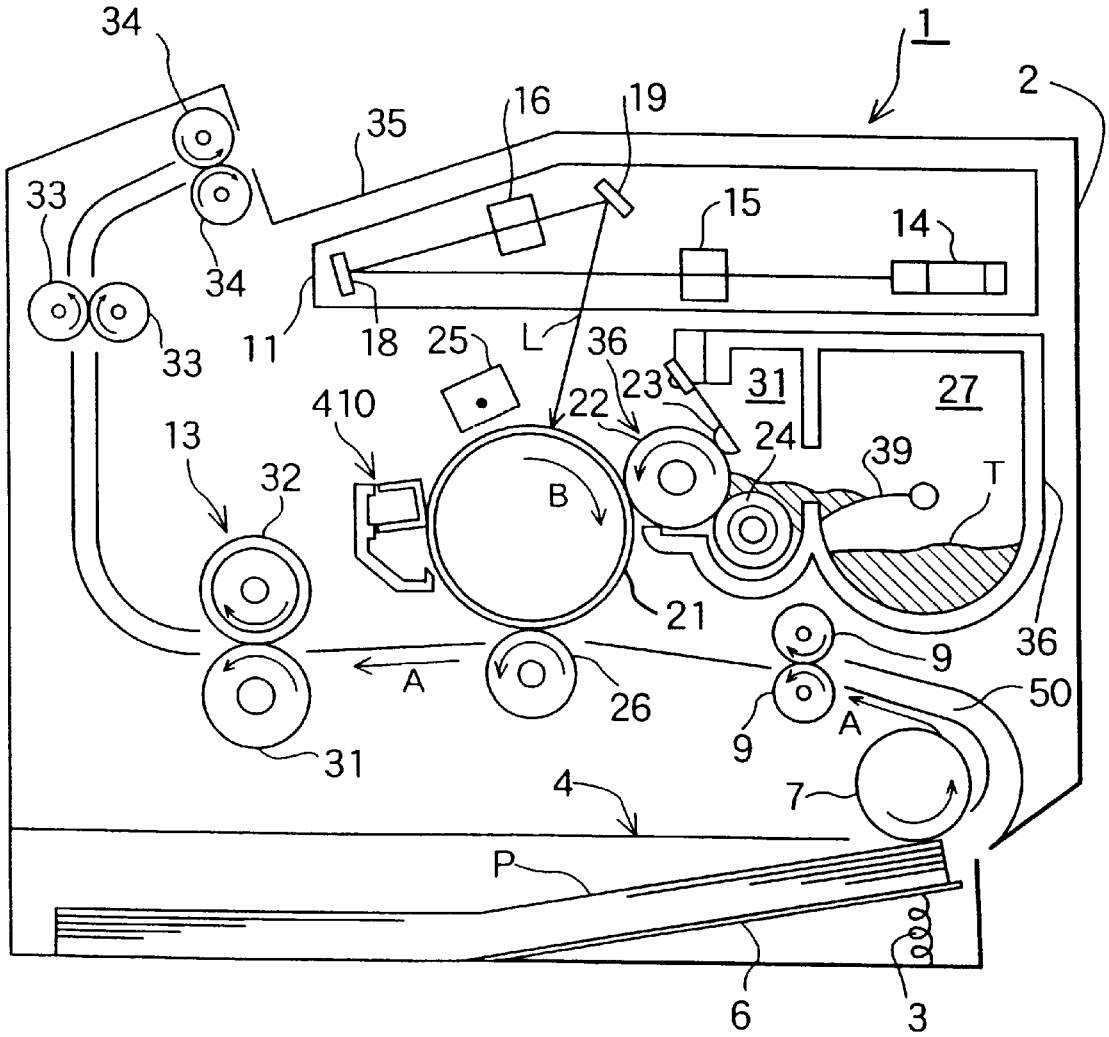
FIG. 18 is a cross-sectional view of an image forming apparatus according to a fourth embodiment.

FIG. 18 is a cross-sectional schematical view of a is laser printer 1 according to the fourth embodiment. The laser printer 1 of the present embodiment is the same as that of the third embodiment except that a paper-dust removing device 410 having the configuration shown in FIGS. 18 and 19(*a*) is provided.

Figure 19A:
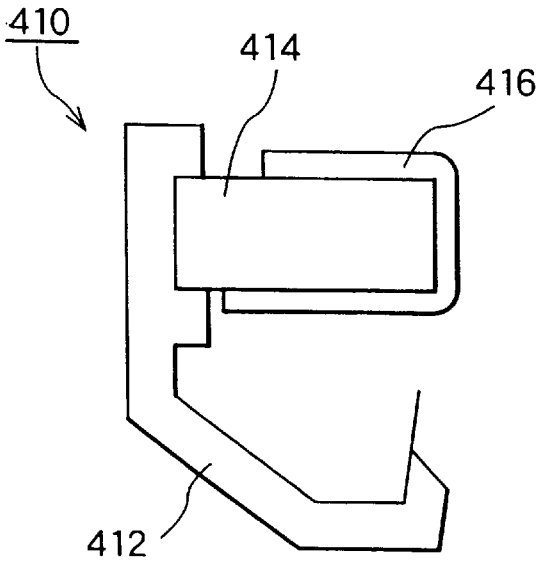
FIG. 19(*a*) is a cross-sectional view of a paper-dust removing device provided in the image forming apparatus of FIG. 18.
Figure 19B:
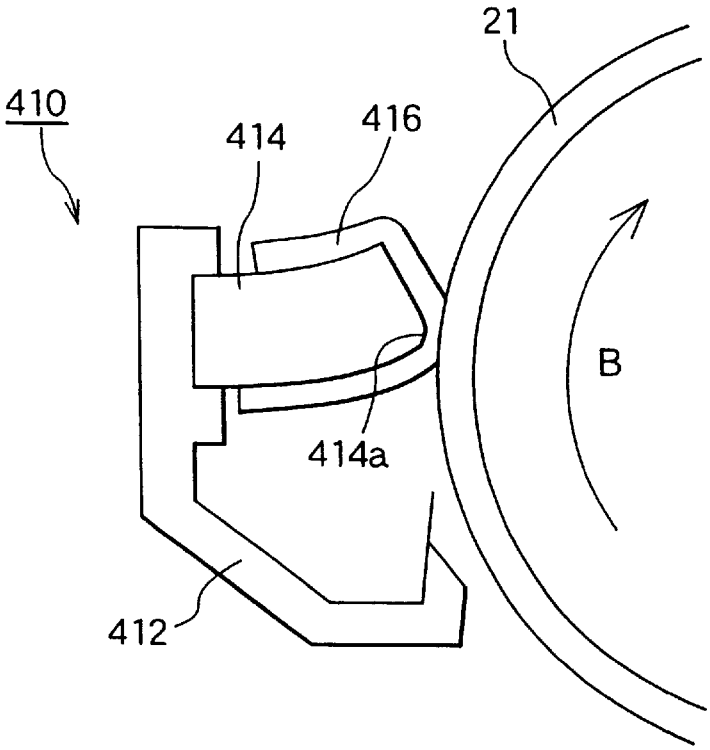

According to the present embodiment, as shown in FIG. 19(*a*), the paper-dust removing device 410 includes a casing 412. The casing 412 is disposed confronting the photosensitive drum 21. The casing 412 is separated from the photosensitive drum 21 with a predetermined distance. A resilient foam member 414 is fixed, at its one end, to the casing 412. The resilient foam member 414 has the other end (free end) that protrudes toward the photosensitive drum 21. A non-woven fabric 416 is provided covering the resilient foam member 414.

The resilient foam member 414 has an elongated shape that extends parallel to and entirely over the length of the photosensitive drum 21. In other words, the resilient foam member 414 extends normal to the sheet of drawing. Thus, the resilient foam member 414 extends in a direction perpendicular to the rotational direction B of the photosensitive drum 21 (FIG. 19(*b*)). As shown in FIG. 19(*a*), the resilient foam member 414 has a rectangular cross-section normal to its elongated direction, wherein horizontal sides are longer than vertical sides. One of the vertical sides of the rectangular cross-section defines the one end of the resilient foam member 414 that is attached to the casing 412, while the other vertical side defines the free end of the resilient foam member 414.

For example, the resilient foam member 414 can be formed from silicone rubber or urethane rubber. The most appropriate material for the resilient foam member 414 is urethane rubber because of its high endurance or strength against abrasion. The non-woven fabric 416 serves to contact the photosensitive drum 21. The resilient foam member 414 is almost entirely covered with the non-woven fabric 416 using adhesive or a two sided adhesive tape except for the vertical side that is connected to the casing 412. The non-woven fabric 416 is impregnated with oil solution similarly to the second and third embodiments.

The resilient foam member 414 is attached to the casing 412 with a small gap being formed between the free end of the resilient foam member 414 and the photosensitive drum 21 so that when the non-woven fabric 416 is attached to the resilient foam member 414 and when the photosensitive drum 21 is rotated, the non-woven fabric 416 will be brought into contact with the photosensitive drum 21.

The resilient foam member 414 is resiliently deformable and has the elongated shape extending perpendicular with the rotating direction B of the photosensitive drum 21. Accordingly, the free end of the resilient foam member 414 softly deforms when the photosensitive drum 21 rotates as shown in FIG. 19(*b*) and the portion of the non-woven fabric 416 is brought into abutment contact with the photosensitive drum 21.

With this configuration, the non-woven fabric 416 is pressed against the photosensitive drum 21 only by one corner edge 414*a* of the resilient foam member 414 that is located upstream side of the resilient foam member 414 in the photosensitive drum rotating direction B. Accordingly, the pressing force of the non-woven fabric 416 against the photosensitive drum 21 can be reduced. Additionally, the contact surface area, at which the non-woven fabric 416 contacts the photosensitive drum 21, can also be reduced. Therefore, the non-woven fabric 416 can properly remove paper dust from the photosensitive drum 21 without damaging the surface of the photosensitive drum 21. Filming caused by soft talc in the paper dust can be prevented from occurring. In addition, transfer of the oil solution onto the photosensitive drum 21 can be suppressed to a minimum. For this reason, the oil solution will not cling in great amount to the photosensitive drum 21. Therefore, filming caused by the oil solution can also be prevented.

Figure 20:
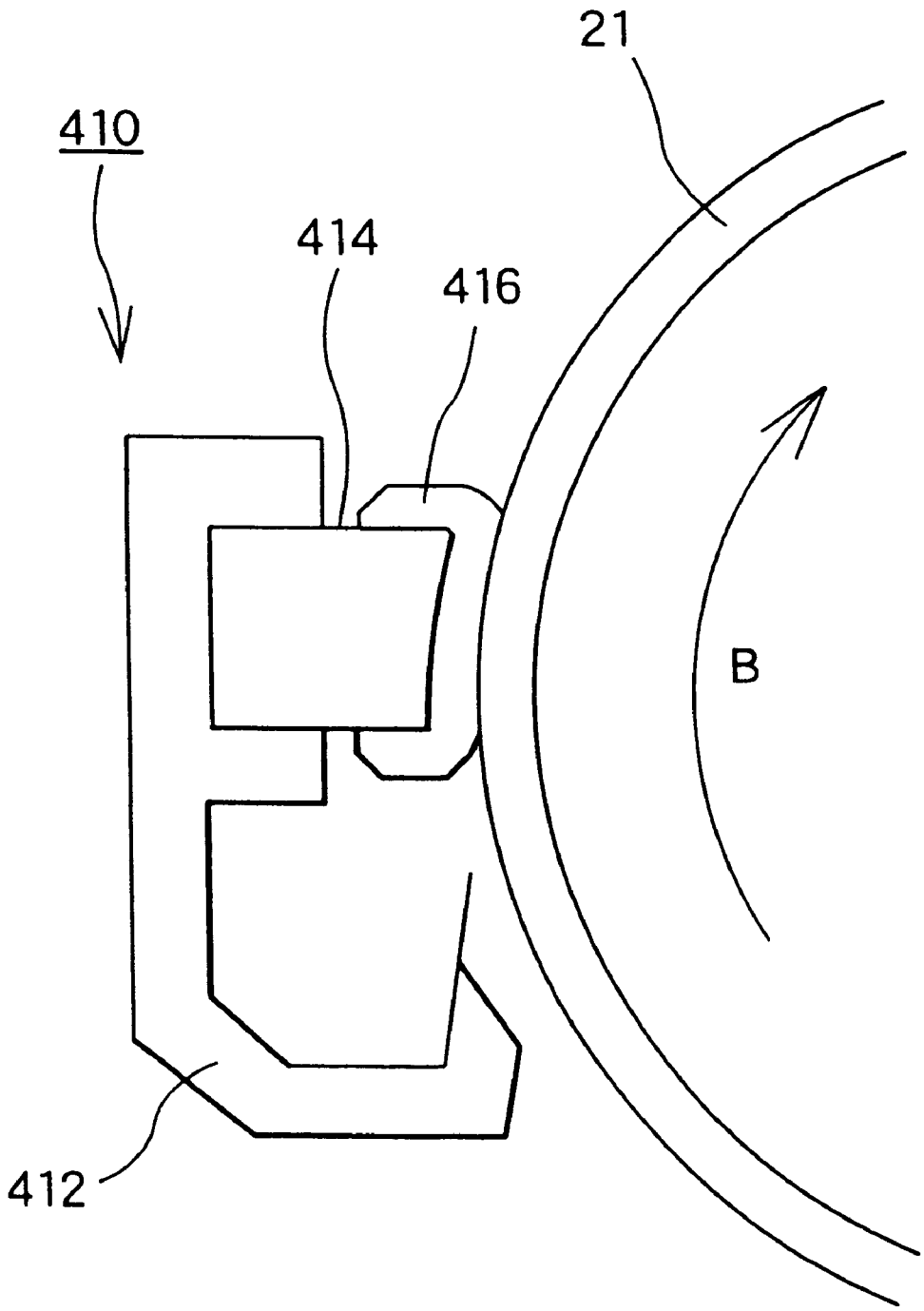
FIG. 20 illustrates a comparative example how the paper-dust removing device is located relative to the photosensitive drum rotates.
Figure 21B:
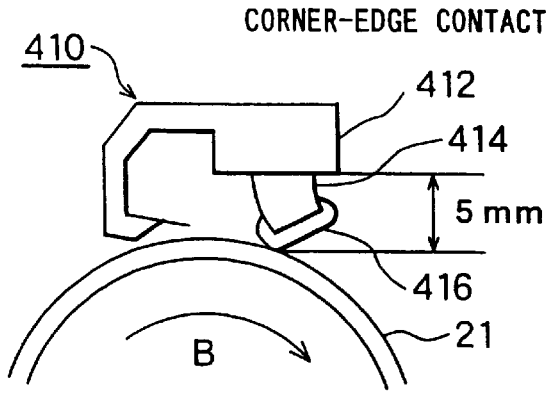
FIGS. 21(*a*)–21(*c*) illustrate experiments performed to show how the paper-dust removing device contacts with the photosensitive drum, wherein FIG. 21(*a*) shows the original shape of a paper-dust removing device used in the experiments, FIG. 21(*b*) shows how the paper-dust removing device contacts the photosensitive drum at its corner edge, and FIG. 21(*c*) shows how the paper-dust removing device contacts the photosensitive drum at its entire end surface.
Figure 21B:
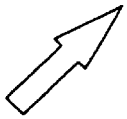
Figure 21A:
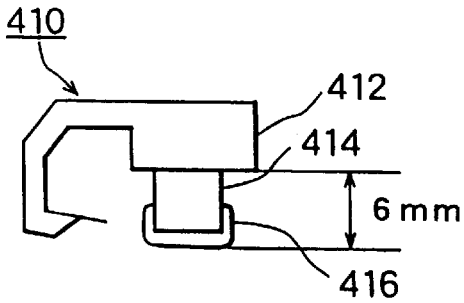
Figure 21A:
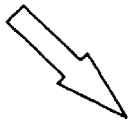
Figure 21C:
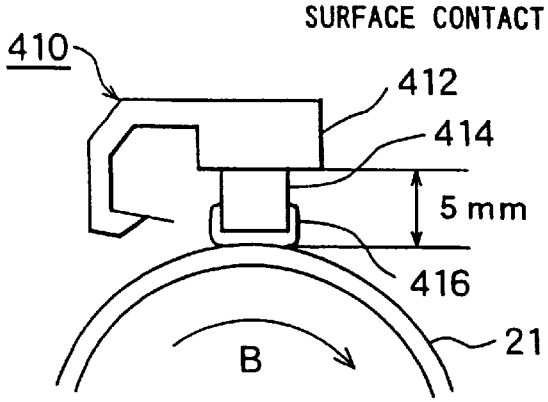

It is noted that the paper dust removing effects can be obtained even if the non-woven fabric 416 is pressed against the photosensitive drum 21 as shown in FIG. 20 at its wide area covering the entire free end of the resilient foam member 414. However, when the non-woven fabric 416 is pressed against the photosensitive drum 21 only by the corner edge portion of the resilient foam member 414 as shown in FIG. 19(*b*), the contact surface area of the non-woven woven fabric 416 to the photosensitive drum 21 can be even more greatly decreased so that filming can be more reliably prevented.

It is noted that also according to the present embodiment, the casing 412 has a spacing for receiving paper dust that is removed by the non-woven fabric 416 from the photosensitive drum 21.

<Experiments>

Experiments were performed to show the effects obtained when the resilient foam member 414 presses the non-woven fabric 416 against the photosensitive drum 21 by its corner edge portion. Experiments were also performed to show comparative effects obtained when the resilient foam member 414 presses the non-woven fabric 416 against the photosensitive drum 21 by the entire surface of its free end. During the experimentations, a single sample shown in FIG. 21(*a*) was used as the paper-dust removing device 410. This sample had a total protrusion amount of 6 mm for the resilient foam member 414 and the non-woven fabric 416.

The experiments were performed under the conditions described below.

Experimental conditions:

1. Positively charging polymerized toner was used.
2. Acidic papers were used as the sheets of paper P.
3. Foam urethane rubber was used as the resilient foam member 414.
4. A non-woven fabric impregnated with paraffin oil solution was used as the non-woven fabric 416.
5. The non-woven fabric 416 was brought into contact with the photosensitive drum 21 so that the original protrusion amount of 6 mm was compressed by 1 mm to a resultant amount of 5 mm.

Under the experimental conditions described above, the laser printer 1 mounted with the paper dust removal device 410 of FIG. 21(*a*) was operated to repeatedly print images onto sheets of paper P to perform first and second experiments. During the first experiment, the paper dust removal device 410 was disposed relative to the photosensitive drum 21 so that the resilient foam member 414 pressed the non-woven fabric 416 at its corner edge against the photosensitive drum 21 as shown in FIG. 21(*b*). The degree how paper dust was removed from the photosensitive drum 21 was observed. The image printing operation was repeatedly performed until some filming occurred. During is the second experiment, the paper dust removal device 410 was disposed relative to the photosensitive drum 21 so that the resilient foam member 414 pressed the entire end surface of the non-woven fabric 416 against the photosensitive drum 21 as shown in FIG. 21(*c*). Similarly to the first experiment, the degree how paper dust was removed from the photosensitive drum 21 was observed. The image printing operation was repeatedly performed until some filming occurred.

Table 2 below shows results of the experiments in terms of the degree how paper dust was removed from the photosensitive drum 21, and the total number of sheets P printed before filming was generated.

TABLE 2

| | Surface Contact | Corner-Edge Contact |
|---|---|---|
| State of photosensitive drum | 2,000 sheets were printed before filming was generated. | 7,000 sheets were printed before filming was generated. |
| Degree of paper dust removal | good | good |

As apparent from Table 2, filming was first observed after 2,000 sheets were printed when the non-woven fabric 416 was pressed, at its entire end surface, against the photosensitive drum 21. Filming was first observed after 7,000 sheets were printed when the non-woven fabric 416 was pressed, at only its corner edge, against the photosensitive drum 21. In both of these situations, paper dust was properly removed from the photosensitive drum 21. These experimental results showed that by abutting the photosensitive drum 21 with a corner edge of the non-woven fabric 416, prevention of filming can be enhanced and the life of the photosensitive drum 21 can be greatly extended.

As described above, according to the present embodiment, one end of the foam resilient member 414 is fixed to the case 412, while the other end protrudes toward the photosensitive drum 21. The foam resilient member 414 is elongated in the lengthwise direction of the photosensitive drum 21. The non-woven fabric 416 covers substantially the entire surface of the foam resilient body 414, and is adhesively attached thereto. The non-woven fabric 416 is impregnated with oil agent. When the photosensitive drum 21 rotates, the non-woven fabric 416 contacts the photosensitive drum 21 at a corner edge of the foam resilient body 414. The contact area, at which the non-woven fabric 416 contacts the photosensitive drum 21, can be reduced. Accordingly, it takes a short period of time that the photosensitive drum 21 will contact paper dust caught by the contact member 416. Additionally, the pressing force, at which the non-woven fabric 416 contacts the photosensitive drum 21, can be reduced. Accordingly, filming on the photosensitive drum 21 by the filler material can be prevented.

In the above description, the base member 414 covered by the non-woven fabric 416 is made of resilient foam material. However, the base member 414 may not be made from a foam material, but could be any resilient member such as a resilient material made of rubber.

In the above description, the contact member 416 that contacts the photosensitive drum 21 is made of non-woven fabric 416. However, a woven fabric or a knitted material can be used instead.

In the above description, the non-woven fabric 416 is impregnated with an oil solution. However, even when the non-woven fabric 416 is not impregnated with an oil solution, the non-woven fabric 416 can sufficiently remove paper dust from the photosensitive drum 21.

In the above description, the resilient foam member 414 is disposed to extend parallel to the lengthwise direction of the photosensitive drum 21. However, the resilient foam member 414 could be disposed in other orientations. For example, the resilient foam member 414 could be disposed at a slant with respect to the lengthwise direction of the photosensitive drum 21. In other words, the resilient foam member 414 may be disposed to extend in a is direction intersecting with the lengthwise direction of the photosensitive drum 21.

In the above description, the resilient foam member 414 has a rectangular cross-section as shown in FIG. 19(*a*) in a plane normal to its elongated direction. However, the cross-section of the resilient foam member 414 is not limited to a rectangle, but can be formed to various shapes as long as that shape has a corner on its free end that faces the photosensitive drum 21. Having this cross-sectional shape, the resilient foam member 414 can press the non-woven fabric 416 into contact with the photosensitive drum 21 at its corner edge only. Accordingly, the paper dust removing effects the same as described above can be attained.

Figure 22A:
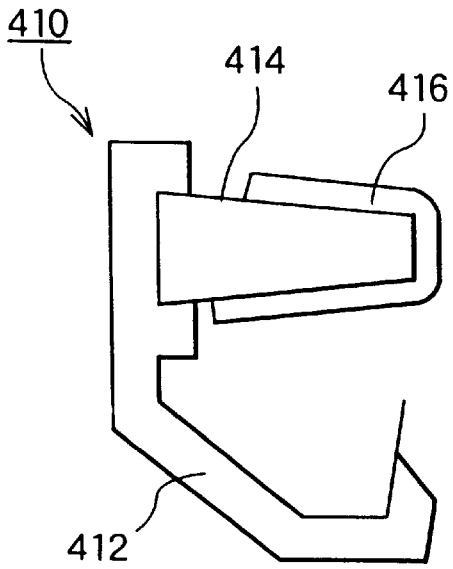
FIG. 22(*a*) is a cross-sectional view of a modification of the paper-dust removing device of the fourth embodiment.
Figure 22B:
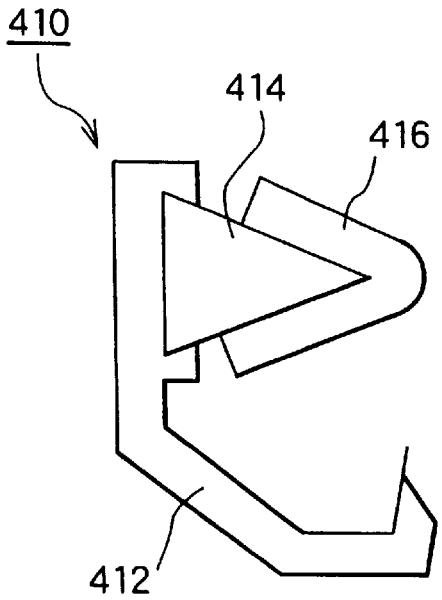
Figure 23:
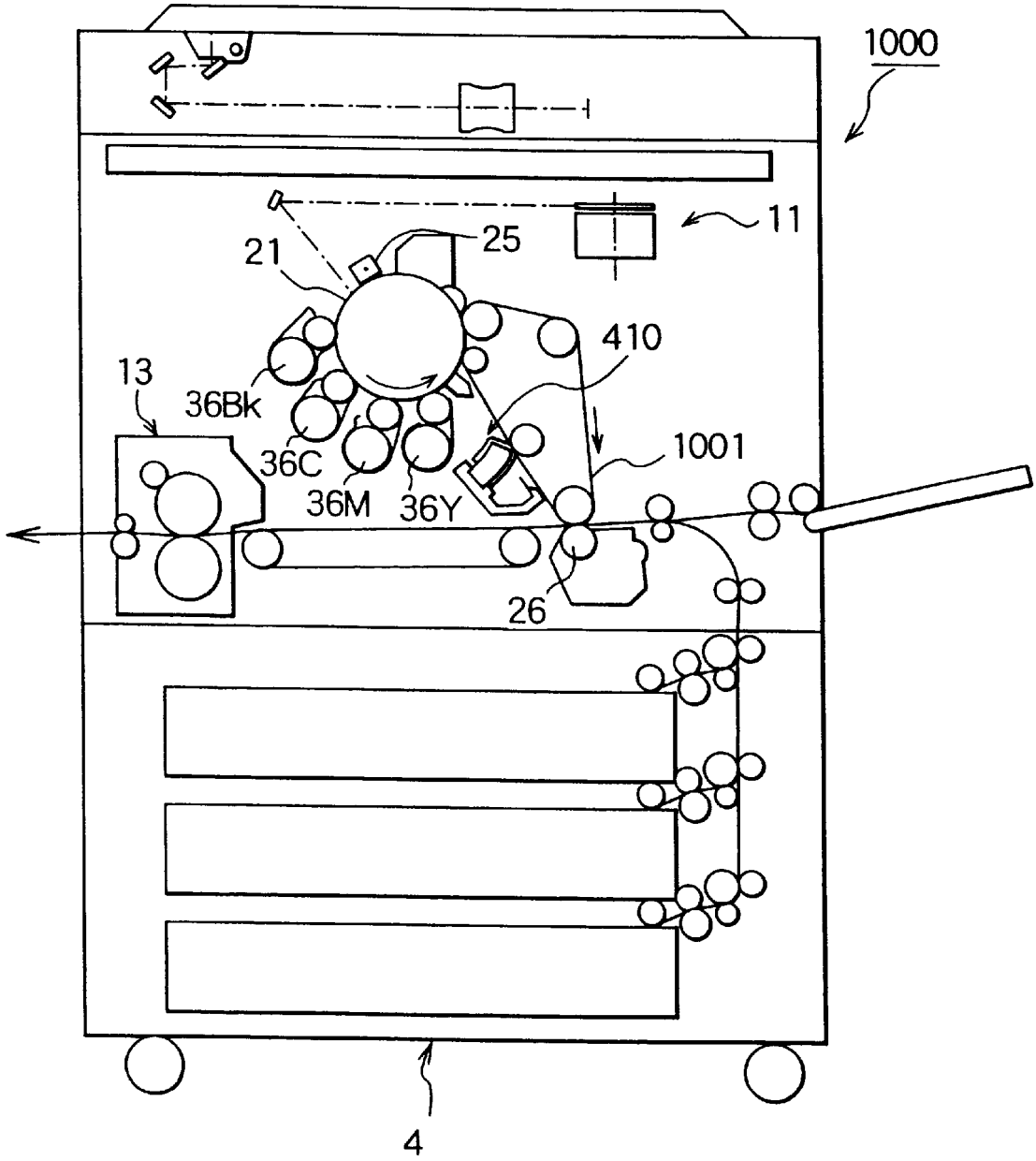
FIG. 23 is a cross-sectional view of an image forming apparatus of a modification according to the fourth embodiment.

For example, the resilient foam member 414 may have a four-sided cross-section as shown in FIG. 22(*a*) wherein its one side, attached to the casing 412, is longer than its opposite side facing the photosensitive drum 21. The resilient foam member 414 having the four-sided cross-section can be easily produced by subjecting a simple processing onto a sheet-shaped material having a predetermined thickness.

The resilient foam member 414 can also have a triangular cross-section as shown in FIG. 22(*b*) wherein its base is connected to the casing 412 and its vortex faces the photosensitive drum 21. Thus, as long as the cross-sectional shape of the resilient foam member 414 has a corner at its free end, the resilient foam member 414 can press the non-woven fabric 416 against the photosensitive drum 21 by the corner only. As a result, the same paper dust removing effects as described above can be attained.

The above description is directed to the laser beam printer 1 that transfers toner images directly from the photosensitive drum 21 to the sheets of paper P. However, the present embodiment can be applied to other types of image forming apparatus. For example, similarly to the second and third embodiments, the present embodiment can be applied to the color copy machine 1000 of FIG. 23 that employs the intermediate transfer belt 1001 to transfer color toner images from the photosensitive drum 21 to the sheets of paper P. In this modification, the paper-dust removing device 410 shown in either one of FIGS. 19(*a*), 22(*a*), and 22(*b*) can be employed to remove paper dust clinging to the intermediate transfer belt 1001, while preventing occurrence of filming on the intermediate transfer belt 1001.

Similarly to the first embodiment, the paper-dust removing devices 410 of the present embodiment may be configured so as to press against the photosensitive drum 21 with a pressure that can maintain unchanged a toner image remaining on the photosensitive drum 21 or on the intermediate belt 1001. The amount of the pressure is adjusted dependently on the nature of toner used. The pressure adjustment can be achieved by changing, for example, the distance between the support member 412 and the photosensitive drum 21 or the intermediate belt 1001, and/or the material and the thickness of the resilient foam member 414 and the sheet member 416 that are supported on the supported member 412.

Fifth Embodiment

A fifth embodiment will be described below with reference to FIGS. 24–30.

Figure 24:
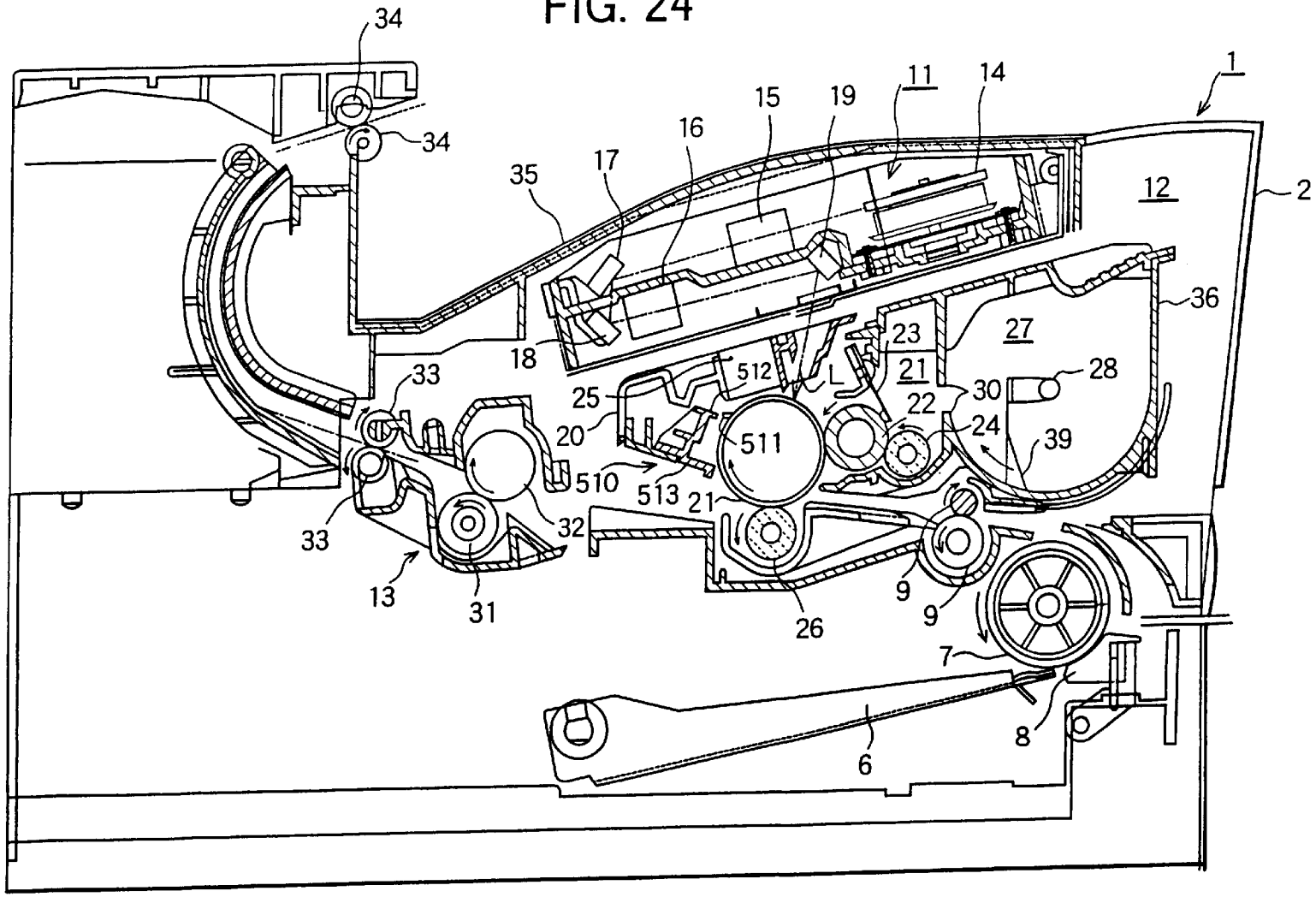
FIG. 24 is a cross-sectional view of an image forming apparatus according to a fifth embodiment.

FIG. 24 is a cross-sectional schematical view of a laser printer 1 according to the fifth embodiment. The laser printer 1 of the present embodiment is the same as that of the first embodiment except that a paper-dust removing device 510 having the configuration shown in FIGS. 24 and 25 is provided.

Figure 25:
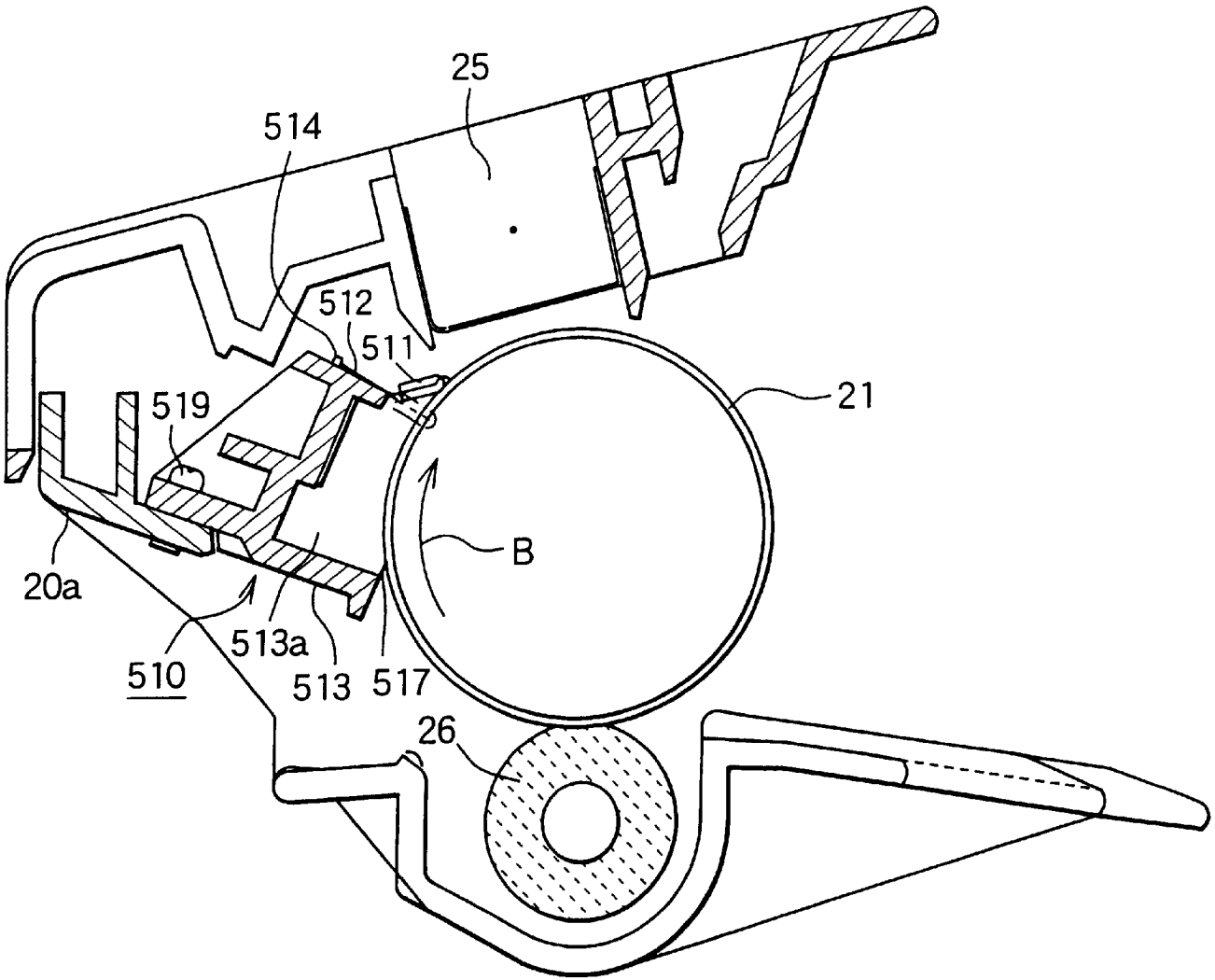
FIG. 25 is a cross-sectional enlarged view illustrating a paper-dust removing device provided in the image forming apparatus of FIG. 24.

As shown in FIG. 25, the paper-dust removing device 510 has a casing or holder 513. A urethane sheet 512 is attached to an upper surface of the holder 513. A front edge of the urethane sheet 512 is covered by a non-woven fabric 511. The non-woven fabric 511 is impregnated with oil agent.

The holder 513 is formed in an elongated shape that extends parallel to the photosensitive drum 21. The holder 513 has a length of 225 mm that is substantially equal to the length of the photosensitive drum 21. The holder 513 is fixed, at its both lengthwise ends, by a pair of screws 519 to the wall 20*a* of the drum cartridge 20 that supports the photosensitive drum 21 so that the holder 513 will confront the photosensitive drum 21.

The holder 513 has a chamber 513*a* for collecting paper dust removed from the photosensitive drum 21. The chamber 513*a* is opened at its front side confronting the photosensitive drum 21. A urethane film 517 is attached to a lower edge of the holder 513 to cover a lower half portion of the opening of the chamber 513*a*. One lower edge of the urethane film 517 is attached to the holder 513 by a two sided adhesive tape so that the upper free edge of the urethane film 517 be in abutment contact with the photosensitive drum 21. The urethane film 517 is for preventing paper dust removed from the photosensitive drum 21 from falling out of the chamber 513*a*.

Figure 26A:
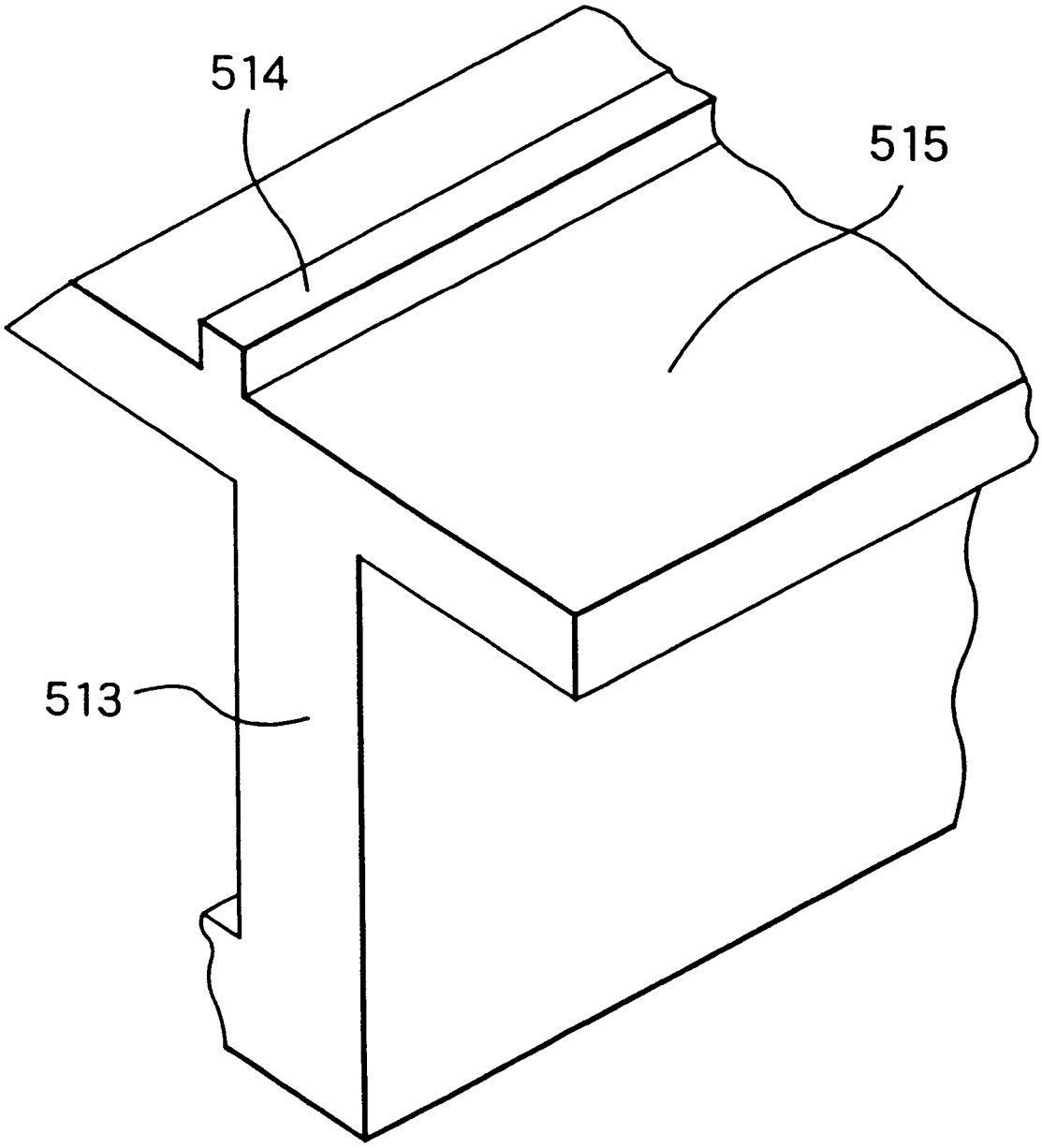
FIG. 26(*a*) is a perspective view of a holder provided in the paper-dust removing device of FIG. 25.
Figure 26B:
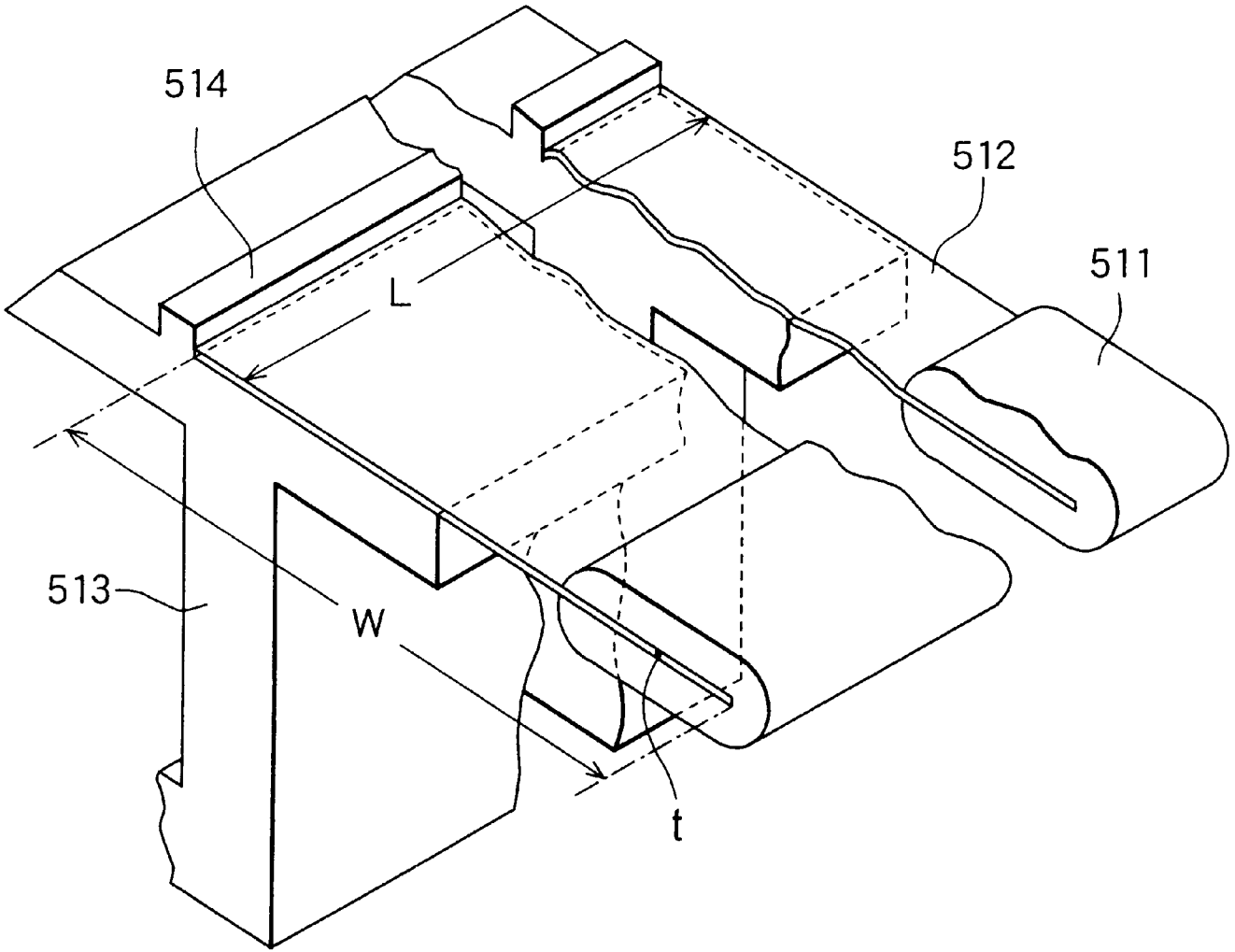

As shown in FIG. 26(*a*), the holder 513 is integrally formed with a positioning protrusion 514 at is upper surface The positioning protrusion 514 extends parallel to the photosensitive drum 21. An attachment surface area 515 is defined on the upper surface of the holder 513 in front of the positioning protrusion 514. The urethane sheet 512 is attached to the attachment surface area 515 by a two sided adhesive tape.

The urethane sheet 512 is a sheet-shaped member made from urethane rubber. The urethane sheet 512 has a hardness of 92 degrees Hs (92° Hs) according to JIS K-6301. As shown in FIG. 26(*b*), the urethane sheet 512 has a thickness t of 100 $\mu$m, a width W of 6 mm, and a length L of 225 mm that is substantially equal to the length of the photosensitive drum 21.

The non-woven fabric 511 is also formed to have the length of 225 mm substantially equal to the length of the photosensitive drum 21. The non-woven fabric 511 is attached to the front edge of the urethane sheet 512 using a two sided adhesive tape. More specifically, as shown in FIG. 26(*b*), the non-woven fabric 511 is folded in half and adhered to the front edge of the urethane sheet 512.

The urethane sheet 512 mounted with the non-woven fabric 511 is mounted to the holder 513 so that the rear edge of the urethane sheet 512 is in abutment contact with the positioning protrusion 514. The urethane sheet 512 is adhered to the attachment surface area 515. It is noted that the positioning protrusion 514 is located on the holder 513 so that if the photosensitive drum 21 is not present, the non-woven fabric 511 on the front edge of the urethane sheet 512 will reach, as indicated by a dotted line in FIG. 25, to the position where the photosensitive drum 21 is to be disposed. When the photosensitive drum 21 is positioned as shown in FIG. 25, the non-woven fabric 511 abuts against the photosensitive drum 21, and the urethane sheet 512 bends as indicated by the solid line in FIG. 25. Thus, the non-woven fabric 511 contacts the photosensitive drum 21 along its entire length by the resilient force of the urethane sheet 512. The urethane sheet 512 bends in the direction, in which the photosensitive drum 21 is driven to rotate.

Because the urethane sheet 512 has a low hardness of 92 degrees Hs (92° Hs), even when the width W of the urethane sheet 512 is short, the urethane sheet 512 can bend sufficiently freely. Accordingly, the entire paper-dust removing device 510 can be produced in a compact size. Further, because the urethane sheet 512 has a low hardness, the non-woven fabric 511 will softly contact the photosensitive drum 21 even when pressed by resilient force of the urethane sheet 512. Experiments were performed to measure, with a dial tension gauge, the pressing force of the non-woven fabric 511 that is effected against the photosensitive drum 21 by the urethane sheet 512. The pressing force was measured as a low value of only 2.5 gf/cm.

Thus, the pressing force of the non-woven fabric 511 against the photosensitive drum 21 is extremely small. However, paper dust can be caught up in the fibers constituting the non-woven fabric 511. Accordingly, the paper dust can be properly removed even with this low pressing force. The non-woven cloth 511 can properly remove both the fibers component and the filler component of the paper dust. Because the pressing force of the non-woven fabric 511 against the photosensitive drum 21 is set to the low value, the surface of the photosensitive drum 21 will not be damaged by the fibers component of the paper dust and also filming will not occur by the filler component of the paper dust.

As described above, according to the present embodiment, the non-woven fabric 511 is attached, with a two-sided adhesive tape, to the front tip end of the urethane sheet 512 that is made from urethane rubber. The urethane sheet 512 is located on the holder 513 so that its rear end abuts against the positioning protrusion 514 of the holder 513. The urethane sheet 512 is then adhered to the top surface of the holder 513 with another two-sided adhesive tape. The width of the urethane sheet 512 and the position of the positioning protrusion portion S14 are selected so that when the non-woven fabric 511 contacts the photosensitive drum 21, the urethane sheet 512 bends in the same direction as the direction in which the photosensitive drum 21 rotates.

The non-woven fabric 511 is pressed against the photosensitive drum 21 by resilient force of the low hardness urethane sheet 512. Accordingly, the pressing force of the non-woven fabric 511 against the photosensitive drum 21 is suppressed to the extremely low value of 2.5 gf/cm. Therefore, the hard pulp fiber caught by the non-woven fabric 511 does not damage the surface of the photosensitive drum 21. Filler also caught by the non-woven fabric 511 does not generate filming on the photosensitive drum surface.

Because the non-woven fabric 511 is folded at its center and adhered to the front edge of the urethane sheet 512, the non-woven fabric 511 contacts the photosensitive drum 21 with an extremely small surface area. This reliably prevents filming caused by filler even more greatly.

The urethane sheet 512 bends in the same direction as the rotational direction of the photosensitive drum 21. For this reason, even when paper dust that is carried on the photosensitive drum 21 accumulates where the non-woven fabric 511 presses against the photosensitive drum 21, the accumulated paper dust will not obstruct the sheet-shaped base member 512 from bending. The pressing force will not be increased by the paper dust. As a result, the damage to the photosensitive drum and filming can be prevented.

Because the non-woven fabric 511 removes paper dust by catching the paper dust by its constituent fibers, the paper dust can be reliably removed even when only a low pressing is force is used. This prevents paper dust from entering into the developing cartridge 36 and consequently prevents formation of undesired defective images.

Because the non-woven fabric 511 is impregnated with oil, paper dust including pulp fiber and talc can be reliably removed by cohesion force of oil. This effect is particularly striking when acidic paper is used as the recording sheet P. Because the non-woven fabric 511 removes all components of the paper dust including talc, defective images, such as fogging, can be reliably prevented.

Because the non-woven fabric 511 presses against the photosensitive drum 21 with a low pressing force, the oil is transferred to the photosensitive drum 21 in extremely small amounts. As a result, the oil does not cling in large amounts to the photosensitive drum 21, so that filming is not caused by oil. Filming caused by talc is also prevented as described previously.

Because toner is produced by polymerization, its base particles have a substantially spherical shape and have a smooth surface. The toner has a very high fluidity and therefore can be transferred very efficiently to the recording sheets P. Only very small amounts of residual toner will remain on the photosensitive drum 21 after transfer operations. Even when those small amounts of residual toner remain on the photosensitive drum 21, the smooth toner does not easily cling to the non-woven fabric 511, and therefore is reliably collected by the developing roller 22. As a result, toner is not caught at the position where the non-woven fabric 511 presses against the photosensitive drum 21. Therefore, the ability of the non-woven woven fabric 511 to remove paper dust will not reduce by accumulation of toner.

Thus, the paper-dust removing device 510 according to the present embodiment can reliably remove paper dust including fiber components and filler components without generating filming and without damaging the surface of the photosensitive drum 21. Therefore, pulp fibers and talc will not enter the developing cartridge 36. Further, pulp fibers will not be transferred to recording sheets P. As a result, defective images by fogging and staining of the recording sheets can be reliably prevented. Experiments were performed to operate the laser printer 1 of FIG. 24 to print images consecutively on 15,000 acidic sheets of paper. It was proved that the configuration of the present embodiment provided good quality images without any damage to the photosensitive drum 21 and without any filming.

A modification of the present embodiment will be described below while referring to FIG. 27.

Figure 27:
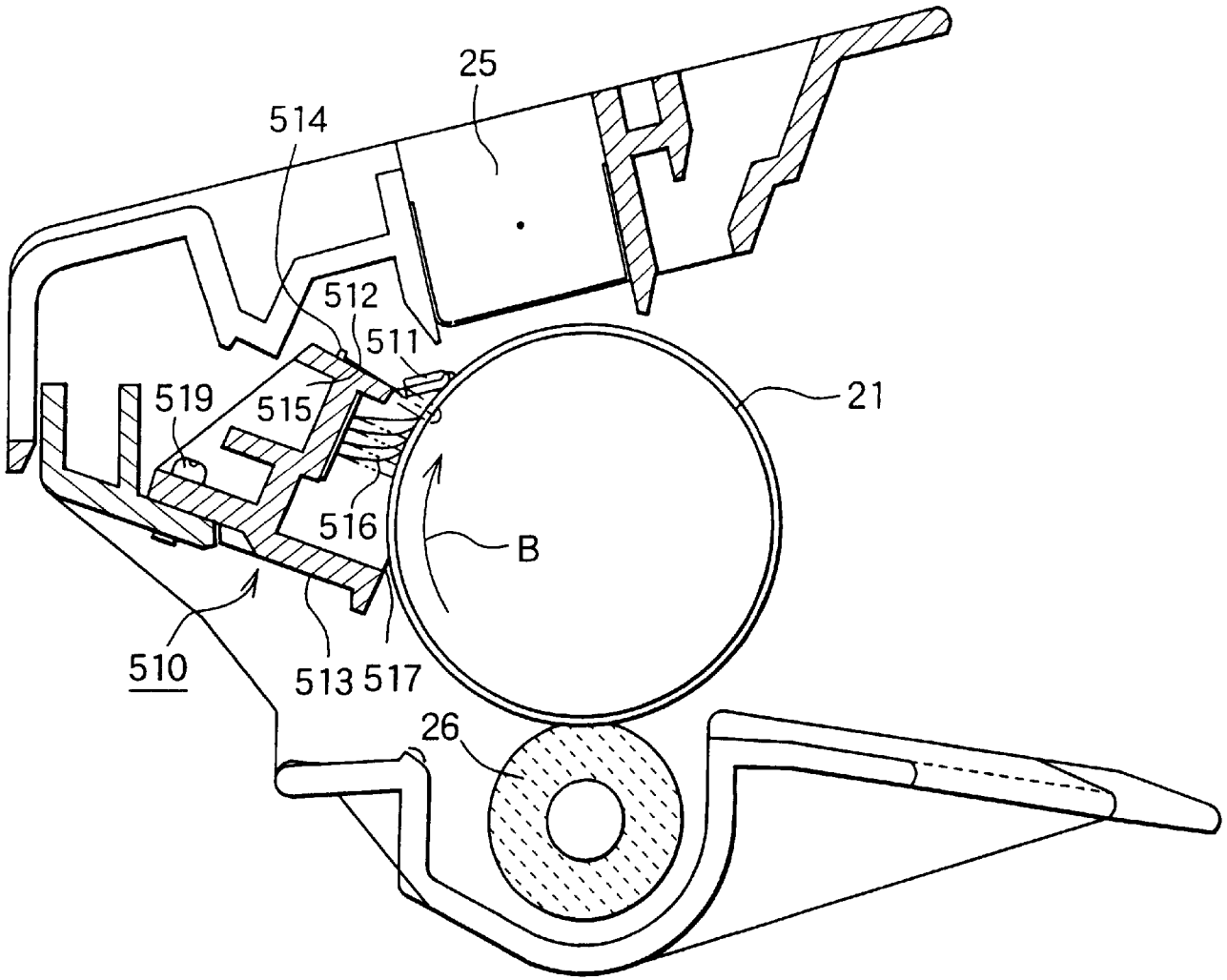
FIG. 27 is a cross-sectional enlarged view illustrating a modification of the paper-dust removing device according to the fifth embodiment.

As shown in FIG. 27, according to the present modification, the paper-dust removing device 510 additionally includes a brush 516 for scraping up paper dust from the surface of the photosensitive drum 21. The brush 516 is attached to the holder 513 at a position upstream in the rotational direction B of the photosensitive drum 21 from the urethane sheet 512.

The brush shaped member 516 can be formed from a sheet embedded with fibers. As shown in FIG. 27, the sheet is attached to an inner side surface of the holder 513 that defines the chamber 513*a* and that confronts the photosensitive drum 21. In this example, the brush 516 includes acrylic fibers. Every 50 filaments has a fineness of 500 deniers (500D/50F). The fibers are arranged on the sheet at a density of 50,000 filaments per square inch. The fibers have such lengths that when the brush 516 is attached to the holder 513, the fibers will contact the photosensitive drum 21 and will bend with small amounts. The brush 516 will therefore apply an extremely low contact force to the photosensitive drum 21.

With this arrangement, the brush shaped member 516 can scrape off large fiber-shaped components of the paper dust while contacting the photosensitive drum 21. Other remaining fine components of the paper dust such as filler will be caught by the non-woven fabric 511 pressed against the photosensitive drum 21. Considering the functions of the non-woven fabric 511 and of the brush 516, the brush 516 is attached to the holder 513 at a position that the space in the chamber 513*a* between the non-woven fabric 511 and the brush 516 be much narrower than the remaining space in the chamber 513*a* located below the brush 516. The large fiber-shaped components of the paper dust will be removed by the brush 516 and accumulated In the larger space in the chamber 513*a*. Fine components of the paper dust such as filler will be removed by the non-woven fabric 511 and accumulated in the smaller space in the chamber 513*a*.

Thus, according to the present modification, by providing the brush member 516 in this manner, large fiber-shaped components of the paper dust can be scraped off by the brush member 516. This configuration reliably prevents large fiber-shaped components of paper dust from accumulating at the position where the non-woven fabric 511 presses against the photosensitive drum 21. As a result, any line-shaped scratches can be reliably prevented from occurring on the surface of the photosensitive drum 21 due to the fiber-shaped paper dust. Even when fiber-shaped paper dust accumulates where the brush shaped member 516 contacts the photosensitive drum 21, because the brush shaped member 516 contacts the photosensitive drum 21 with an extremely low pressing contact force, any line-shaped scratches will not be generated on the surface of the photosensitive drum 21.

According to the paper-dust removing device 510 of the present modification, paper dust accumulates at two locations, that is, where the brush shaped member 516 contacts the photosensitive drum 21 and where the non-woven fabric 511 presses against the photosensitive drum 21. Therefore, the paper dust removing ability of the brush 516 and of the non-woven fabric 511 can be reliably maintained over a long period of time. Therefore, the life of the paper-dust removing device 510 can be increased.

Figure 28:
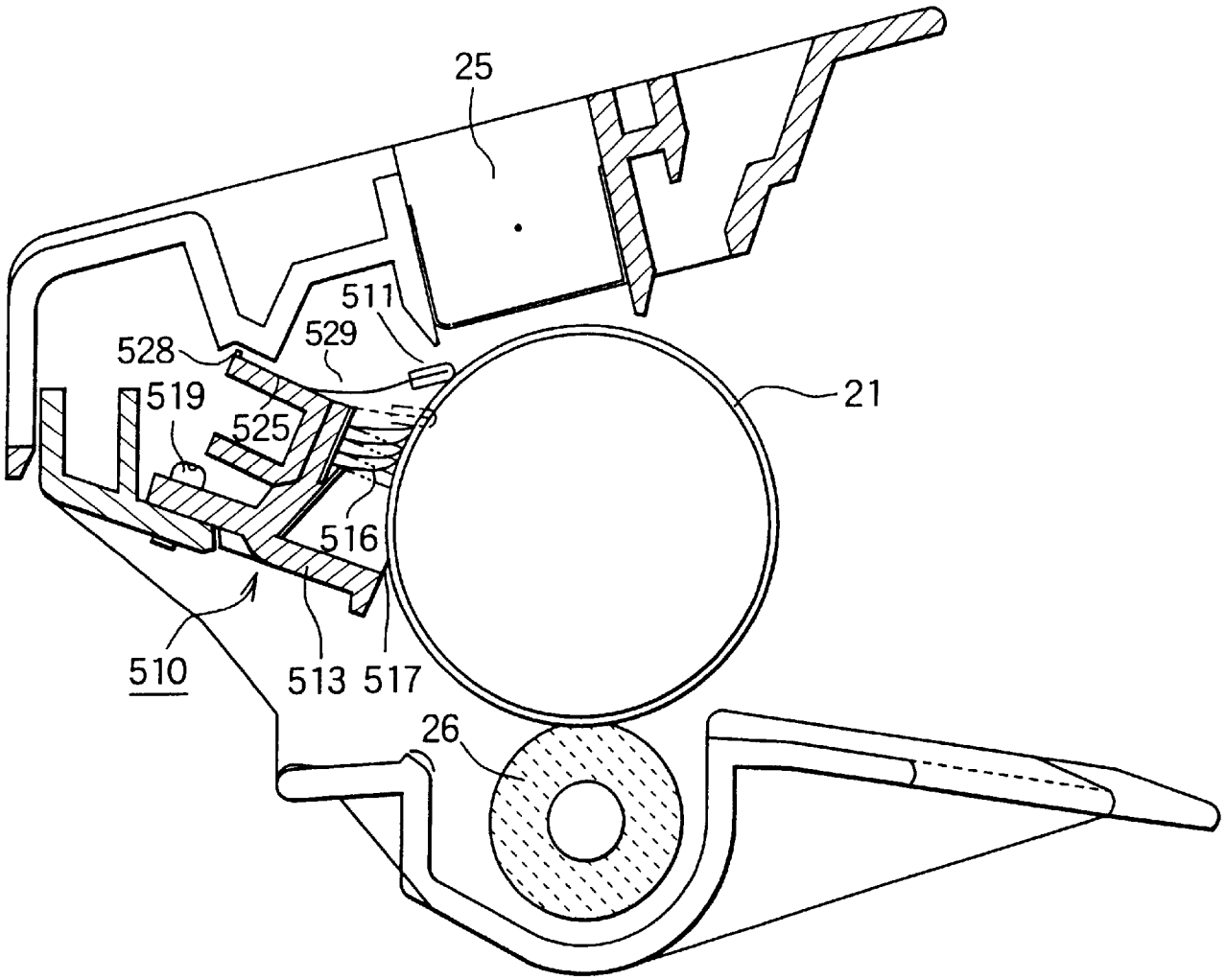
FIG. 28 is a cross-sectional enlarged view illustrating another modification of the paper-dust removing device according to the fifth embodiment.

Next, another modification of the present embodiment will be described while referring to FIGS. 28–29(*b*).

According to the present modification, a resin sheet 529 is used instead of the urethane rubber sheet 512 for supporting the non-woven fabric 511. In this example, a polyethylene terephthalate (PET) sheet 529 is used. PET normally has hardness greater than urethane rubber. Accordingly, by setting the width of the PET sheet 529 greater than the urethane sheet 512 and by setting the thickness of the PET sheet 529 smaller than the urethane sheet 512, bendability of the PET sheet 529 can be increased to the same degree as that of the urethane sheet 512. The pressing force of the PET sheet against the photosensitive drum 21 can therefore be suppressed to a desired amount.

Figure 29A:
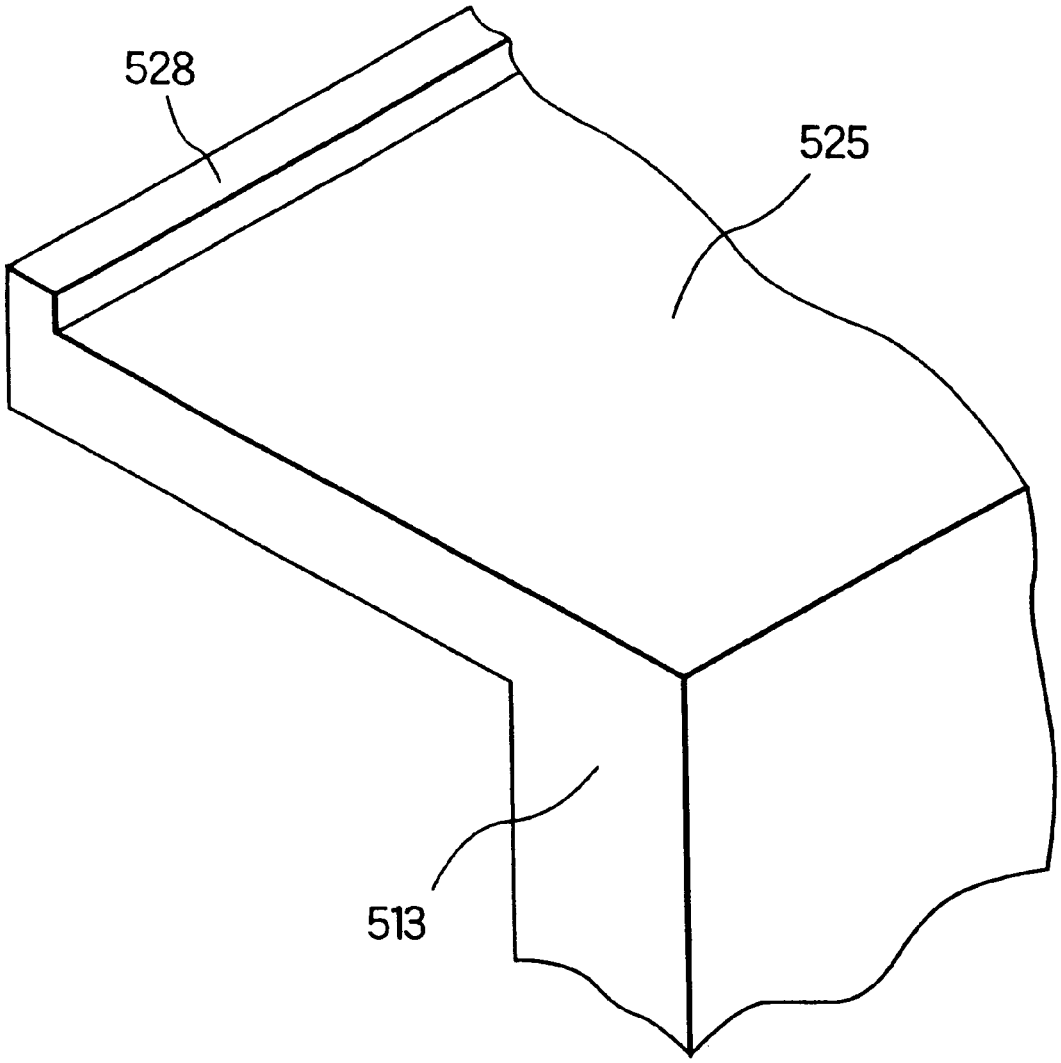
FIG. 29(*a*) is a perspective view of a holder in the paper-dust removing device of FIG. 28.
Figure 29B:
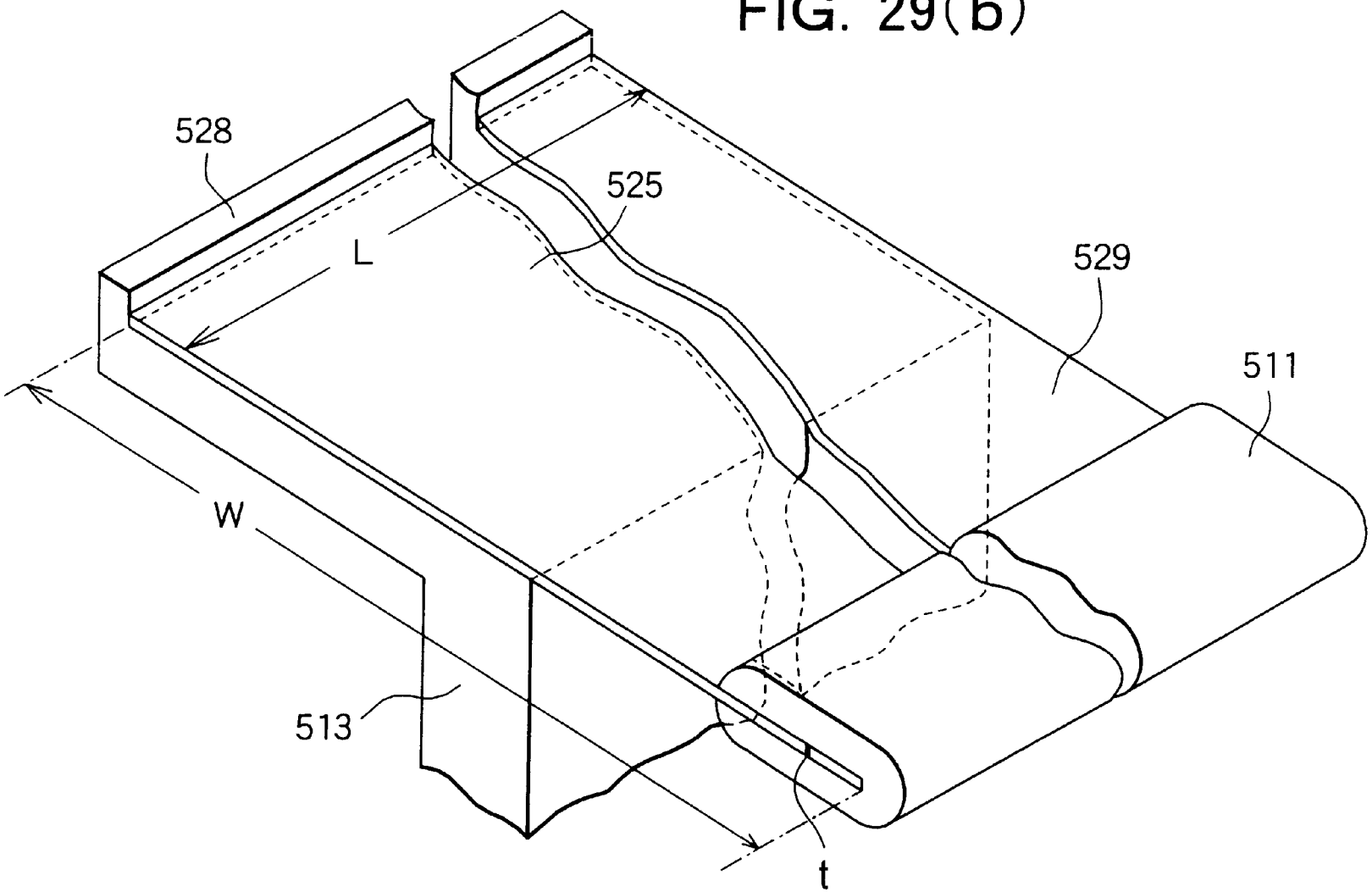
Figure 30:
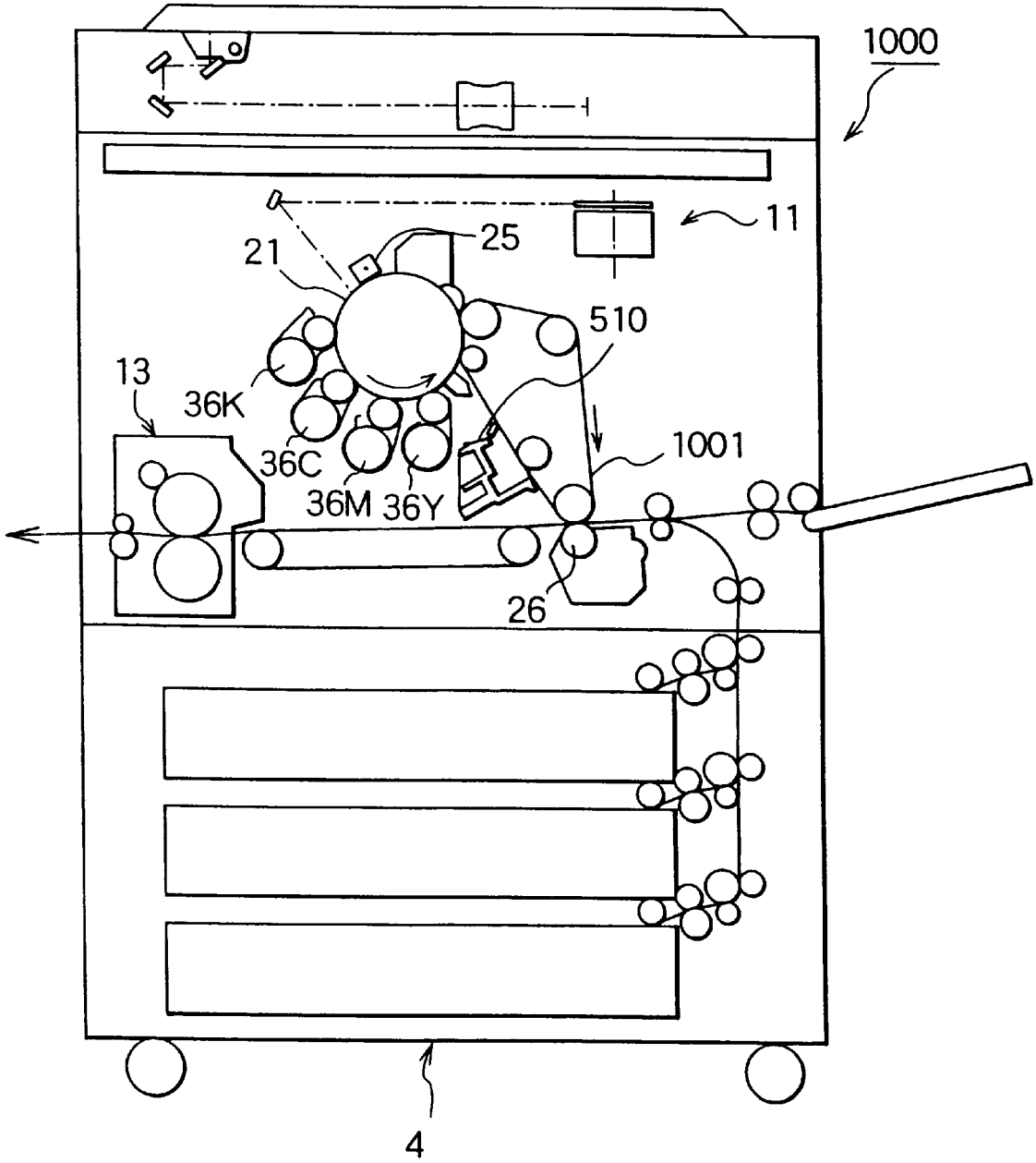
FIG. 30 is a cross-sectional view of an image forming apparatus of a modification according to the fifth embodiment.

In this example, as shown in FIG. 29(*b*), the PET sheet 529 is formed to have a thickness t of 50 $\mu$m, a width W of 16 mm, and a length L of 225 mm. Thus, the PET sheet 529 is formed thinner and wider than the urethane sheet 512 of FIG. 26(*b*).

As shown in FIG. 29(*a*), the holder 513 is integrally formed with another positioning protrusion 528 at its upper surface. The positioning protrusion 528 extends parallel to the lengthwise direction of the photosensitive drum 21. Another attachment surface area 525 is defined on the upper surface of the holder 513 in front of the positioning protrusion 528. Because the width of the PET sheet 529 is larger than that of the urethane sheet 512, the positioning protrusion 528 is positioned so that the attachment surface area 525 for the PET sheet 529 will become greater than that of the attachment surface area 515 for the urethane sheet 512. As shown In FIGS. 28 and 29(*b*), the PET sheet 529 is attached to the attachment surface area 525 by a two sided adhesive tape while the rear edge of the PET sheet 529 abuts against the positioning protrusion 528. The PET sheet 529 is formed to the width large enough so that if the photosensitive drum 21 is not present, the non-woven fabric 511 provided on the front edge of the PET sheet 529 will reach the position of the photosensitive drum 21 as indicated by the dotted line in FIG. 28, Accordingly, when the photosensitive drum 21 is disposed at position indicated in FIG. 28, the PET sheet 529 bends as indicated by a solid line to resiliently press the non-woven fabric 511 against the photosensitive drum 21 by a resilient force of the PET sheet 529. The PET sheet 529 bends in the same direction as the rotational direction of the photosensitive drum 21.

The pressing force of the PET sheet 529 was measured, using a dial tension gauging, in the same manner as described already in the present embodiment. The pressing force was measured as extremely low as 1.2 gf/cm.

An experiment was performed to test paper dust removal performance of the paper-dust removing device 510 of the present modification. That is, the paper-dust removing device 510 of FIG. 28 was mounted in the laser printer 1 of FIG. 24, and the laser printer 1 was operated to print images consecutively on 15,000 sheets of acidic paper in the same manner as described already in the present embodiment. It was confirmed that paper dust was properly removed without any generation of filming and any damage to the surface of the photosensitive drum 21. Also, printed images had high quality.

The above description is directed to the laser beam printer 1 that transfers toner images directly from the photosensitive drum 21 to the sheets of paper P. However, the present embodiment can be applied to other types of image forming apparatus. For example, similarly to the second through fourth embodiments, the present embodiment can be applied to the color copy machine 1000 of FIG. 30 that employs the intermediate transfer belt 1001 to transfer toner images from the photosensitive drum 21 to the sheets of paper P. In this modification, the paper-dust removing device 510 having the configuration of either one of FIGS. 25, 27, and 28 can be employed to remove paper dust clinging to the intermediate transfer belt 1001, while preventing occurrence of filming on the intermediate transfer belt 1001.

Similarly to the first embodiment, the paper-dust removing devices 510 of the present embodiment may be configured so as to press against the photosensitive drum 21 with a pressure that can maintain unchanged a toner image remaining on the photosensitive drum 21 or on the intermediate belt 1001. The amount of the pressure is adjusted dependently on the nature of toner used. The pressure adjustment can be achieved by changing, for example, the distance between the holder 513 and the photosensitive drum 21 or the intermediate belt 1001, the material and/or the width of the sheet member 512 or 529 supported on the holder 513, and/or the material and the thickness of the non-woven fabric sheet member 511.

Sixth Embodiment

A sixth embodiment will be described below with reference to FIGS. 31–36.

Figure 31:
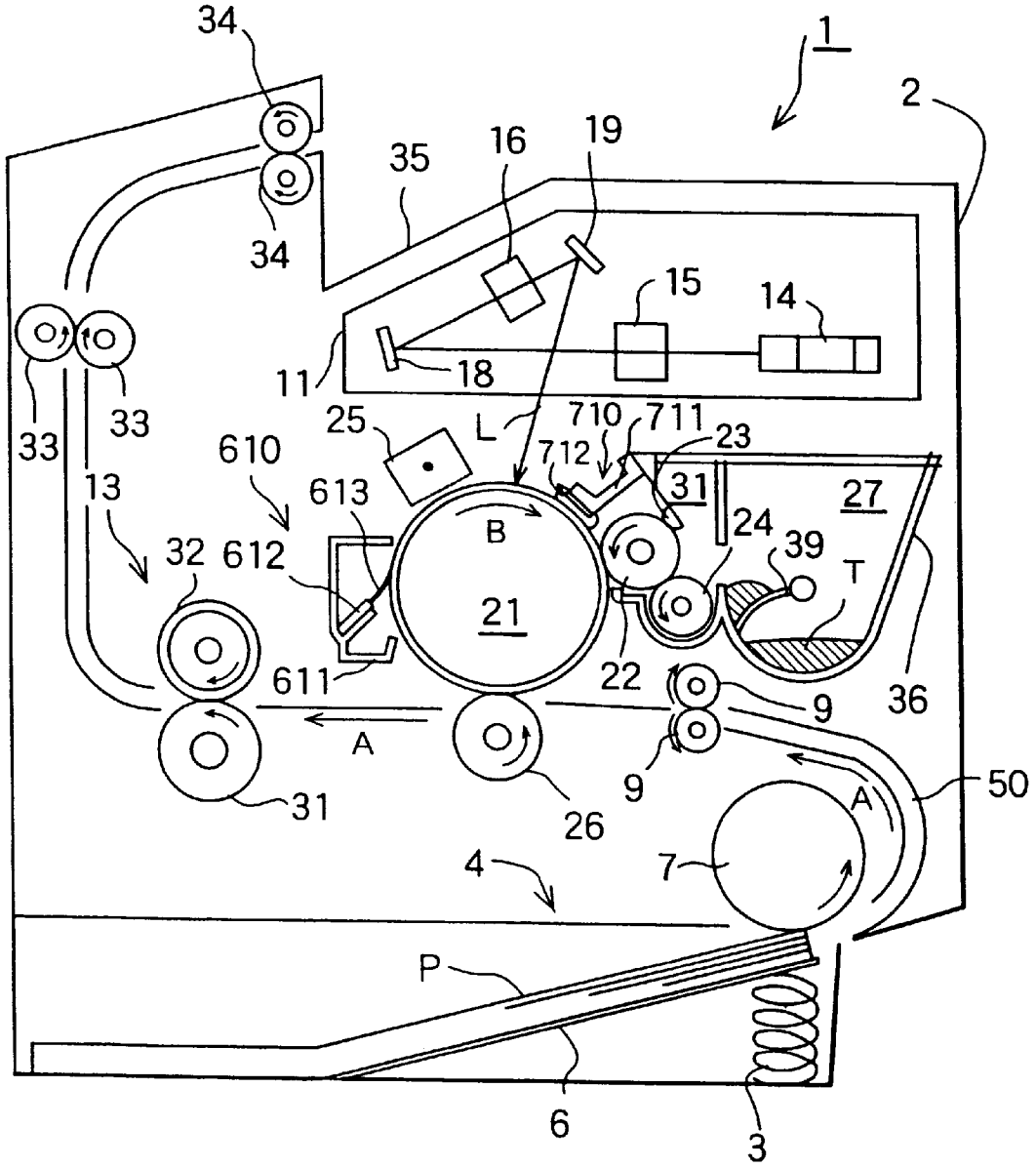
FIG. 31 is a cross-sectional view of an image forming apparatus according to a sixth embodiment.

FIG. 31 is a cross-sectional schematical view of a laser printer 1 according to the sixth embodiment. The laser printer 1 of the present embodiment is the same as those of the second through fourth embodiments except that first and second paper-dust removing devices 610 and 710 are provided in the present embodiment.

The first paper-dust removing device 610 is provided mainly for removing pulp fiber, while the second paper-dust removing device 710 is provided mainly for removing filler such as talc. The paper-dust removing device 610 is disposed downstream from the transfer position in the rotational direction B of the photosensitive drum 21. The second paper-dust removing device 710 is disposed downstream from the first paper-dust removing device 610 in the rotational direction 3 of the photosensitive drum 21.

Figure 32:
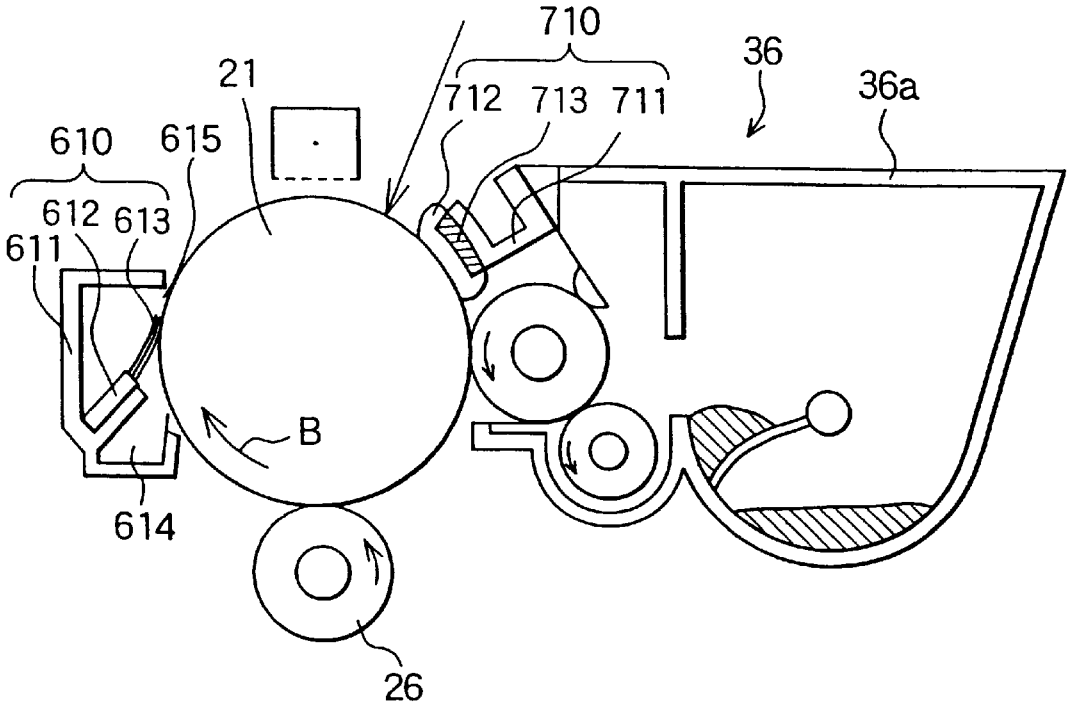
FIG. 32 is a cross-sectional view illustrating first and second paper-dust removing devices provided in the image forming apparatus of FIG. 31.

As shown in FIG. 32, the first paper-dust removing device 610 includes a casing 611, within which a support member 612 is fixedly mounted. An electrically insulating brush 613 is supported by the support member 612 to slantedly extend in the rotational direction B of the photosensitive drum 21 so that its front tip end contacts the surface of the photosensitive drum 21. The casing 611 includes a paper dust accumulation space 614 therein. The paper dust accumulation space 614 is located below the brush 613. The casing 611 also includes an opening 615 communicating with the paper dust accumulation space 614.

The opening 615 is located at a predetermined position and has a predetermined size, thereby allowing paper dust, removed by the brush 613, to fall due to gravitational force and properly enter the space 614.

Having the above-described structure, the first paper-dust removing device 610 is disposed relative to the photosensitive drum 21 so that the brush 613 contacts the photosensitive drum 21 at a position that is directly downstream from the transfer position in the rotational direction B of the photosensitive drum 21. At this position, paper dust including both pulp fiber and filler such as talc clings to the surface of the photosensitive drum 21. Because the brush 613 contacts the photosensitive drum 21 directly after the photosensitive drum 21 contacts a sheet of paper P at the transfer position, the brush 613 can remove long and hard pulp fibers from the photosensitive drum 21. Rotation of the photosensitive drum 21 will convey residual components of the paper dust, such as filler material, downstream from the position where the brush 613 contacts the photosensitive drum 21 with respect to the rotational direction B of the photosensitive drum 21.

The brush 613 is provided to contact the photosensitive drum 21 with an extremely small contact pressure. More specifically, the distance between the support member 612 and the photosensitive drum 21, the is length of the brush 613, and the material of the brush 613 are selected so that the brush 613 can apply an extremely small contact pressure against the photosensitive drum 21. Accordingly, pulp fibers will not be accumulated where the brush 613 contacts the photosensitive drum 21, but instead will drop down by gravitational force into the space 614 of the casing 611 and be accumulated therein. Great amounts of pulp fiber will not accumulate where the brush 613 contacts the photosensitive drum 21. Accordingly, pulp fiber will not scratch the surface of the photosensitive drum 21, and filming is not generated by accumulation of talc.

As shown in FIG. 32, the second paper-dust removing device 710 Includes a support member 711 that is integrally attached to the wall 36*a* of the developing cartridge 36. A non-woven fabric 712 lined by a back lining sponge 713 is supported on the support member 711. Because fibers are highly randomly entangled Into an integral mass of the non-woven fabric 712, the non-woven fabric 712 can properly catch fine paper dust in between the fibers. However, even a woven fabric or knitted fabric can be used instead of the non-woven fabric 712 because fibers entangled Into the integral mass of the woven fabric or the knitted fabric can also catch the fine paper dust sufficiently.

The non-woven fabric 712 is positioned so as to press against the photosensitive drum 21 with a pressing force of substantially a zero (0) value. That is, the support member 711 is separated from the photosensitive drum 21 by a distance equal to the total thickness of the non-woven fabric 712 and the back lining sponge 713. Because the non-woven woven fabric 712 is lined by the sponge 713, the pressing force against the photosensitive drum 21 is maintained at substantially zero for a long period of time.

Also, the non-woven fabric 712 contacts the photosensitive drum 21 at a position downstream in the rotational direction B of the photosensitive drum 21 than the position where the first paper-dust removing device 610 contacts the photosensitive drum Z1. Because hard pulp fibers included in the paper dust have been removed by the first paper-dust removing device 710, hard pulp fibers will not accumulate where the non-woven fabric 712 contacts the photosensitive drum 21. Accordingly, the surface of the photosensitive drum 21 will not be damaged by pulp fibers.

Because pressing force of the non-woven fabric 712 against the photosensitive drum 21 will be maintained at substantially zero pressing force and because the non-woven fabric 712 will not lose its soft character, filler material, such as relatively soft talc, caught by the non-woven fabric 712 will not be strongly pressed against the photosensitive drum 21. Accordingly, filming will not occur. In this way, the surface of the photosensitive drum 21 will not be is damaged, and talc can be reliably removed.

Because the non-woven fabric 712 is fixedly positioned to be pressed against the photosensitive drum 21, components of paper dust other than pulp fibers will likely accumulate between the non-woven fabric 712 and the photosensitive drum 21. However, the developing cartridge 36 is freely detachable from the laser printer 1, and therefore the second paper-dust removing device 710 can be exchanged with a new one when the developing cartridge 36 is exchanged with a new one. Accordingly, damage to the photosensitive drum 21, such as filming, that can possibly occur over long periods of time, can be properly prevented from occurring. More specifically, when deterioration of images is occurred due to decrease of the remaining amount of the developing agent in the developing cartridge 36, the developing cartridge 36 is removed from the laser printer 1. A new developing cartridge 36 is attached to the printer 1, thereby enabling formation of good images. When the developing cartridge 36 is thus replaced with a new one, the second paper dust removing device 710 attached to the developing cartridge 36 can be simultaneously replaced with a new one. Accordingly, even when paper dust accumulates on the contact portion between the second paper-dust removing device 710 and the photosensitive drum 21, damage of the photosensitive drum 21 and filming can be prevented.

Thus, according to the present embodiment, components of paper dust are investigated in detail and divided into fibers components, such as pulp fiber, and filler components, such as talc. The first paper-dust removing device 610 designed for removing fibers components is disposed upstream in the rotational direction of the photosensitive drum 21 than the second paper-dust removing device 710 that is designed for removing filler components. Therefore, even when acidic paper is used as the recording medium, pulp fiber and talc can be reliably removed while filming by talc is not generated on the photosensitive drum 21. Thus, pulp fiber and talc can be prevented from entering the developing cartridge 36. Pulp fiber can be prevented from being transferred to the sheet of paper P. Defective images caused by fogging or stains on the recording sheet can be reliably prevented.

As described above, in the first removing device 610, the brush 613 is supported by the support member 612 that is attached to the interior of the casing 611. The device 610 mainly removes pulp fibers of the paper dust. The device 610 is located downstream from the transfer position in the photosensitive drum rotating direction B. The second removing device 710 includes the support member 711 that is attached to the casing 36a of the developing cartridge 36. The support member 711 supports the non-woven fabric 712 that is lined by the sponge 713. The second removing device 710 mainly removes talc in the paper dust. The second removing device 710 is located downstream from the first removing device 610 in the photosensitive drum rotating direction B. In the device 710, the non-woven fabric 712 contacts the photosensitive drum 21 at substantially zero contact pressure.

A modification of the present embodiment will be described below.

Figure 33:
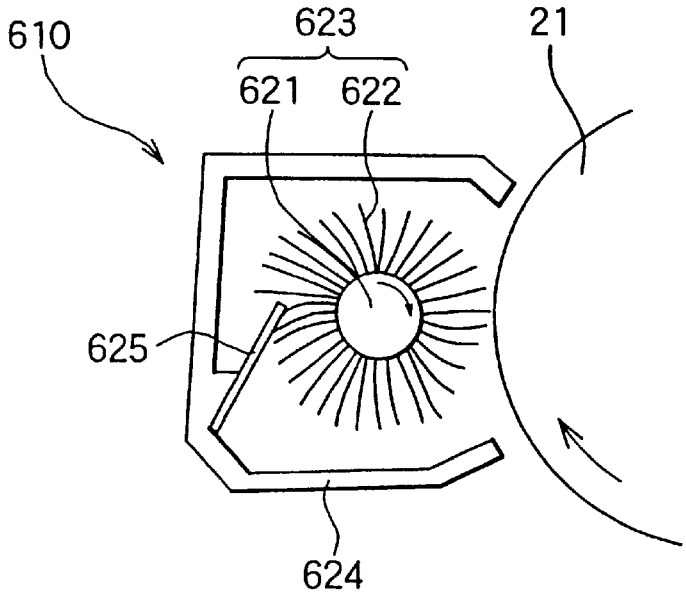
FIG. 33 is a cross-sectional view of a modification of the first paper-dust removing device of the sixth embodiment.
Figure 34A:
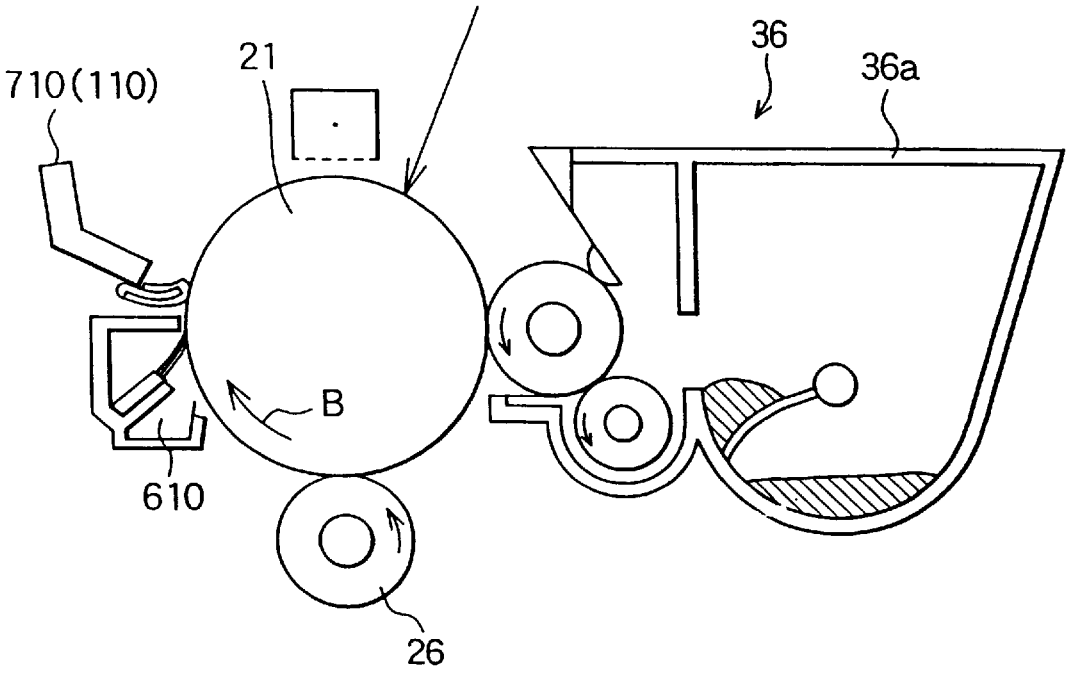
FIG. 34(*a*) is a cross-sectional view illustrating the state how the first paper-dust removing device and a second paper-dust removing device of another modification are provided.
Figure 34B:
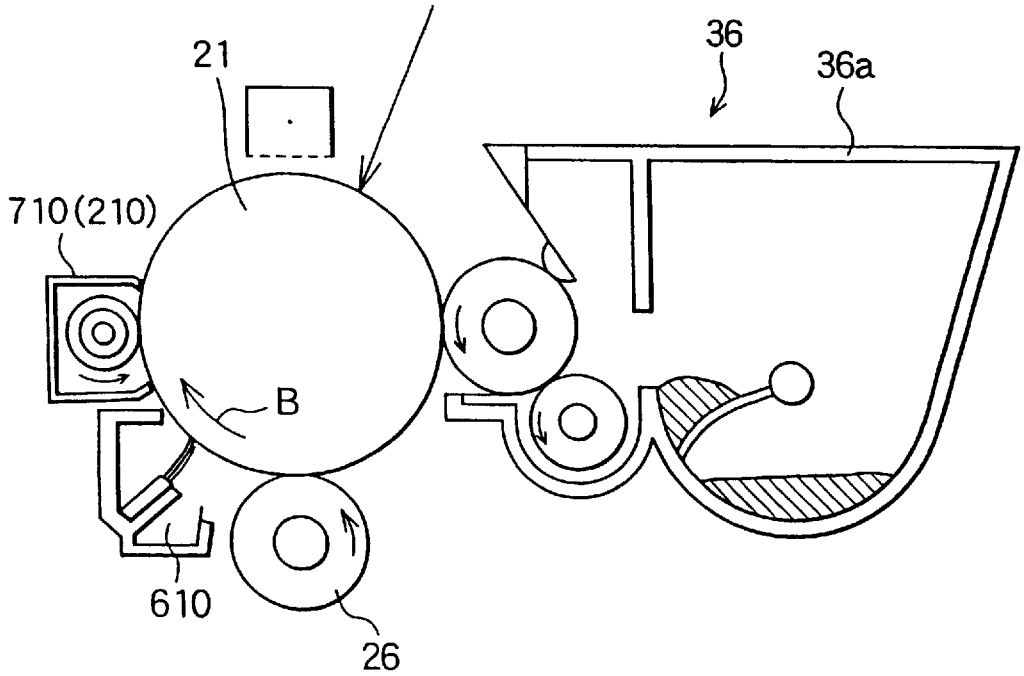
Figure 34C:
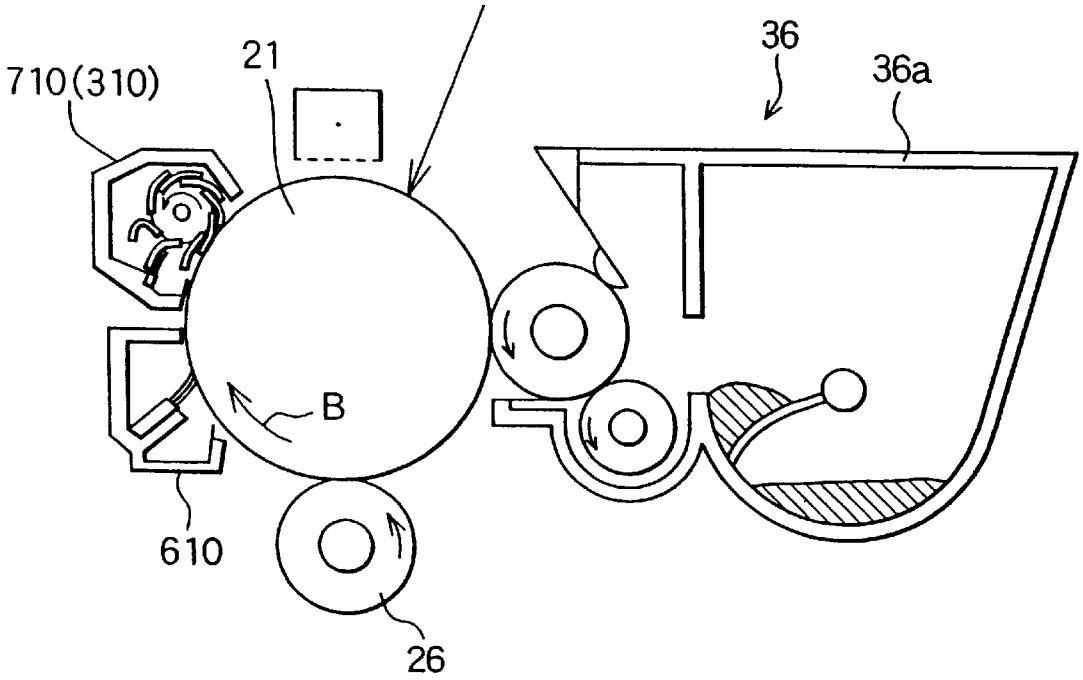
Figure 34D:
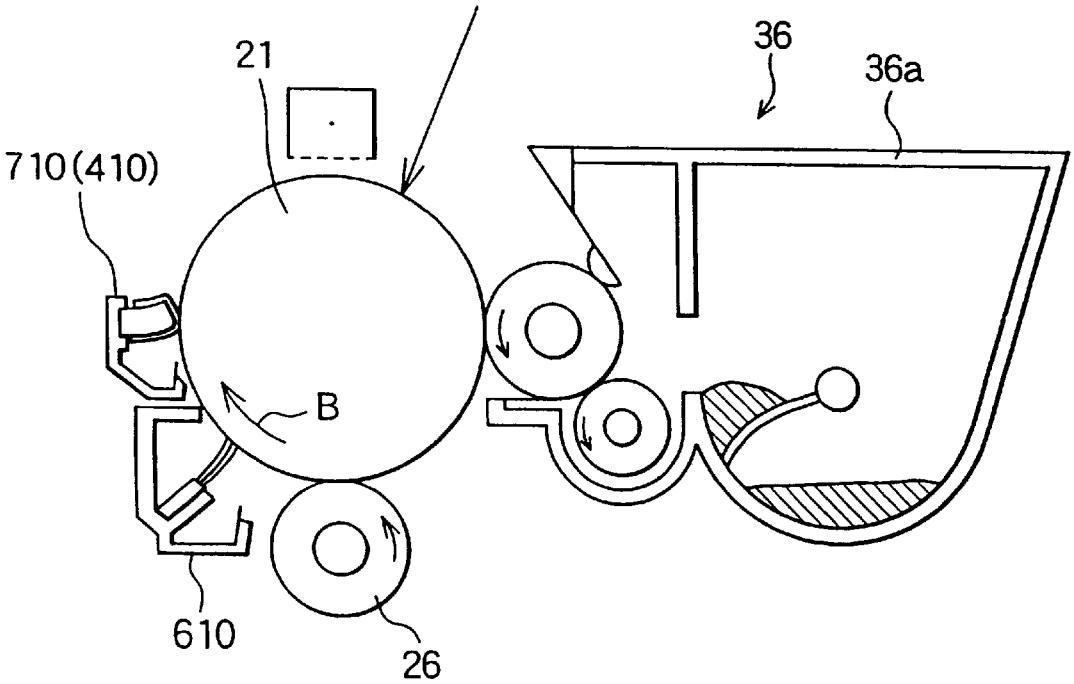
Figure 34E:
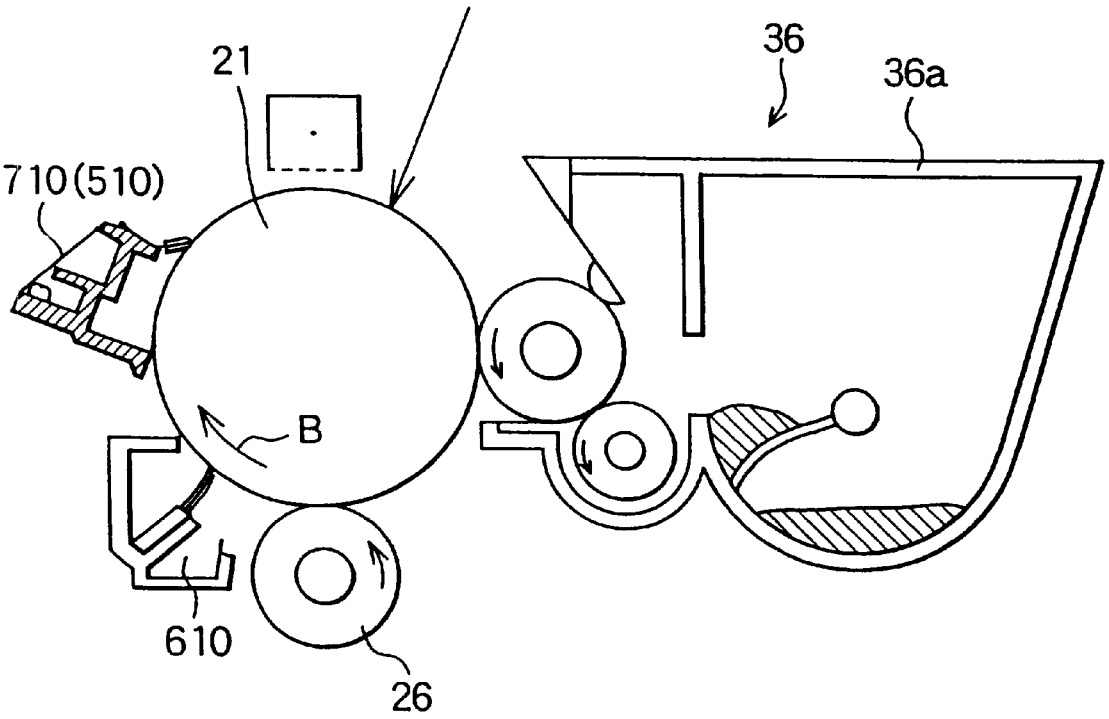

In the above description, the first paper-dust removing device 610 includes the electrically-insulating brush 613 that is fixedly secured to the casing 611. However, the first paper-dust removing device 610 can be configured as shown in FIG. 33. In this case, the first paper-dust removing device 610 includes a casing 624, within which a paper dust removing roller 623 is mounted. The paper dust removing roller 623 is mounted freely rotatably within the casing 624. A drive mechanism (not shown) is provided for driving the roller 623 to rotate in, the same direction as the photosensitive drum 21.

The paper dust removing roller 623 is constructed from: a resilient roller 621; and an insulating brush 622 attached to the roller 621. Alternatively, the roller 621 may be made of a stiff material. The brush 622 is made of material that tends to charge to the same polarity as the photosensitive drum 21 and that has the same charging characteristic as the photosensitive drum 21. Accordingly, the photosensitive drum 21 is not electrically charged even when the photosensitive drum 21 slidingly contacts the brush 622. For example, the insulating brush 622 is formed from nylon.

As shown in FIG. 33, a scraping member 625 is additionally mounted in the casing 624. The scraping member 625 is formed from a PET sheet and is positioned in contact with the brush 622.

The first paper-dust removing device 620 having the above-described structure is located at a position so that the brush 622 can be pressed against the photosensitive drum 21 with an extremely small pressing force. More specifically, the distance between the roller 621 and the photosensitive drum 21, the length of the brush 622 attached to the roller 621, and the material of the brush 622 are selected so that the brush 622 can apply an extremely small pressing force to the photosensitive drum 21. However, wiping force of the brush 622 can remove pulp fiber reliably from the surface of the photosensitive drum 21. Even when the pulp fiber removed by the brush 622 from the photosensitive drum 21 clings to the brush 622, the scraping member 625 scrapes the pulp fiber off the brush 622 so that the pulp fiber will not cling to the brush 622.

The roll-shaped brush 623 can properly remove fiber components of the paper dust. The contact portion of the roller 623 with the photosensitive drum 21 continuously changes according to rotation of the roll-shaped brush 623. The paper dust picking up efficiency is therefore enhanced. Paper fiber components are prevented from accumulating between the second paper-dust removing device 711 and the photosensitive drum 21.

Similarly to the first embodiment, each of the brush 613 (FIG. 32) and the brush roller 623 (FIG. 33) of the first paper-dust removing device 610 can be configured to press against the photosensitive drum 21 with a contact force that can properly maintain a pattern of a residual toner image remaining on the surface of the photosensitive drum 21. The contact force is adjusted dependently on the nature of toner by changing the bending amount that the brush 613 or 622 bends in contact with the photosensitive drum 21. The bending amount can be changed by changing the length of the constituent fibers of the brush 613 or 622, the distance between the brush and the photosensitive drum 21, and/or the material of the brush-fibers.

Similarly, the non-woven fabric 712 of the second paper-dust removing device 710 can be configured to press against the photosensitive drum 21 with a contact force that can properly maintain the pattern of a residual toner image on the surface of the photosensitive drum 21. The contact force is adjusted dependently on the nature of toner by changing the material and thickness of the back lining sponge 713, and the distance between the support member 711 and the photosensitive drum 21. The back lining sponge 713 may be replaced with a thin PET film or the like. Or, the paper-dust removing device 110 of the first embodiment (shown in FIG. 1.) can be employed as the second paper-dust removing device 710 as shown in FIG. 34(*a*). The paper-dust removing device 110 is located downstream from the first paper-dust removing device 610 with respect to the photosensitive drum rotating direction B. The paper-dust removing device 110 therefore serves to remove remaining fine paper dust that is not removed by the first paper-dust removing device 610. Several advantages the same as those obtained by the paper-dust removing device 110 of the first embodiment can be attained.

The non-woven fabric 712 of the second paper-dust removing device 710 can be impregnated with oil in a similar manner to the second embodiment. In such a case, the paper-dust removing device 210 of the second embodiment (shown in FIG. 7) can be employed as the second paper-dust removing device 710 as shown in FIG. 34(*b*). The paper-dust removing device 210 is located downstream from the first paper-dust removing device 610 with respect to the photosensitive drum rotating direction B. The paper-dust removing device 210 therefore serves to remove remaining fine paper dust that is not removed by the first paper-dust removing device 610. Several advantages the same as those obtained by the paper-dust removing device 210 of the second embodiment can be attained. In a similar manner, any of the paper-dust removing devices 210, 220, 230, 240, and 250 (FIGS. 8–12) can be employed as the second paper-dust removing device 710. Each paper-dust removing device 210, 220, 230, 240, and 250 is located to press its oil-impregnated fiber-made contact member 215, 222, 232, 242, 251 against the photosensitive drum 21 with substantially a zero pressure value.

Similarly to the third embodiment, the configuration of the second paper-dust removing device 710 can be modified so that the non-woven fabric 712 can contact the photosensitive drum surface at its position that is not supported by the back lining member 713. Or, the paper-dust removing device 310 of the third embodiment (shown in FIG. 14) can be employed as the second paper-dust removing device 710 as shown in FIG. 34(*c*). The paper-dust removing device 310 is located downstream from the first paper-dust removing device 610 with respect to the photosensitive drum rotating direction B. The paper-dust removing device 310 therefore serves to remove remaining fine paper dust that is not removed by the first paper-dust removing device 610. Several advantages the same as those obtained by the paper-dust removing device 310 of the third embodiment can be attained. In a similar manner, any of the paper-dust removing devices 320, 330, and 340 (FIGS. 15(*b*)–16) can be employed as the second paper-dust removing device 710. Each removing device 310, 320, 330, and 340 is disposed so that its sheet-shaped contact member 318, 328, 338, and 348 will contact the photosensitive drum 21 at its portion that is out of contact with its base member 316, 325, 336, and 345. For example, in the device 320, the central curved portion of the sheet 328 that is out of contact with the base member 325 contacts the photosensitive drum 21. In the device 330, the lower part of the tubular sheet 338 that is out of contact with the roller 336 contacts the photosensitive drum 21. In the device 340, the protruding portion of the sheet 348 that is out of contact with the bass member 345 contacts the photosensitive drum 21. Each removing device 310, 320, 330, and 340 is preferably disposed so that its base member 316, 325, 336, and 345 be located vertically higher than the portion where its sheet-shaped contact member 318, 328, 338, and 348 contacts the photosensitive drum 21. In this case, the sheet-shaped contact member 318, 328, 338, and 348 hangs down from the corresponding base member 316, 325, 336, and 345 due to gravitational force to contact the photosensitive drum 21.

Similarly to the fourth embodiment, the non-woven fabric 712 can be designed to contact the photosensitive drum 21 at its position that is supported by a corner edge of the back lining sponge 713. Or, the paper-dust removing device 410 of the fourth embodiment (shown in FIG. 18) can be employed as the second paper-dust removing device 710 as shown in FIG. 34(*d*). The paper-dust removing device 410 is located downstream from the first paper-dust removing device 610 with respect to the photosensitive drum rotating direction B. The paper-dust removing device 410 therefore serves to remove remaining fine paper dust that is not removed by the first paper-dust removing device 610. Several advantages the same as those obtained by the paper-dust dust removing device 410 of the fourth embodiment can be attained. The configuration of the paper-dust removing devices 410 may have other configurations such as those shown in FIGS. 22(*a*) and 22(*b*).

Similarly to the fifth embodiment, the non-woven fabric 712 can be provided to a tip end of a resilient sheet member, such as a urethane sheet or a PET sheet, that is mounted to the development cartridge 36. Or, the paper-dust removing device 510 of the fifth embodiment (shown in FIG. 24) can be employed as the second paper-dust removing device 710 as shown in FIG. 34(*e*). The paper-dust removing device 510 is located downstream from the first paper-dust removing device 610 with respect to the photosensitive drum rotating direction B. The paper-dust removing device 510 therefore serves to remove remaining fine paper dust that is not removed by the first paper-dust removing device 610. Several advantages the same as those obtained by the paper-dust dust removing device 510 of the fifth embodiment can be attained. The configuration of the paper-dust removing devices 510 may have other configurations such as those shown in FIGS. 27 and 28.

The above description is directed to the laser beam printer 1 that transfers toner images directly from the photosensitive drum 21 to the sheets of paper P. However, the present embodiment can be applied to other types of image forming apparatus. For example, similarly to the second through fifth embodiments, the present embodiment can be applied to the color copy machine 1000 of FIG. 35 that employs the intermediate transfer belt 1001 to transfer toner images from the photosensitive drum 21 to the sheets of paper P. In this modification, the first paper-dust removing device 610 having the configuration of FIGS. 32 or 33 and the second paper-dust removing device 710 having the configuration of FIGS. 32, 8–12, 15(*a*)–16, 19(*a*), 22(*a*)–22(*b*), 25, 27, or 28 can be mounted to remove paper dust clinging to the intermediate transfer belt 1001.

Figure 35:
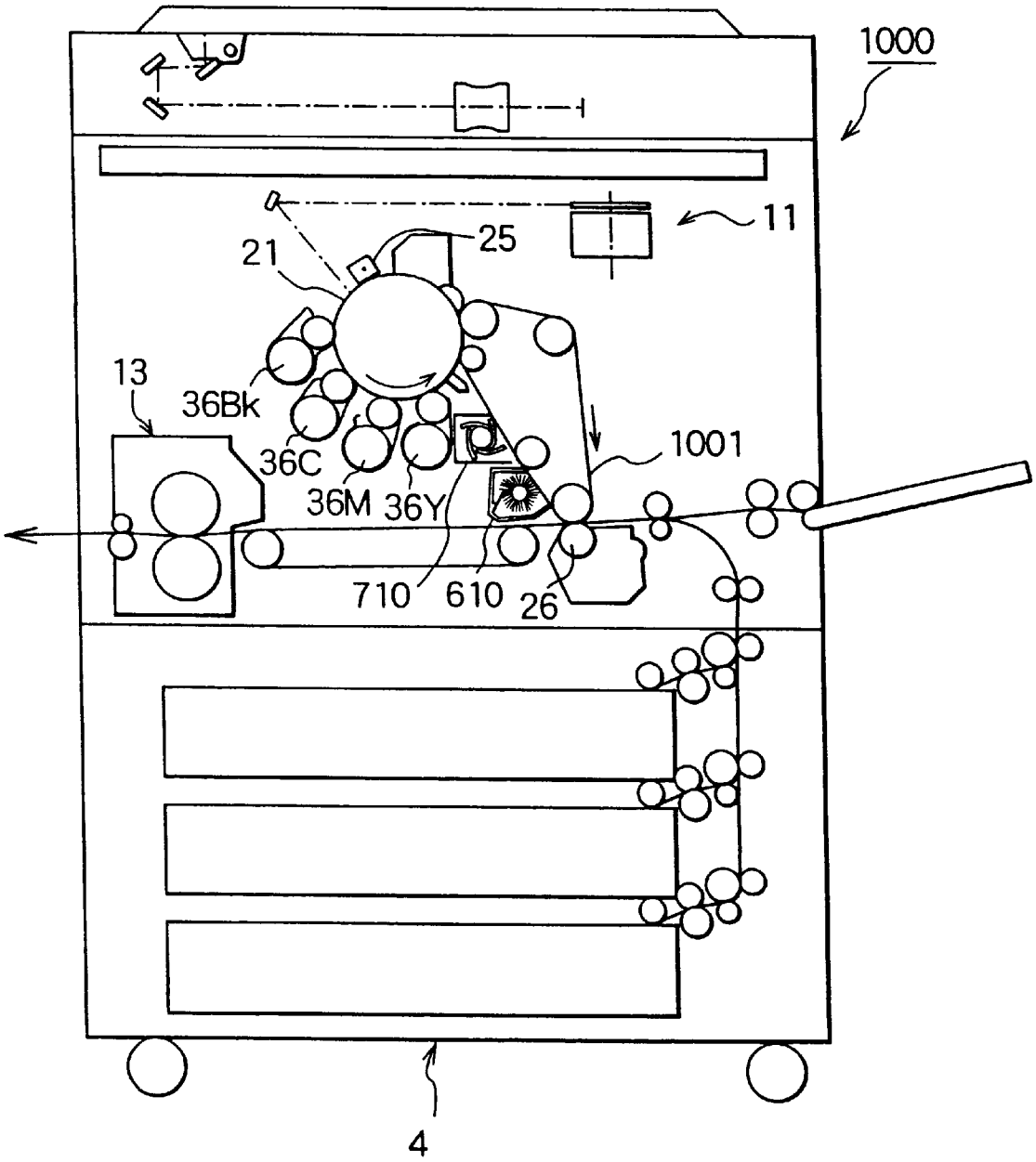
FIG. 35 is a cross-sectional view of an image forming apparatus of a modification according to the sixth embodiment.
Figure 36:
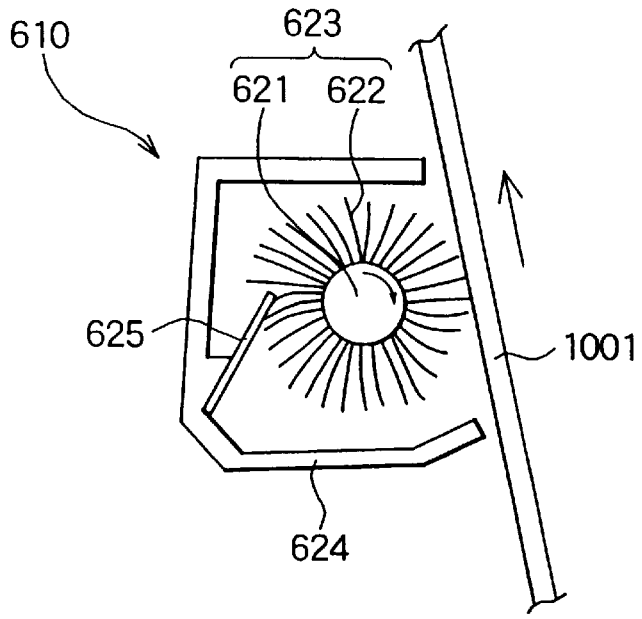
FIG. 36 is a cross-sectional view of the first paper-dust removing device employed in the image forming apparatus of FIG. 35.
Figure 37:
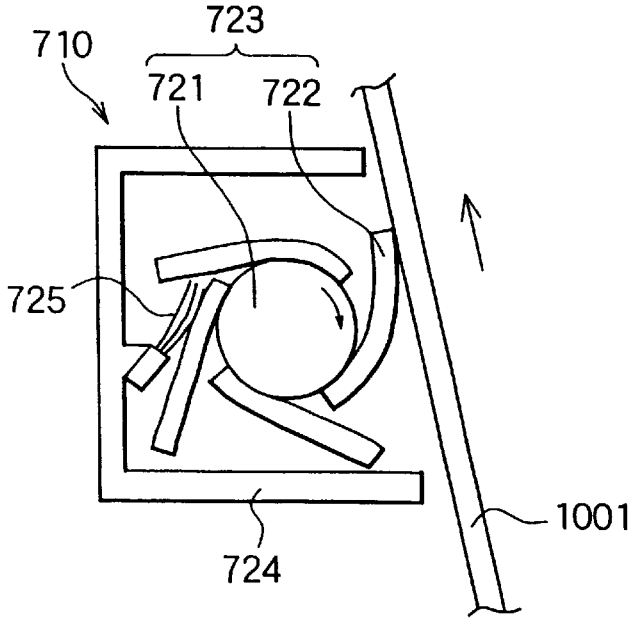
FIG. 37 is a cross-sectional view of the second paper-dust removing device employed in the image forming apparatus of FIG. 35.

In this example, as shown in FIG. 35, a first paper-dust removing device 610 having the configuration of FIG. 36 and a second paper-dust removing device 710 having the configuration of FIG. 37 can be mounted in the copy machine 1000. The first paper-dust removing device 610 of FIG. 36 has the same configuration as that of FIG. 33.

As shown in FIG. 37, the second paper-dust removing device 710 includes a casing 724, within which a paper dust removing roller 723 is rotatably provided. The paper dust removing roller 723 is constructed from a resilient or stiff roller 721 which is attached with several strip-shaped non-woven fabric sheets 722. Each non-woven fabric sheet 722 is attached at one edge thereof to the roller 721 so that the free end of each non-woven fabric sheet 722 will overlap with the fixed end of an adjacent sheet 722.

A drive mechanism (not shown) is provided for driving the roller 723 to rotate in the same direction as the intermediate transfer belt 1001. Accordingly, each non-woven fabric sheet 722 moves in the opposite direction to the intermediate transfer belt 1001 at a position where the non-woven fabric sheet 722 contacts the intermediate transfer belt 1001.

A scraping brush member 725 is additionally provided in the casing 724 so as to be capable of contacting with each non-woven fabric sheet 722. When paper dust removed by one non-woven fabric sheet 722 from the intermediate is to transfer belt 1001 clings to the non-woven fabric sheet 722, the scraping member 725 scrapes off the paper dust from the non-woven fabric sheet 722.

Because the first paper-dust removing device 610 has reliably removed pulp fiber clinging to the intermediate transfer belt 1001 at an upstream position from the second paper-dust removing device 710, pulp fiber will not accumulate where each non-woven fabric sheet 722 contacts the intermediate transfer belt 1001. Accordingly, each non-woven fabric sheet 722 can be positioned so as to be pressed against the intermediate transfer belt 1001 with extremely light touch. Therefore, filming can be prevented from occurring. Also, the wiping force of the non-woven fabric sheets 722 can reliably remove talc from the intermediate transfer belt 1001. Accordingly, paper dust can be reliably removed from the intermediate transfer belt 1001.

While the invention has been described in detail with reference to specific embodiments thereof, it would be apparent to those skilled in the art that various changes and modifications may be made therein without departing from the spirit of the invention.

For example, in the above-described embodiments, a positive polarity toner is used. However, a negative polarity toner can be used instead. Also, a crushed type toner can be used instead of the polymerized toner. When the negative polarity toner is used, then a charge control resin including an anion function group can be mixed in with toner material.

In the first and fifth embodiments, the photosensitive drum 21, the charge unit 25, the transfer roller 26, and the paper-dust removing device (110, 120, or 510) are mounted in the image forming cartridge 12. The image forming cartridge 12 is detachably mounted to the casing 2 of the laser printer 1. Contrarily, in the second through fourth, and sixth embodiments, the photosensitive drum 21, the charge unit 25, the transfer roller 26, and the paper-dust removing device (210–250, 310–340, 410, 510, or 610 and 710) are mounted directly to the casing 2 of the laser printer 1. However, similarly to the first and fifth embodiments, the image forming cartridge 12 may be employed to mount therein the photosensitive drum 21, the charge unit 25, the transfer roller 26, and the paper-dust removing device (210–250, 310–340, 410, 510, or 610 and 710). It is noted that the image forming cartridge 12 is constructed from a combination of the drum cartridge 20 and the development cartridge 12. The paper-dust removing devices 210–250, 310–340, 410, 510, and 610 are mounted in the drum cartridge 20. The paper-dust removing device 710 may be mounted to either the drum cartridge 20 or the development cartridge 36 according to the structure of the paper-dust removing device 710. The transfer roller 26 may not be mounted in the image forming cartridge 12, but may be directly mounted to the housing 2.

What is claimed is:

1. An image forming apparatus, comprising:

an image bearing body having a surface that bears thereon a visible image that is formed through development of an electrostatic latent image by developing agent and that moves along a predetermined moving path in a predetermined moving direction, thereby carrying the visible image;

a transfer member positioned in a predetermined transfer position along the moving path, the transfer member transferring the visible image from the image bearing body onto a recording medium;

a first paper dust removing member that is positioned in a first predetermined position along the moving path downstream from the predetermined transfer position in the moving direction, the first paper dust removing member contacting the surface of the image bearing body to remove a first component in paper dust that clings to the surface of the image bearing body; and a second paper dust removing member that is positioned in a second predetermined position along the moving path downstream from the first predetermined position in the moving direction, the second paper dust removing member contacting the surface of the image bearing body to remove a second component in the paper dust.

2. An image forming apparatus as claimed in claim 1, wherein the first paper dust removing member includes a brush, and wherein the second paper dust removing member includes a fiber material.

3. An image forming apparatus as claimed in claim 2, wherein the second paper dust removing member is formed from either one of a non-woven fabric, a woven fabric, and a knitted fabric.

4. An image forming apparatus as claimed in claim 2, wherein the first paper dust removing member includes a roll-shaped brush.

5. An image forming apparatus as claimed in claim 2, wherein the first paper dust removing member includes:

a paper dust accommodating member having a wall defining a space and an opening communicated with the space; and a brush member fixedly attached to the paper dust accommodating member, the wall defining the opening to be positioned at a predetermined position and to have a predetermined size, thereby allowing the paper dust, removed by the brush member, to fall due to gravitational force to enter the space.

6. An image forming apparatus as claimed in claim 1, further comprising:

a frame; and a developing unit developing, with the developing agent, the electrostatic latent image into the visible image, the developing unit being detachably mounted to the frame, the second paper dust removing member being attached to the developing unit.

7. An image forming apparatus as claimed in claim 1, further comprising a developing unit developing, with the developing agent, the electrostatic latent image into the visible image, wherein the developing unit collects, for later development, residual developing agent that remains on the image bearing body after the transfer operation.

8. An image forming apparatus as claimed in claim 7, wherein the developing agent includes polymerized toner that is produced through polymerization of polymerizing monomer.

9. An image forming apparatus as claimed in claim 1, wherein the first paper dust removing member contacts the surface of the image bearing body with a contact force of an amount that maintains a pattern of the visible image after its contact with the surface of the image bearing body.

10. An image forming apparatus as claimed in claim 1, wherein the second paper dust removing member contacts the surface of the image bearing body with a contact force of an amount that maintains a pattern of the visible image after its contact with the surface of the image bearing body.

11. An image forming apparatus as claimed in claim 10, further comprising a frame supporting the image bearing body, wherein the second paper dust removing member includes:

a base member whose one end is fixed to the frame; and a contact member that is held by the base member and that contacts the surface of the image bearing body.

12. An image forming apparatus as claimed in claim 11, wherein the contact member is made from a non-woven fabric.

13. An image forming apparatus as claimed in claim 1, wherein the image bearing body conveys the visible image to the transfer position where the transfer member transfers the visible image from the image bearing body onto the recording medium, and wherein the second paper dust removing member includes a contact member that contacts the image bearing body and that is made of fibers impregnated with oil agent.

14. An image forming apparatus as claimed in claim 13, wherein the second paper dust removing member further includes a rotatable support member that supports the contact member on its peripheral portion.

15. An image forming apparatus as claimed in claim 14, wherein the contact member includes a sheet member whose one end is attached to the support member and whose other end is a free end, the sheet member being impregnated with oil agent.

16. An image forming apparatus as claimed in claim 15, wherein the sheet member is made of either one of non-woven fabric, a woven fabric, and a knitted material.

17. An image forming apparatus as claimed in claim 13, wherein the contact member is made of either one of a fiber brush, a non-woven fabric, a woven fabric, and a knitted material.

18. An image forming apparatus as claimed in claim 13, wherein a contacting pressure, at which the contact member contacts the image bearing body, has substantially a zero value.

19. An image forming apparatus as claimed in claim 13, wherein the oil agent includes at least one of mineral oil, synthetic oil, silicone oil, and surfactant.

20. An image forming apparatus as claimed in claim 1, wherein the image bearing body includes a photosensitive body that forms the electrostatic latent image thereon and that then forms the visible image through development by the developing agent.

21. An image forming apparatus as claimed in claim 1, further comprising a photosensitive body that forms an electrostatic latent image thereon, wherein the image bearing body includes an intermediate transfer body that is located confronting the photosensitive body and that has an endless belt movable with respect to the photosensitive body.

22. An image forming apparatus as claimed in claim 1, wherein the second paper dust removing member includes:

a base member that is located in the vicinity of the moving path, along which the image bearing body moves, the base member being separated from the image bearing body with a predetermined amount of gap; and a sheet-shaped contact member that is made of fibers and formed into a sheet shape, the sheet-shaped contact member being supported by the base member to allow its contact portion to contact the image bearing body, the contact portion being separated from the base member.

23. An image forming apparatus as claimed in claim 22, wherein the sheet-shaped contact member is made from either one of a non-woven fabric, a woven fabric, and a knitted material.

24. An image forming apparatus as claimed in claim 22, wherein the sheet-shaped contact member has one end fixed to the base member and the other end contacting the image bearing body.

25. An image forming apparatus as claimed in claim 22, wherein the sheet-shaped contact member has both ends fixed to the base member and an intermediate portion that is defined between the both ends and that does not contact the base member, the intermediate portion contacting the image bearing body.

26. An image forming apparatus as claimed in claim 22, wherein the base member has a roller shape having a predetermined outer diameter, and wherein the sheet-shaped contact member has a tubular shape supported on the base member, the tubular shape having an inner side confronting the base member and an outer side confronting the image bearing body, the tubular shape having an inner diameter greater than the predetermined outer diameter, the tubular shape contacting the image bearing body at a portion on its outer side whose corresponding portion on the inner side is out of contact with the base member.

27. An image forming apparatus as claimed in claim 22, wherein the base member includes a rotating member that rotates around an axis extending perpendicularly to the moving direction, in which the image bearing body moves, the sheet-shaped contact member contacting the image bearing body according to the rotation of the base member.

28. An image forming apparatus as claimed in claim 1, wherein the second paper dust removing member includes:

a base member that is located in the vicinity of the moving path, along which the image bearing body moves, the base member being separated from the image bearing body with a predetermined amount of gap; and a contact member that is made of fibers and that is supported by the base member to allow its portion to contact the image bearing body, wherein the base member is located vertically higher than a contact portion where the contact member contacts the image bearing body, the contact member hanging down from the base member due to a gravitational force to contact the image bearing body.

29. An image forming apparatus as claimed in claim 28, wherein the contact member is formed from either one of a non-woven fabric, a woven fabric, and a knitted material.

30. An image forming apparatus as claimed in claim 28, wherein the contact member has one end fixed to the base member, the contact member having the other end that hangs down from the base member due to gravitational force, thereby contacting the image bearing body.

31. An image forming apparatus as claimed in claim 28, wherein the contact member has both ends, fixed to the base member, and an intermediate portion that is defined between the both ends and that is not contacted with the base member, the intermediate portion hanging down from the base member due to gravitational force, thereby contacting the image bearing body.

32. An image forming apparatus as claimed in claim 28, wherein the base member has a roller shape having a predetermined outer diameter, and wherein the contact member includes a tubular shape whose inner diameter being greater than the predetermined outer diameter and that is supported by the base member with a portion of the contact member contacting the base member, another portion of the contact member that is out of contact with the base member hanging down due to gravitational force to contact the image bearing body.

33. An image forming apparatus as claimed in claim 28, wherein the contact member has a sheet shape.

34. An image forming apparatus as claimed in claim 1, wherein the second paper dust removing member includes:

a resilient base member that is located in the vicinity of the moving path, along which the image bearing body moves, the resilient base member being formed from resilient material and being elongated in a direction that intersects with the moving direction in which the image bearing body moves; and a contact member that is made of fibers and that is located between the resilient base member and the image bearing body, the contact member being applied with an urging force from the resilient base member to thereby contact the image bearing body.

35. An image forming apparatus as claimed in claim 34, wherein the contact member is formed from either one of a non-woven fabric, a woven fabric, and a knitted material.

36. An image forming apparatus as claimed in claim 34, wherein the resilient base member is made of foam resilient material.

37. An image forming apparatus as claimed in claim 34, further comprising a support member that is located with a gap being formed between the support member and the image bearing body, wherein the resilient base member has one side that extends along its elongated direction and that is fixed to the support member, the resilient base member having an opposite side that confronts the image bearing body, the opposite side having a corner edge that is elongated in the direction intersecting with the moving direction, in which the image bearing body moves, the corner edge allowing the contact member to contact the image bearing body surface.

38. An image forming apparatus as claimed in claim 34, wherein the resilient base member has a cross-section along a plane normal to the elongated direction of the resilient base member, the cross-section having four sides.

39. An image forming apparatus as claimed in claim 38, wherein one side of the four-sided cross-section, at which the resilient base member is fixed to the support member, is shorter than two sides that extend to protrude from the support member in a direction toward the image bearing body, and wherein when the image bearing body moves, the free end of the resilient base member that protrudes away from the support member resiliently deforms in the moving direction, in which the image bearing body moves, the contact member contacting the image bearing body surface on a corner edge of the resilient base member that is located on the deformed free end at an upstream side with respect to the moving direction.

40. An image forming apparatus as claimed in claim 1, wherein the second paper dust removing member includes:

a resilient base member that is located in the vicinity of the moving path, along which the image bearing body moves, the resilient base member being formed from foam resilient material and being elongated in a direction intersecting with the moving direction in which the image bearing body moves; and a contact member that is made of fibers and that is located between the resilient base member and the image bearing body, the contact member being applied with an urging force from the resilient base member to thereby contact the image bearing body, wherein the resilient base member has a corner edge portion, at which the resilient base member causes the contact member to contact the image bearing body surface along the direction intersecting with the moving direction, the contact member being located between the corner edge portion of the resilient base member and the image bearing body.

41. An image forming apparatus as claimed in claim 40, wherein the contact member is formed from either one of a non-woven fabric, a woven fabric, and a knitted material.

42. An image forming apparatus as claimed in claim 1, wherein the second paper dust removing member includes:

a sheet-shaped base member that is formed in a sheet shape; and a contact member attached to the sheet-shaped base member, the contact member being made from fibers, the base member being positioned relative to the image bearing body so as to cause the contact member to contact the image bearing body.

43. An image forming apparatus as claimed in claim 42, wherein the contact member is formed from either one of a non-woven fabric, a woven fabric, and a knitted material.

44. An image forming apparatus as claimed in claim 42, wherein the sheet-shaped base member is positioned so as to resiliently bend in the same direction with the moving direction in which the image bearing body moves at least when the image bearing body is driven to move.

45. An image forming apparatus as claimed in claim 42, further comprising an additional paper dust removing member that is formed from a brush and that is located between the contact portion where the contact member contacts the image bearing body and the transfer position where the transfer operation is performed.

46. An image forming apparatus as claimed in claim 42, wherein the sheet-shaped base member is made of a resin sheet member.

47. An image forming apparatus as claimed in claim 42, wherein the sheet-shaped base member is made of a rubber sheet member.

48. An image forming cartridge detachably mounted to an image forming apparatus, the image forming cartridge comprising:

an image bearing body having a surface that bears thereon a visible image that is formed through development of an electrostatic latent image by developing agent and that moves along a predetermined moving path in a predetermined moving direction to carry the visible image to a predetermined transfer position;

a first paper dust removing member that is positioned in a first predetermined position along the moving path downstream from the predetermined transfer position in the moving direction, the first paper dust removing member contacting the surface of the image bearing body to remove a first component in paper dust that clings to the surface of the image bearing body; and a second paper dust removing member that is positioned in a second predetermined position along the moving path downstream from the first predetermined position in the moving direction, the second paper dust removing member contacting the surface of the image bearing body to remove a second component in the paper dust.

49. An image forming apparatus, comprising:

an image bearing body having a surface that bears thereon a visible image which is formed through development of an electrostatic latent image by developing agent, the image bearing body conveying the visible image to a predetermined transfer position;

a transfer member located on the transfer position for transferring the visible image from the image bearing body onto a recording medium;

a paper dust removing member for removing paper dust clinging to the surface of the image bearing body after the visible image is transferred from the image bearing body onto the recording medium, the paper dust removing member including a contact portion that contacts the image bearing body and that is made of fibers impregnated by oil agent.

50. An image forming apparatus, comprising:

an image bearing body having a surface that bears thereon a visible image which is formed through development of an electrostatic latent image by developing agent, the image bearing body moving along a predetermined moving path to thereby convey the visible image to a predetermined transfer position;

a transfer member located on the transfer position for transferring the visible image from the image bearing body onto a recording medium;

a paper dust removing member for removing paper dust clinging to the surface of the image bearing body after the visible image is transferred from the image bearing body onto the recording medium, wherein the paper dust removing member includes:

a base member that is located in the vicinity of the moving path, along which the image bearing body moves, the base member being separated from the image bearing body with a predetermined amount of gap; and a sheet-shaped contact member that is made of fibers and formed in a sheet shape, the sheet-shaped contact member being supported by the base member to allow its contact portion to contact the image bearing body, the contact portion being separated from the base member, wherein the sheet-shaped contact member is made from either one of a non-woven fabric, a woven fabric, and a knitted material.

51. An image forming apparatus as claimed in claim 50, wherein the sheet-shaped contact member has one end fixed to the base member and the other end contacting the image bearing body.

52. An image forming apparatus as claimed in claim 50, wherein the sheet-shaped contact member has both ends fixed to the base member and an intermediate portion that is defined between the both ends and that does not contact with the base member, the intermediate portion contacting the image bearing body.

53. An image forming apparatus as claimed in claim 50, wherein the base member has a roller shape having a predetermined outer diameter, and wherein the sheet-shaped contact member has a tubular shape supported on the base member, the tubular shape having an inner side confronting the base member and an outer side confronting the image bearing body, the tubular shape having an inner diameter greater than the predetermined outer diameter, the tubular shape contacting the image bearing body at a portion on its outer side whose corresponding portion on the inner side is out of contact with the base member.

54. An image forming apparatus as claimed in claim 50, wherein the base member includes a rotating member that rotates around an axis extending perpendicularly to the moving direction, in which the image bearing body moves, the sheet-shaped contact member contacting the image bearing body according to the rotation of the base member.

55. An image forming apparatus, comprising:

an image bearing body having a surface that bears thereon a visible image which is formed through development of an electrostatic latent image by developing agent, the image bearing body moving along a predetermined moving path to thereby convey the visible image to a predetermined transfer position;

a transfer member located on the transfer position for transferring the visible image from the image bearing body onto a recording medium;

a paper dust removing member for removing paper dust clinging to the surface of the image bearing body after the visible image is transferred from the image bearing body onto the recording medium, wherein the paper dust removing member includes:

a base member that is located in the vicinity of the moving path, along which the image bearing body moves, the base member being separated from the image bearing body with a predetermined amount of gap; and a contact member that is made of fibers and that is supported by the base member to allow its portion to contact the image bearing body, wherein the base member is located vertically higher than the portion of the contact member that contacts the image bearing body, the contact member hanging down from the base member due to a gravitational force to contact the image bearing body.

56. an image forming apparatus, comprising:

an image bearing body having a surface that bears thereon a visible image which is formed through development of an electrostatic latent image by developing agent, the image bearing body moving along a predetermined moving path in a predetermined moving direction to thereby convey the visible image to a predetermined transfer position;

a transfer member located on the transfer position for transferring the visible image from the image bearing body onto a recording medium;

a supporting member that is located with a gap being formed between the support member and the image bearing body;

a paper dust removing member, supported by the support member, for removing paper dust clinging to the surface of the image bearing body after the visible image is transferred from the image bearing body onto the recording medium, wherein the paper dust removing member includes:

a resilient base member that is located in the vicinity of the moving path, along which the image bearing body moves, the resilient base member being formed from resilient material and being elongated in a direction intersecting with the moving direction in which the image bearing body moves; and a contact member that is made of fibers and that is located between the resilient base member and the image bearing body, the contact member being applied with an urging force from the resilient base member to thereby contact the image bearing body, wherein the resilient base member has a cross-section along a plane normal to the elongated direction of the resilient base member, the cross-section having four sides, wherein one side of the four-sided cross-section, at which the resilient base member is fixed to the support member, is shorter than two sides that extend to protrude from the support member in a direction toward the image bearing body, and wherein when the image bearing body moves, the free end of the resilient base member that protrudes away from the support member resiliently deforms in the moving direction, in which the image bearing body moves, the contact member contacting the image bearing body surface on a corner edge of the resilient base member that is located on the deformed free end at an upstream side with respect to the moving direction.

57. An image forming apparatus, comprising:

an image bearing body having a surface that bears thereon a visible image which is formed through development of an electrostatic latent image by developing agent, the image bearing body moving along a predetermined moving path in a predetermined moving direction to thereby convey the visible image to a predetermined transfer position;

a transfer member located on the transfer position for transferring the visible image from the image bearing body onto a recording medium;

a support member that is located with a gap being formed between the support member and the image bearing body;

a paper dust removing member, supported by the support member, for removing paper dust clinging to the surface of the image bearing body after the visible image is transferred from the image bearing body onto the recording medium, wherein the paper dust removing member includes:

a resilient base member that is located in the vicinity of the moving path, along which the image bearing body moves, the resilient base member being formed from foam resilient material and being elongated in a direction intersecting with the moving direction in which the image bearing body moves; and a contact member that is made of fibers, that is formed from either one of a non-woven fabric, a woven fabric, and a knitted material, and that is located between the resilient base member and the image bearing body, the contact member being applied with an urging force from the resilient base member to thereby contact the image bearing body, the resilient base member having a support side that is fixed to the support member and a protrusion portion that protrudes from the support side in a direction toward the image bearing body, the protrusion portion having a cross-section along a plane normal to the elongated direction of the resilient base member, the cross-section having at least two sides and a corner edge portion therebetween, the corner edge portion confronting the image bearing body, the contact member being provided to extend from at least a part of one side among the at least two sides toward at least a part of another side among the at least two sides over the corner edge portion, the corner edge portion of the resilient base member causing the contact member to contact the image bearing body surface along the direction intersecting with the moving direction, the contact member being located between the corner edge portion of the resilient base member and the image bearing body.

58. An image forming apparatus, comprising:

an image bearing body having a surface that bears thereon a visible image which is formed through development of an electrostatic latent image by developing agent, the image bearing body conveying the visible image to a predetermined transfer position;

a transfer member located on the transfer portion for transferring the visible image from the image bearing body onto a recording medium;

a paper dust removing member for removing paper dust clinging to the surface of the image bearing body after the visible image is transferred from the image bearing body onto the recording medium, wherein the paper dust removing member includes:

a sheet-shaped base member that is formed in a sheet shape; and a contact member that is made of fibers, that is formed from either one of a non-woven fabric, a woven fabric, and a knitted material, and that is attached to a tip end of the sheet-shaped base member, the base member being positioned relative to the image bearing body so as to resiliently bend in the same direction with the moving direction in which the image bearing body moves at least when the image bearing body is driven to move, thereby causing the contact member to contact the image bearing body.

* * * * *